US012312823B2

(12) United States Patent
Girard

(10) Patent No.: US 12,312,823 B2
(45) **Date of Patent: *May 27, 2025**

(54) PORTABLE MULTI-HINGED SHELTER

(71) Applicant: Mark Timothy Girard, Darwin, MN (US)

(72) Inventor: Mark Timothy Girard, Darwin, MN (US)

( * ) Notice: Subject to any disclaimer, the term of this patent is extended or adjusted under 35 U.S.C. 154(b) by 197 days.

This patent is subject to a terminal disclaimer.

(21) Appl. No.: 17/988,761

(22) Filed: Nov. 17, 2022

(65) Prior Publication Data

US 2023/0151634 A1 May 18, 2023

Related U.S. Application Data

(63) Continuation-in-part of application No. 17/866,494, filed on Jul. 16, 2022.

(60) Provisional application No. 63/280,027, filed on Nov. 16, 2021.

(51) Int. Cl.
*E04H 15/06* (2006.01)

(52) U.S. Cl.
CPC ..... *E04H 15/06* (2013.01)

(58) Field of Classification Search
CPC ..... E04H 15/05
See application file for complete search history.

(56) References Cited

U.S. PATENT DOCUMENTS

| | | | | |
|---|---|---|---|---|
| 2,054,673 | A * | 9/1936 | Alonzo | E04H 15/06 135/88.13 |
| 3,006,353 | A * | 10/1961 | Richardson | E04H 15/06 135/96 |
| 4,088,363 | A * | 5/1978 | Palmer | B60P 3/341 135/88.13 |
| 6,017,081 | A * | 1/2000 | Colby | B60P 3/341 296/168 |
| 6,802,327 | B2 * | 10/2004 | Koss | E04H 15/38 296/159 |
| 11,371,255 | B2 * | 6/2022 | Frederickson | B60J 7/1621 |

* cited by examiner

*Primary Examiner* — David R Dunn
*Assistant Examiner* — Danielle Jackson
(74) *Attorney, Agent, or Firm* — Michael A. Mochinski

(57) ABSTRACT

A portable multi-hinged shelter for housing one or more individuals and storing gear commonly associated with outdoor excursions and like activities, which includes a box frame mounted atop of and connected to an open cargo bay of a vehicle and fitted with a secondary shelter shell and a supportive wind wall removably attached to the box frame and pivotally connected to a lower wind wall and sideward arms of a moveable frame assembly. The moveable frame assembly further includes primary and secondary canopies pivotally connected to the sideward arms and a ground brace pivotally connected to the primary canopy that collectively accept and support attachment of a primary shelter shell, whereby manual manipulation and adjustment of angular moveable supports or alternative telescopic supports that interact with select structural aspects of the supportive wind wall and moveable frame assembly yields expansion and contraction of the moveable frame assembly respectively for occupancy and compact transport alongside the vehicle.

32 Claims, 37 Drawing Sheets

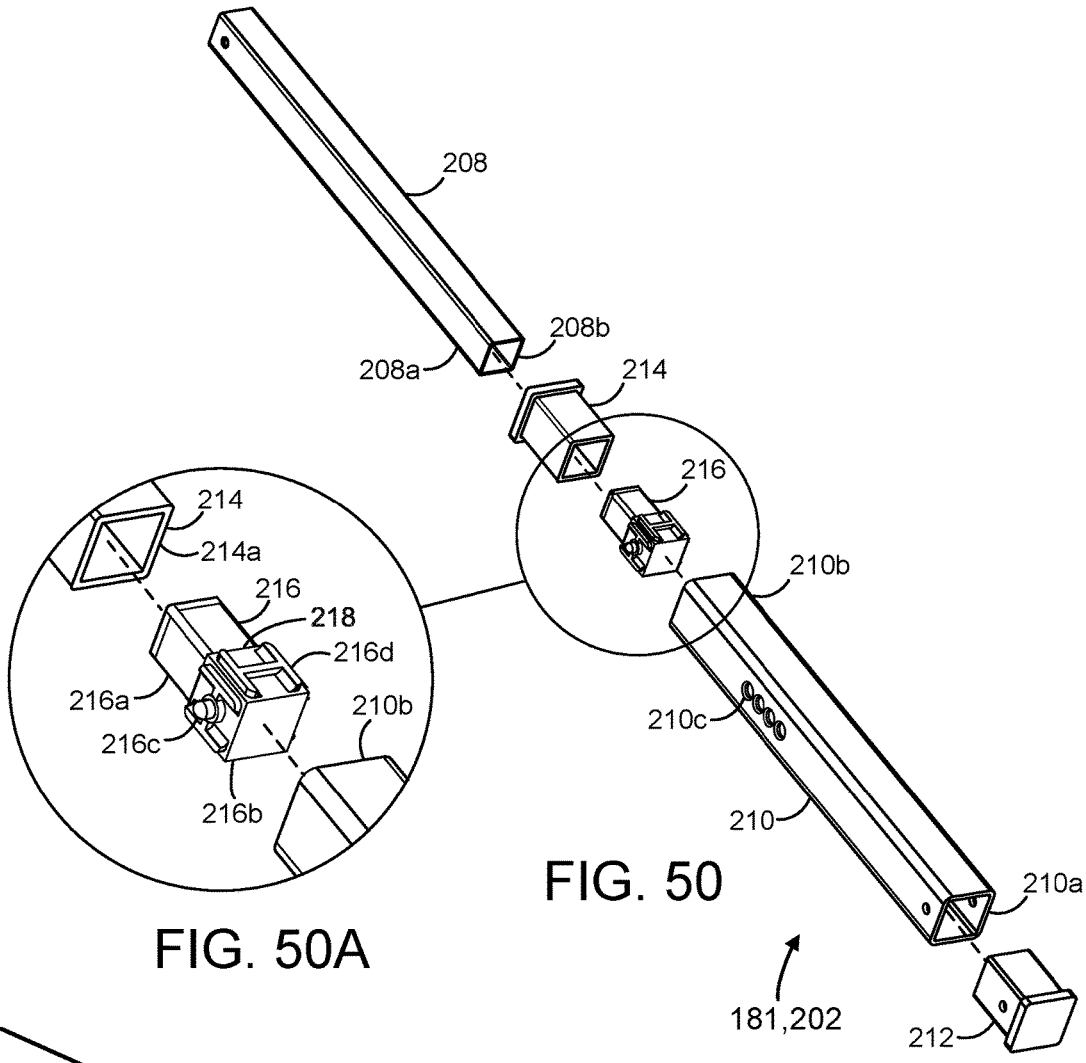
FIG. 50
FIG. 50A
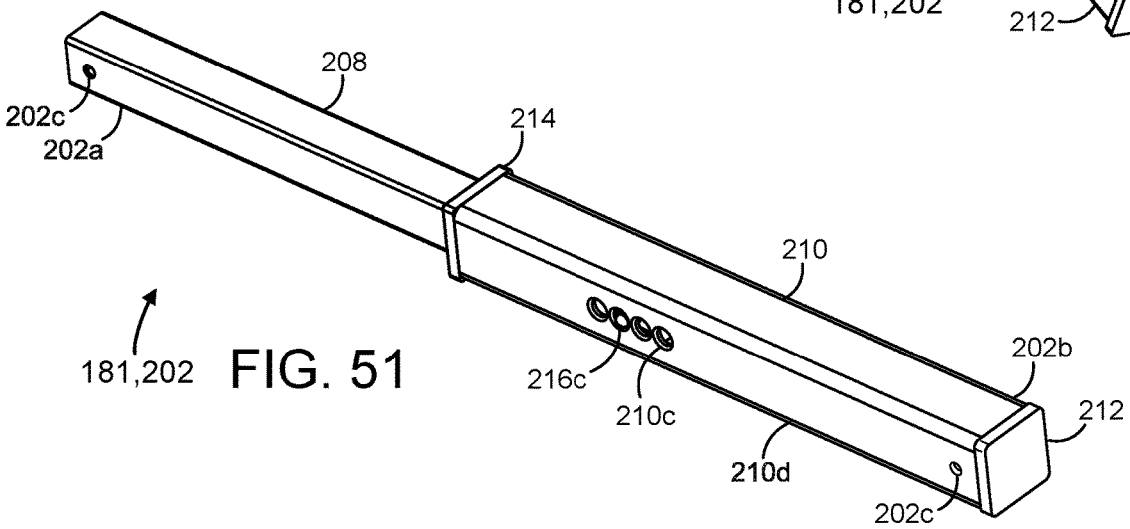
FIG. 51

PORTABLE MULTI-HINGED SHELTER

CROSS-REFERENCE TO RELATED APPLICATIONS

This application is a continuation-in-part of U.S. application Ser. No. 17/866,494, filed Jul. 16, 2022, entitled "Portable Multi-hinged Shelter," which claims the benefit of U.S. Provisional Application No. 63/280,027, filed Nov. 16, 2021, entitled "Multi-hinged Fishing Shelter," the disclosures of which, including all attached documents, are incorporated herein by reference in their entirety for all purposes.

FIELD OF THE INVENTION

The present invention is largely directed to a portable multi-hinged shelter for attachment to and operation with vehicles generally equipped with an open cargo bay or bed, such as a truck, a utility terrain vehicle (UTV), an all-terrain vehicle (ATV), or equivalent. More particularly, the portable multi-hinged shelter offers manual operation for expansion to form an enclosure for occupancy by multiple individuals and storage of cargo and the like and contraction to facilitate convenient self-storage on the vehicle for effectual transport to varying locations or destinations.

BACKGROUND OF THE INVENTION

Portable shelters or enclosures are often utilized in recreational activities such as ice fishing and camping to protect the enthusiast from the cold and sometimes harsh climatic conditions. Ice fishing, for example, is a popular and favorite outdoor sport or hobby held typically in northern regions of many countries with cold climatic conditions, often necessitating the need for some form of protective enclosure or shelter. Ice fishing in general involves catching fish from atop of an ice sheet formed on a body of water. Access to the aquatic environment that underlies the ice sheet is mainly achieved by drilling or cutting a hole through the ice sheet of sizable dimension to allow ample room for adequately accommodating passage of fish line, a fish catch of varying size and weight, and ancillary fishing equipment like that of a sonar fish finder without undue hinderance and difficulty. Some ice fishing enthusiasts or anglers desirably participate in the sport within the open environment so as take in the fresh air, while others may preferably reside within the comforts of an enclosure to protect them from the elements and harsh cold conditions.

Enclosures directed for this purpose may vary in type and size, with some being of the semi-permanent type fabricated from metal or wood to resemble a structured shed or shack and optionally fitted with wheels or skids to fulfill relocation relatively about the ice sheet as may be desired from time to time, whereas other types of enclosures may be extensively portable in nature. Portable shelters that often fulfill the enthusiastic angler's requirements are typically inexpensive, can accommodate one or more persons, albeit generally limited in number, lightweight for transport to and from the body of water, and incorporate features for quick assembly and disassembly so that one may desirably relocate the shelter coincident to the movement of feeding fish for attainment of the ultimate catch.

The construct of and features associated with portable fishing shelters are recognized in the art to vary by some degree, but are generally represented by three basic design types: a pop-up tent, a rigid sled incorporating a flip-over tent, and a flip-over tent connectively adapted to a utility terrain vehicle (UTV) or equivalent.

As considered the most basic form of a portable fishing shelter, the pop-up tent fishing shelter is usually featured with similar components as one would find for a tent used in camping, absent an integrated floor structure. This type of the portable shelter typically includes a light-weighted assembly of flexible poles hingedly mounted to and extending from hubs to expand outwardly and forcibly act against an all-encompassing, water-proof fabric skin to rigidly form a structured enclosure suited for occupancy and containment of a minimal amount of fishing gear and the like. Although pop-tent shelters are rather inexpensive and light-weighted for carry and assembly by an individual fishing angler, they can be cumbersome in fulfilling the capability of transporting the desirable amount of fishing gear with that of the pop-up tent, in addition to the difficulty associated with setup, particularly in relation to embedding the requisite anchors within the ice sheet and connecting lines to structural aspects of the pop-up tent to consummate the assembly.

In an extended version or variation of the pop-up tent fishing shelter described above, the rigid sled with the flip-over tent type of fishing shelter incorporates within the structure of the sled a pair of sideward anchoring plates that offers mounting of one or more swinging canopy supports that selectively connect in part to an outer, waterproof skin and pivotally rotate relative to the anchoring plate to spatially expand and relocate the outer skin from within the confines of the sled to structurally form an enclosure for occupancy and containment of a limited amount of fishing gear. Like the pop-up tent fishing shelter, the canopy supports inherently possess capabilities to extend outwardly and forcibly act against the outer skin and lock in place to consummate the assembly. Although this type of fishing shelter conveniently offers onboard storage of the outer skin and associated canopy supports to admirably advance aspects portability for transport to the body of water and relocation relatively about the ice sheet at moment's notice, there is a tendency for premature wear and tear of operative components and hardware as well as calamitous opportunities for damaging fishing gear and sensitive equipment due to traversing over rough sheets of ice and mounds of snow, particularly if the sled is being transported behind a moving vehicle like that of a snowmobile or UTV and the like. Additionally, this type of fishing shelter, like that of the pop-tent type, is spatially limited for occupancy and storage of fishing gear, can be difficult for one to manage setup during adverse climatic and windy conditions, and with due consideration of its weight and overall bulkiness and sizable dimension, can be problematic for the individual user to load and unload the fishing shelter respectively into and from the vehicle, which, on most occasions, necessitates use of a truck or an equivalent type of vehicle offering sizable holding capacity.

Like the two previously described portable fishing shelters, the flip-over tent for UTV's utilizes a plurality of flexible canopy supports and an attachable stretchable fabric skin capable of being attached to and expanded outwardly from the UTV to form an enclosure, generally offering a minimal footprint with limited overall spatial capacity for comfortably accommodating multiple anglers and fishing gear. As with most designs of this type, the flexible canopy supports and attachable fabric skin typically collapse or fold together to attain a level of compactness for convenient storage within the spatial confines of a cargo bay or bed of the UTV, which in turn adversely limits the vehicle's onboard storage capacity for carrying fishing gear and ancillary necessities. Although this type of portable fishing shelter may possess practicality and convenience for most anglers, there still remains unresolved issues of utilizing flexible canopy supports that are inherently difficult to manage during adverse, climatic conditions and are prone to breakage. Furthermore, inadvertent jarring of the vehicle during travel and snow and ice unwantedly accumulating within the bed of the UTV may unduly compromise vital operating components of the flip-over tent as well as fishing gear that may accompany transport therewith.

Accordingly, there remains a need for a portable multi-hinged shelter that is adaptable for use with most vehicle types having an open cargo bay or bed and incorporates structural components for readily forming a structural enclosure that sufficiently and comfortably accommodates one or more individuals and accompanying gear and attains a level of compactness for onboard storage on the vehicle without unduly compromising the vehicle's overall spatial capacity to stow and transport ancillary necessities and items typically relating to an outdoor excursion.

BRIEF SUMMARY OF THE INVENTION

In order to overcome the numerous drawbacks apparent in the prior art, a portable multi-hinged shelter has been devised for readily attaching to and conjunctively operating with a variety of vehicle types that generally incorporate an open cargo bay or bed, such as a truck, a utility terrain vehicle (UTV), an all-terrain vehicle (ATV), or equivalent.

It is an object of the present invention to provide a portable multi-hinged shelter that includes structural components to readily fulfill expansion of an attachable fabric skin to form a protective enclosure for occupancy of one or more individuals and storage of accompanying gear and ancillary necessities, while equally possessing the capabilities to readily contract or fold together to attain a level of compactness for transport.

It is a further object of the present invention to provide a portable multi-hinged shelter that retains the onboard storage capacity of the vehicle so as adequately accommodate storage of accompanying gear and ancillary necessities without unduly compromising the comfort of passengers situated within the vehicle.

It is yet another object of the present invention to provide a portable multi-hinged shelter that is relatively simple in terms of design and construction and fabricated from corrosion resistant materials to sustain long-term use and operation in harsh climatic conditions.

It is yet another object of the present invention to provide a portable multi-hinged shelter that offers stowable bench seating for advancing comfort to individuals and ample storage capacity within the formed enclosure for immediate, convenient access to accompanying gear and ancillary equipment.

It is yet another object of the present invention to provide a portable multi-hinged shelter that consists of modular structural components for readily effecting repair and replacement of damaged or failed components.

It is a further object of the present invention to provide a portable multi-hinged shelter that is capable of being held within the height and width of the vehicle's dimensional relationship while in a folded, compact arrangement so as to afford unhindered travel into and out of a trailer, a garage, or other forms of storage accommodations.

In accordance with the present invention, a portable multi-hinged shelter has been devised to comfortably house one or more occupants and fulfill convenient and accessible storage of accompanying gear during outdoor excursions and like activity, the portable multi-hinged shelter includes a box frame mountably situated atop of sidewalls of an open cargo bay of a transport vehicle and connecting to a moveable frame assembly by way of a supportive wind wall that equally connects to a lower wind wall, the box frame further includes provisions for storage of items on one or more shelf platforms while maintaining a sufficient amount of loading capacity of the cargo bay and permits attachment of a secondary shelter shell for forming a protective enclosure, the moveable frame assembly further includes primary and secondary canopies and a ground brace that are individually capable of pivotal movement and permit attachment of a primary shelter shell, whereby angular moveable supports or telescopic supports in connection with the supportive wind wall and moveable frame assembly permits manual capabilities for expansion and contraction of the moveable frame assembly respectively for occupancy and convenient transport alongside the vehicle without unduly hindering the vehicle's safe operation.

Other objects, features, and advantages of the present invention will become apparent in the following detailed description of the preferred embodiments thereof when read in conjunction with the accompanying drawings in which like reference numerals depict the same parts in the various views.

BRIEF DESCRIPTION OF THE SEVERAL VIEWS OF THE DRAWINGS

A preferred embodiment of the present invention will now be described by way of example with reference to the accompanying drawings, in which:

FIG. 50 is an exploded perspective view of the preferred embodiment of the present invention illustrating a telescopic support having an elongate sleeve separable from an inner slidable support, a bushing, and a fitted stop mechanism;

FIG. 50A is a partial enlarged view of the preferred embodiment of the present invention illustrating a fitted stop mechanism associated with a telescopic support having an insertable end and enlarged portion with a spring-loaded pin;

FIG. 51 is a rear perspective view of the preferred embodiment of the present invention illustrating a telescopic support having an inner slidable support slidably fitting within an elongate sleeve;

DETAILED DESCRIPTION OF THE INVENTION

Figure 1:
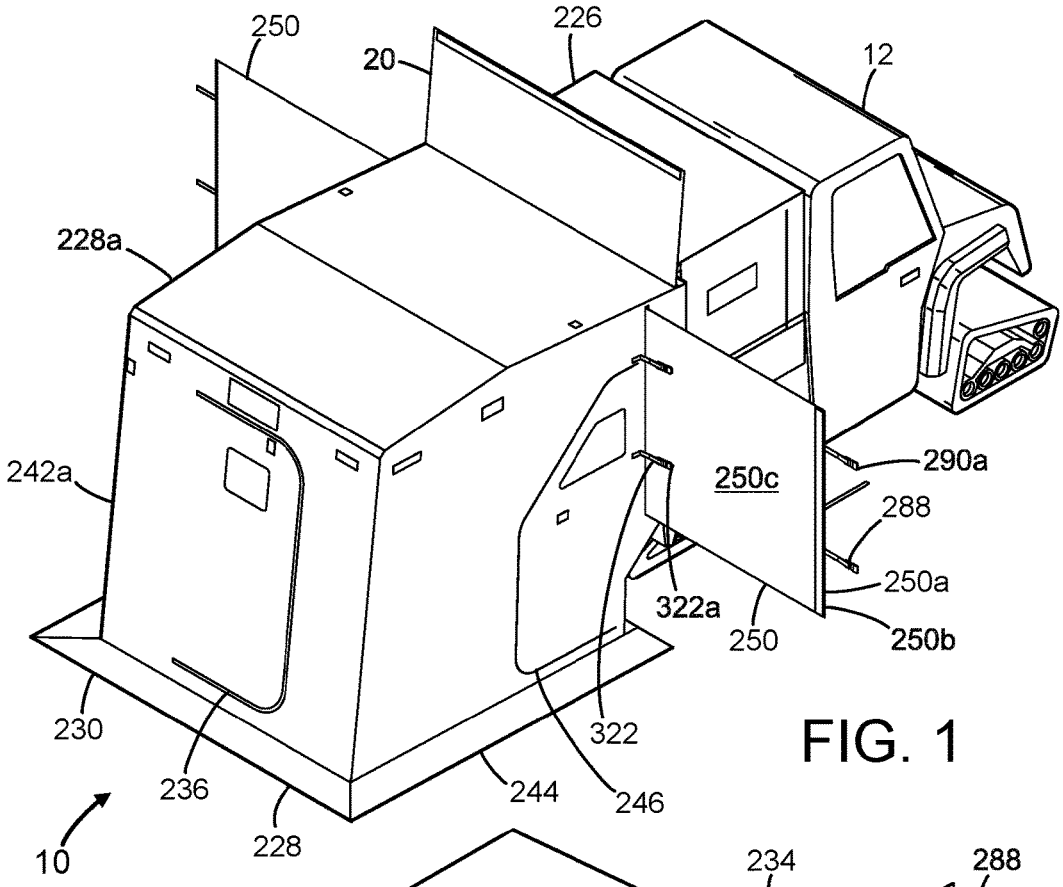
FIG. 1 is a rear perspective view of the preferred embodiment of the present invention illustrating a primary shelter shell joined to a secondary shelter shell collectively covering a box frame and moveable frame assembly and being attached to a vehicle.

While this invention is susceptible of being embodied in many different forms, the preferred embodiment of the invention is illustrated in the accompanying drawings and described in detail hereinafter with the understanding that the present disclosure purposefully exemplifies the principles of the present invention and is not intended to unduly limit the invention to the embodiments illustrated and presented herein. The present invention has particular utility as a portable shelter for outdoor excursions and like activities with structural features that readily advance assembly for immediate occupancy by one or more individuals and storage of accompanying gear and ancillary items, while equally possessing capabilities to attain a level of compactness for onboard, self-storage in connection with a variety of vehicle types.

Referring now to FIGS. 1-4, there is shown generally at 10 a portable multi-hinged shelter in expanded form and mounted and attached to a vehicle 12 of the particular type equipped with an open cargo bay 12*a* or bed, with a portion of the portable shelter extending outwardly from a rearward end 12*b* of the vehicle to advance an increase in spatial capacity for comfortably accommodating one or more individuals and storage of accompanying equipment and related gear. As further shown therein, the portable multi-hinged shelter includes a protective shell assembly 14 semi-permanently attached to and exteriorly covering a box frame 16 and a moveable frame assembly 18, in addition to incorporating an integral assembly of flaps 20 suited to protectively wrap and encase the moveable frame assembly while presented in collapsible form, primarily in preparation for transport.

The box frame 16 in FIGS. 5-8 preferentially resides above the open cargo bay 12*a* and is configured to attach to sidewalls 12*c* substantially forming the cargo bay of the vehicle and includes four corner posts 22 generally extending vertically in alignment with the sidewalls and perpendicular to a bottom surface 12*d* of the open cargo bay, with each of the corner posts having a first end 22*a* and a second end 22*b* respectively connecting to upper horizontal members 24 and lower horizontal members 26 by way of a three-way connector 28. The three-way connector in particular is shown in FIGS. 9-14 to include an aperture 30 extending through each of the three walls 28*a* of the three-way connector for accepting therethrough a cap screw 32 or equivalent, with a threaded end 32*a* thereof being threadably inserted within a cylindrical bore 22*c*, 24*a*, 26*a* extending lengthwise about the corner post as well as each of the upper and lower horizontal members. Accessible openings 34 supplement the three-way connector to allow access to and passage of the cap screw for advancing and consummating assembly. To promote proper alignment and positioning of the corner posts 22 with respect to the horizontal members 24, 26, the three-way connector as in FIGS. 11 and 12 incorporates within its structure an alignment member 36 extending outwardly from a backside 28*b* of each wall configured with the aperture for fitment within an open track 22*d*, 24*b*, 26*b* integrated within and extending lengthwise along each of the corner posts and horizontal members, generally formed within each as an extrusion. A corner cap 38 of the type depicted in FIGS. 13 and 14 encases the three-way connector, whereby connectivity is maintained by a pair of outward pins 40 that engage and snap in place within corners of an open side 28*c* of the three-way connector 28, while a pair of inversed grooved slides 42 engagingly mate with an equally configured pair of inversed grooved slides 44 integrated within the structure of the three-way connector's walls bearing the accessible openings.

Figure 7:
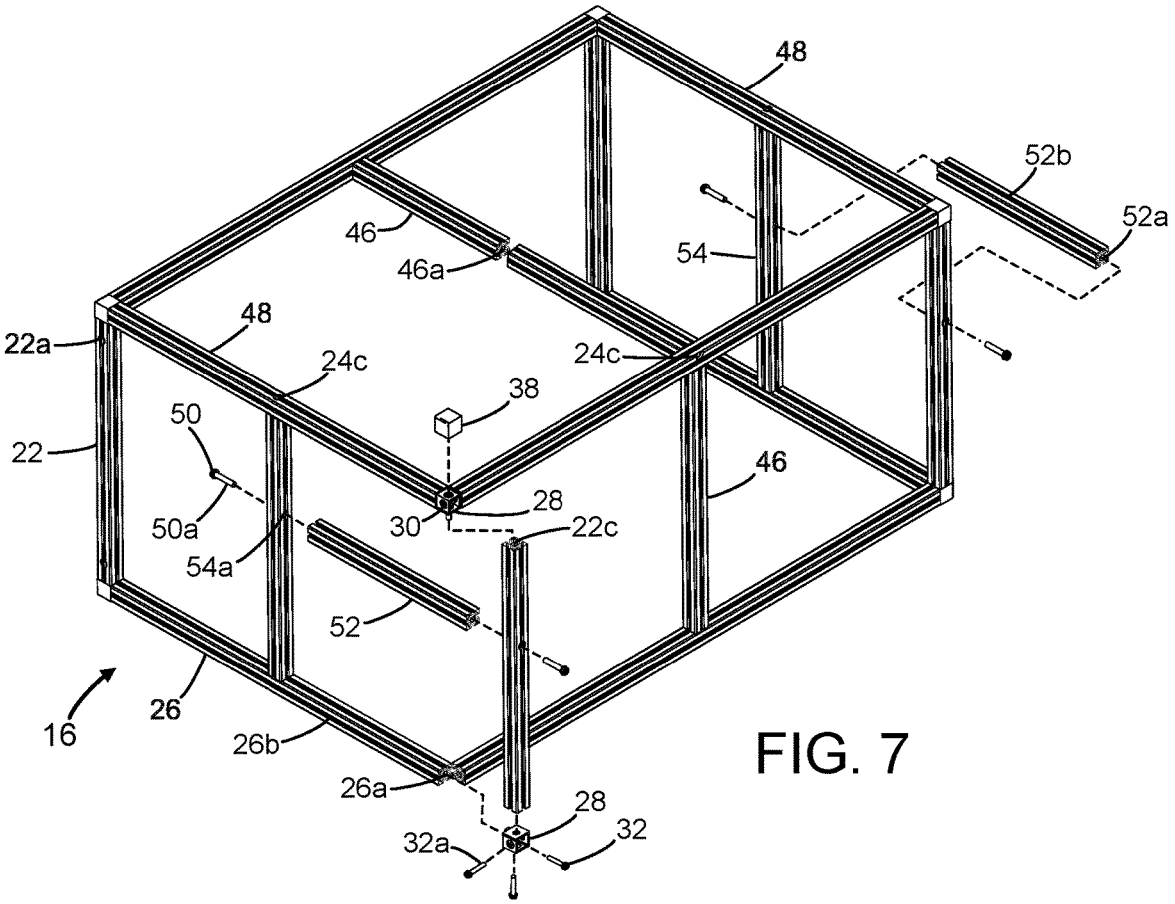
FIG. 7 is a top perspective view of the preferred embodiment of the present invention illustrating a box frame having upper and lower horizontal members connecting to corner posts.
Figure 8:
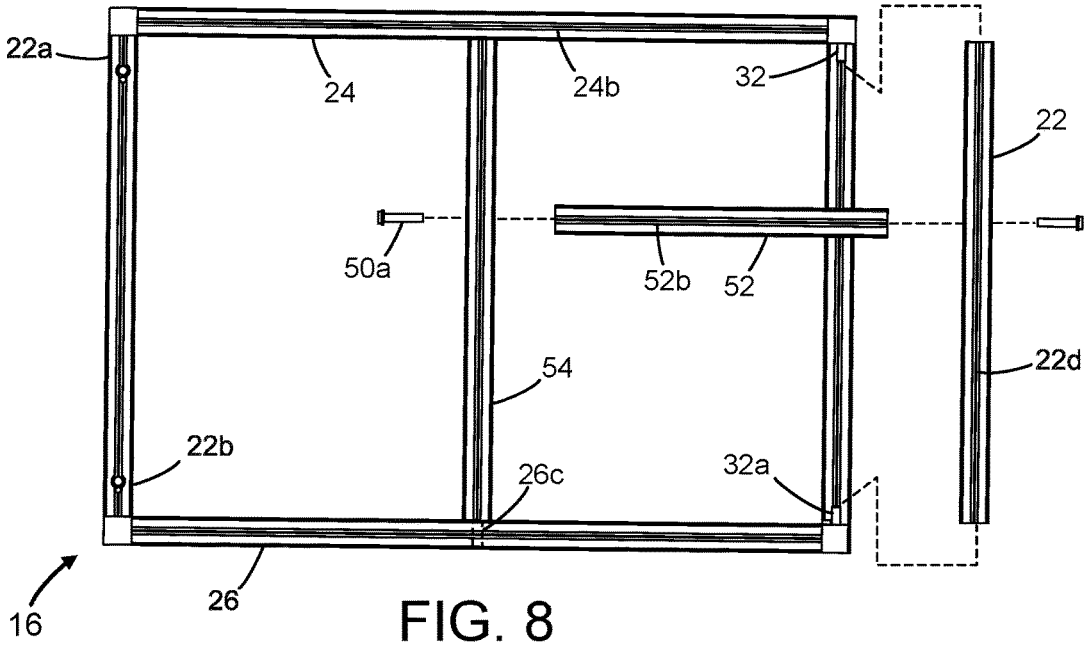
FIG. 8 is a side elevational view of the preferred embodiment of the present invention illustrating a box frame having upper and lower horizontal members connecting to corner posts.
Figure 9:
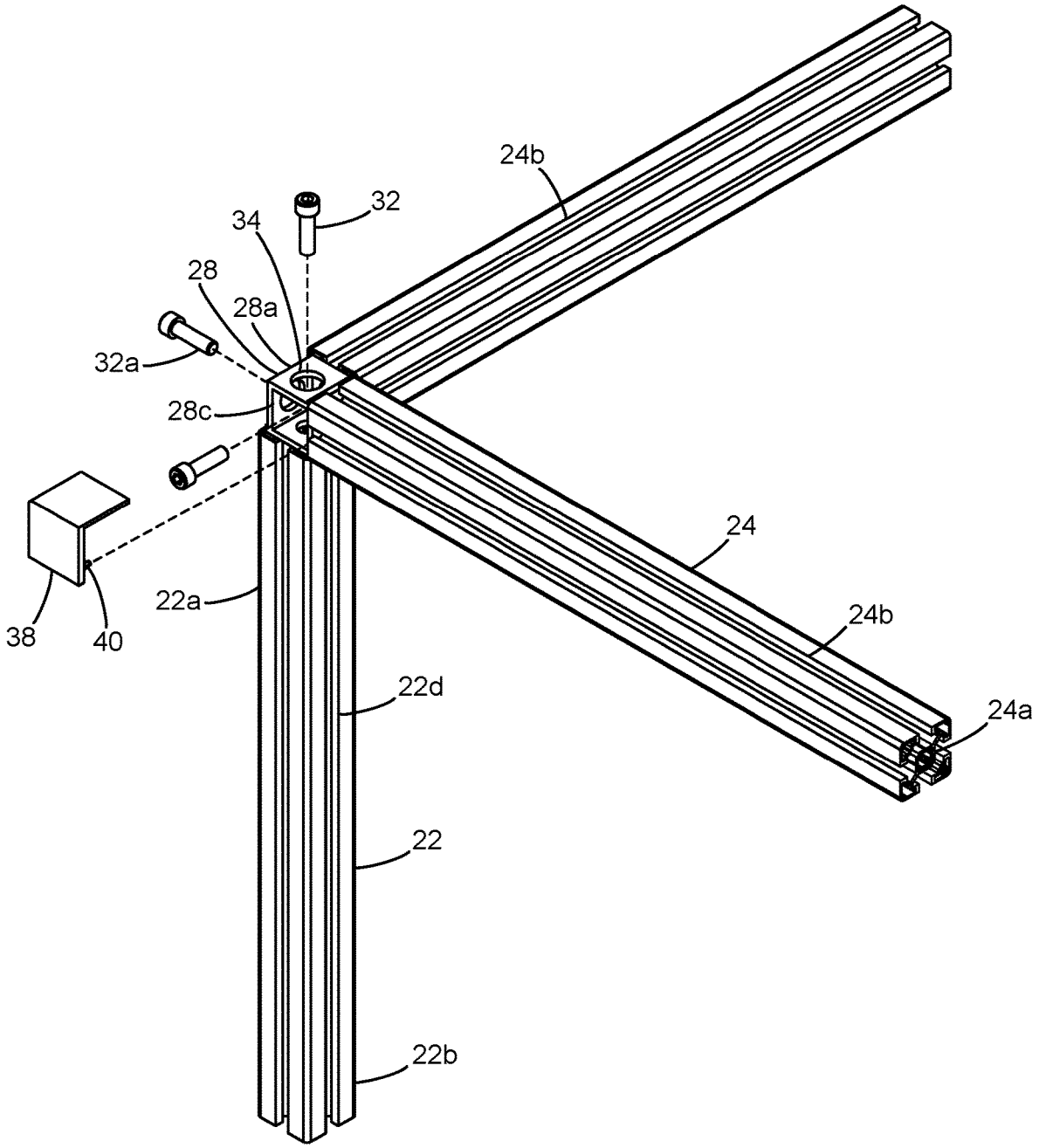
FIG. 9 is a top perspective view of the preferred embodiment of the present invention illustrating detail of joining upper and lower horizontal members to a corner post by a three-way connector.
Figure 10:
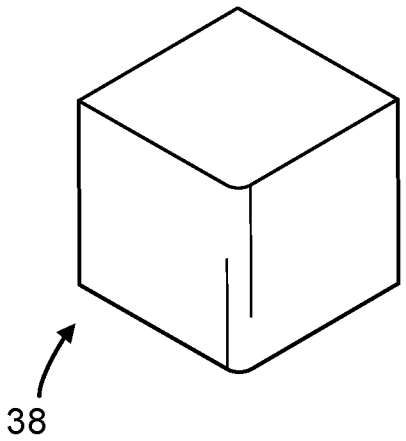
FIG. 10 is a rear perspective view of the preferred embodiment of the present invention illustrating of a corner cap fitted to a three-way connector.
Figure 11:
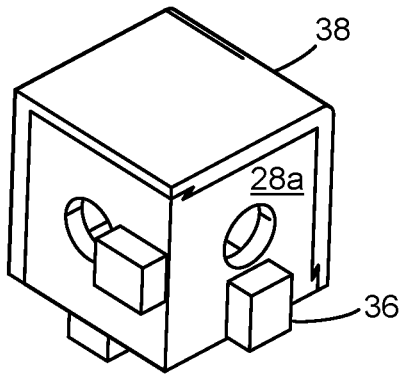
FIG. 11 is a front perspective view of the preferred embodiment of the present invention illustrating of a corner cap fitted to a three-way connector having accessible openings.
Figure 12:
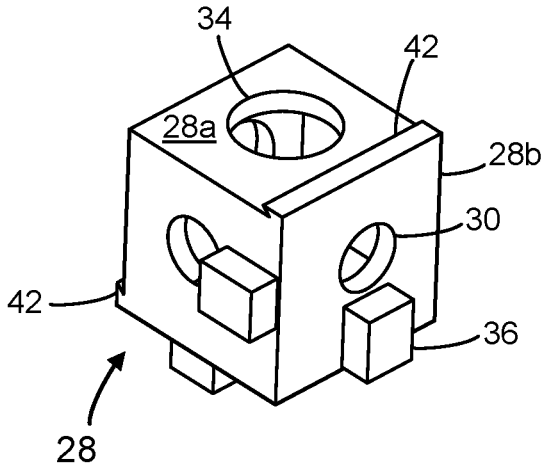
FIG. 12 is a front perspective view of the preferred embodiment of the present invention illustrating a three-way connector having accessible openings and alignment members.
Figure 13:
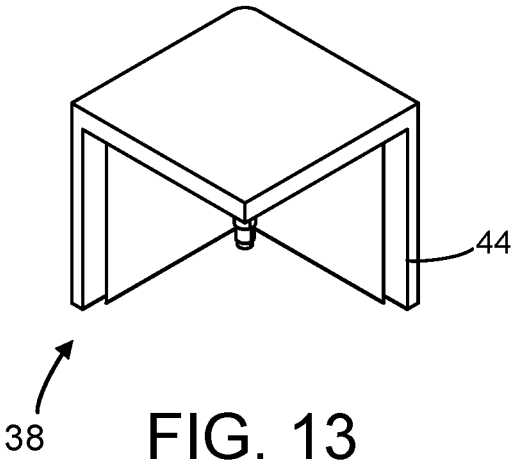
FIG. 13 is a rear perspective view of the preferred embodiment of the present invention illustrating of a corner cap having a pair of outward pins and a pair of inversed grooved slides.
Figure 14:
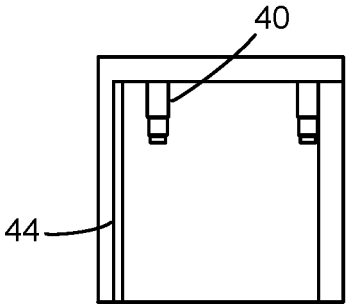
FIG. 14 is a side elevational view of the preferred embodiment of the present invention illustrating of a corner cap having a pair of outward pins.
Figure 15:
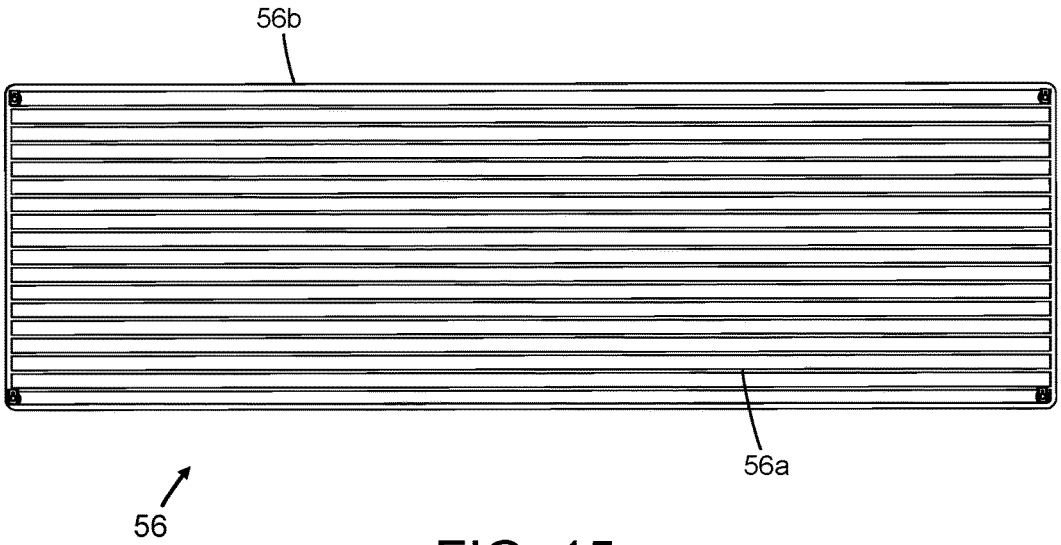
FIG. 15 is a top plan view of the preferred embodiment of the present invention illustrating a shelf platform.
Figure 16:
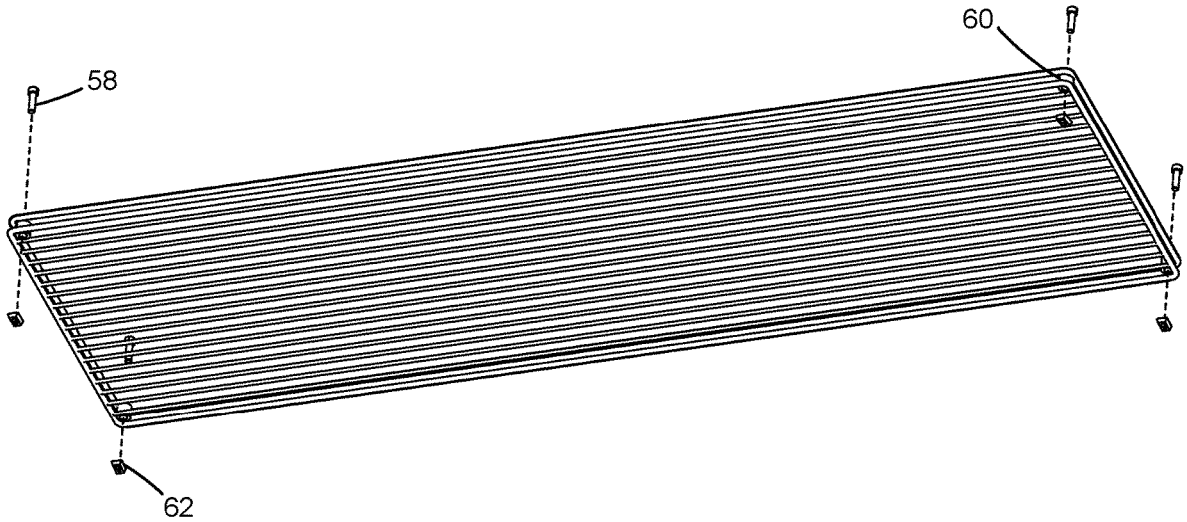
FIG. 16 is a bottom perspective view of the preferred embodiment of the present invention illustrating a shelf platform configured with cap screws and track nuts.

As further depicted in FIGS. 7 and 8, the box frame 16 incorporates one or more intermediate members 46 to supplement its overall strength and rigidity and generally connect midway to each of the upper horizontal members 24 and lower horizontal members 26 as well as extending in between a pair of parallel upper horizontal members 48. Connection of the individual intermediate members in this regard may be advanced by a common connective assembly 50 primarily comprising a cap screw 50*a* or equivalent passing into and fitting within a cross bore 24*c*, 26*c* extending perpendicularly through the upper and lower horizontal members, whereupon the cap screw's threaded end threadably engages a cylindrical bore 46*a* of the intermediate member 46.

Figure 5:
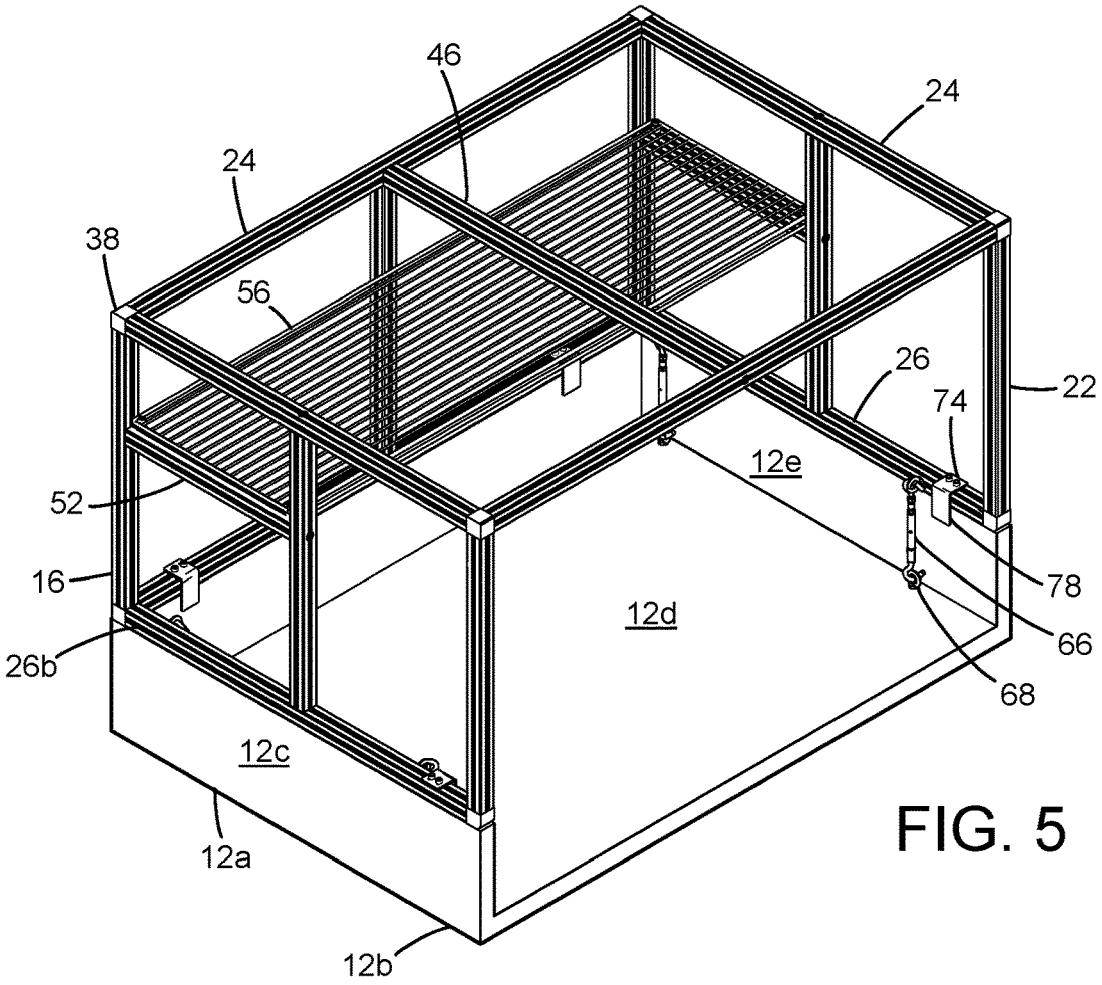
FIG. 5 is a top perspective view of the preferred embodiment of the present invention illustrating a box frame positioned atop of sidewalls of and mounted to an open cargo bay of a vehicle.
Figure 6:
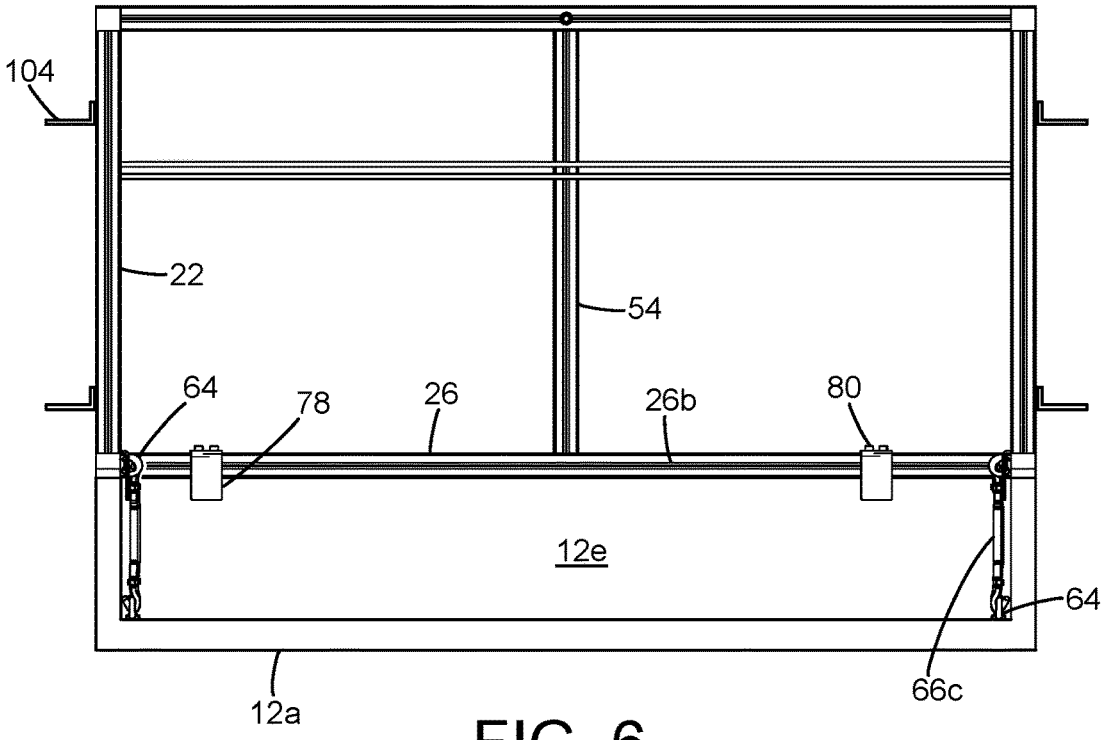
FIG. 6 is a rear elevational view of the preferred embodiment of the present invention illustrating a box frame mounted atop of an open cargo bay of a vehicle.

In some embodiments of the present invention, as represented in FIGS. 5, 6, 15, and 16 the box frame 16 may be fitted with an optional shelf system that fulfills expanded storage capabilities for items and the like interiorly within the confines of the portable shelter 10. In this regard, a pair of shelf supports 52 individually extend horizontally in between and connect to one of the four corner posts 22 and a vertically orientated intermediate member 54, generally in the manner shown in FIGS. 7 and 8. Connection is maintained by the common connective assembly 50, whereby by individual cap screws 50*a* fit within a cross bore 22*e*, 54*a* respectively extending through the corner post and vertically orientated intermediate member and threadably engage and terminate within a cylindrical bore 52*a* of the shelf support 52. In completing assembly of the shelf system, a shelf platform 56 is illustrated in FIGS. 5 and 6 to extend to each of the mounted shelf supports 52 and attaches thereto by way of a cap screw 58 or equivalent fitting within a cylindrical sleeve 60 fixedly attached to each corner of the shelf platform. A track nut 62 of the type shown in FIG. 16 includes an overall geometric shape that enables it to slidably pass into and within an open track 52*b* of the mounted shelf support 52 yet inhibits upward movement as the cap screw 58 is tightened to a specified torque setting. Although the construct of the shelf platform 56 may exist in numerous forms, practically adapting use of the types conventionally known in the art, it is preferably fabricated from a plurality of inner supports 56*a* spaced apart from one another and bounded by and connected at their ends to a supportive frame 56*b* so as to maintain passing of light from above-positioned light fixtures that may be used within the interior of the portable shelter 10. In some installations, where it is desired to increase the supportive strength of the shelf platform for heavily-weighted items, a stacked arrangement of shelf platforms may be aptly connected together by way of the cylindrical sleeves 60, typically in the manner depicted in FIG. 16.

Figure 17:
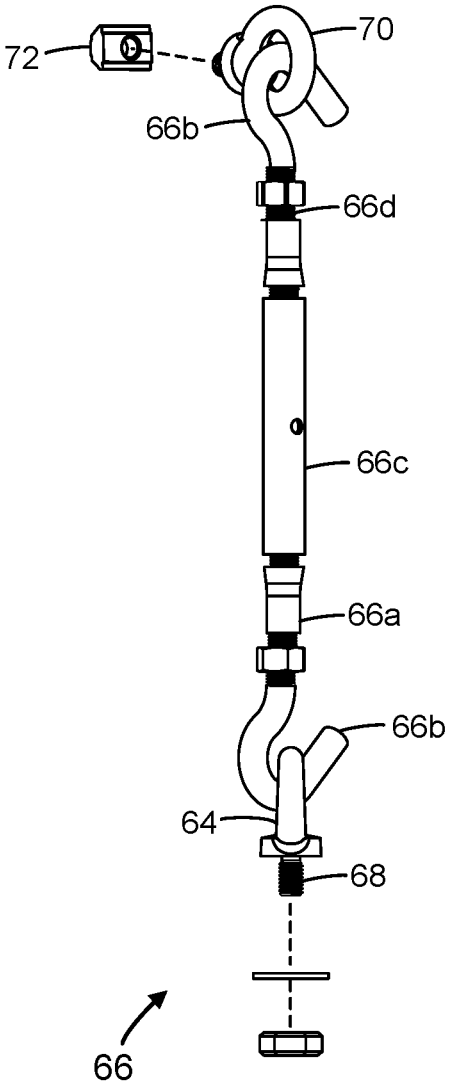
FIG. 17 is a side elevational view of the preferred embodiment of the present invention illustrating a turnbuckle having connective hooks configured to engage eye bolts.
Figure 18:
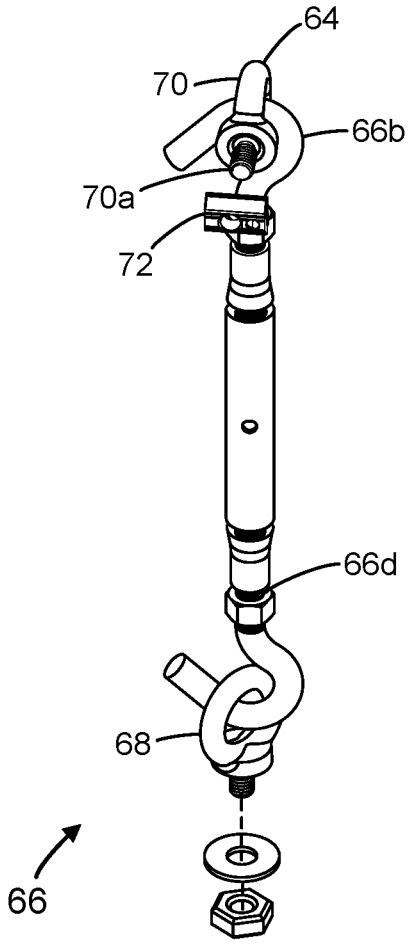
FIG. 18 is a top perspective view of the preferred embodiment of the present invention illustrating a turnbuckle having connective hooks configured to engage eye bolts.

As illustrated in FIGS. 6, 17 and 18, the box frame 16 is preferentially attached to the vehicle's cargo bay 12*a* by way of an assembly of eye bolts 64 and multiple turnbuckles 66 of the type generally recognized in the art for such applications, with each of the turnbuckles having a pair of ends 66*a* individually configured with a connective hook 66*b* or equivalent and a tensioning mechanism 66*c* operating conjunctively with threaded stem portions 66*d*, whereby turning of the tensioning mechanism clockwise or counterclockwise respectively shortens or lengthens the effective length of the turnbuckle. In fulfilling attachment of the turnbuckles 66 to the box frame, one end bearing the connective hook 66*b* engages a lowermost eye bolt 68 fixedly mounted to the open cargo bay's bottom surface, whereas the other, companion connective hook is configured to engage an uppermost eye bolt 70 extending outwardly from and connecting to one of the lower horizontal members 26. Adjustability of the eye bolt along the lower horizontal members is fulfilled by the capabilities of a track nut 72 slidably fitting within the open track 26*b*, whereas a threaded portion 70*a* of the eye bolt passes into and threadably engages the track nut to consummate a secured arrangement, as generally depicted in FIGS. 17 and 18.

Figure 19:
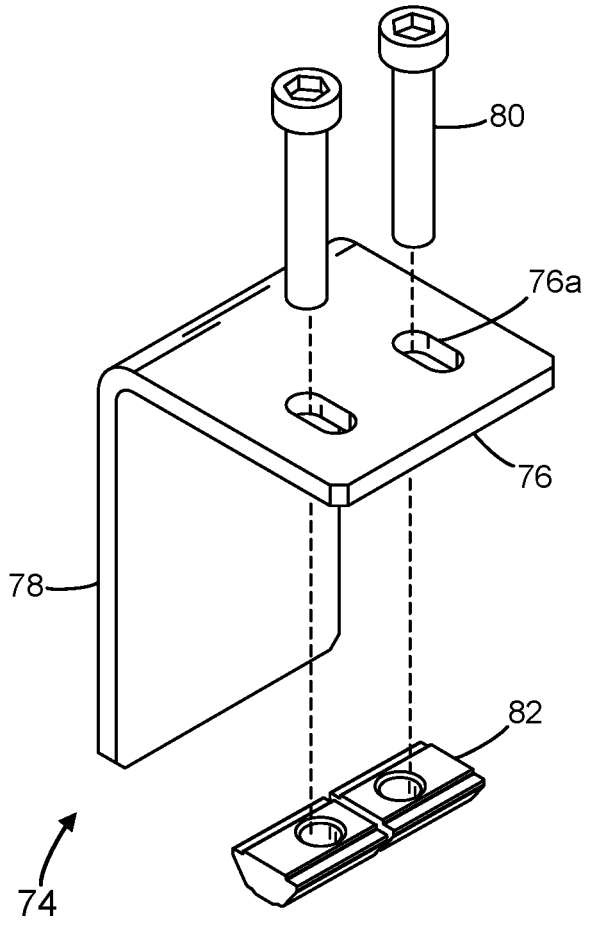
FIG. 19 is a top perspective view of the preferred embodiment of the present invention illustrating an alignment plate having a top planar element integrally connecting to a sideward planar element.
Figure 20:
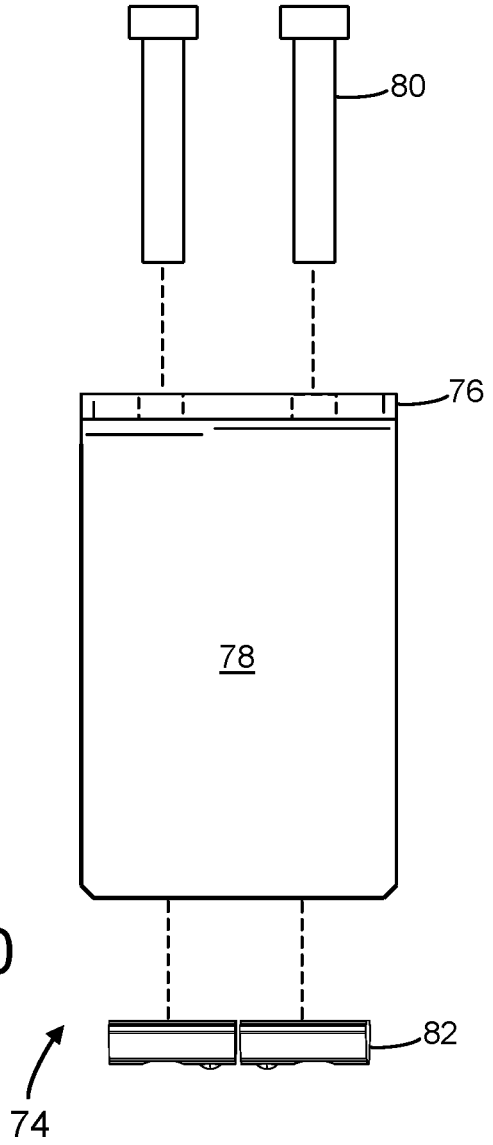
FIG. 20 is a front elevational view of the preferred embodiment of the present invention illustrating an alignment plate designated for use with a pair of cap screws and track nuts.

In further association with the box frame 16, a plurality of alignment plates 74 may be employed to ensure proper orientation and alignment of the box frame relative to the open cargo bay 12*a* while positioned atop the sidewalls 12*c* thereof. As can be seen in FIGS. 19 and 20, each alignment plate includes a top planar element 76 integrally connecting to and being perpendicularly orientated to a sideward planar element 78, where the top planar element is configured to sit atop of and engage the lower horizontal member with the sideward planar element being situated to simultaneously abut against the horizontal member and an inner wall surface 12*e* of the cargo bay's sidewall. Moveability and securement of the alignment plates relative to and along the lower horizontal member 26 is furthered by an assembled arrangement of a cap screw 80 passing into an aperture 76*a* extending through the top planar element 76 where it is allowed to threadably engage a track nut 82 capable of sliding along the open track 26*b* of the lower horizontal member 26 and being tightened to fulfill securement of the alignment plate.

Now in reference to FIGS. 21-24, the portable shelter 10 is further associated with a supportive wind wall 84 possessing structural features for connecting the box frame 16 to the moveable frame assembly 18 as well as supporting connectivity of a lower wind wall 86 that possesses capabilities of being moved inwardly toward the supportive wind wall and stowed for transportational purposes.

Figure 21:
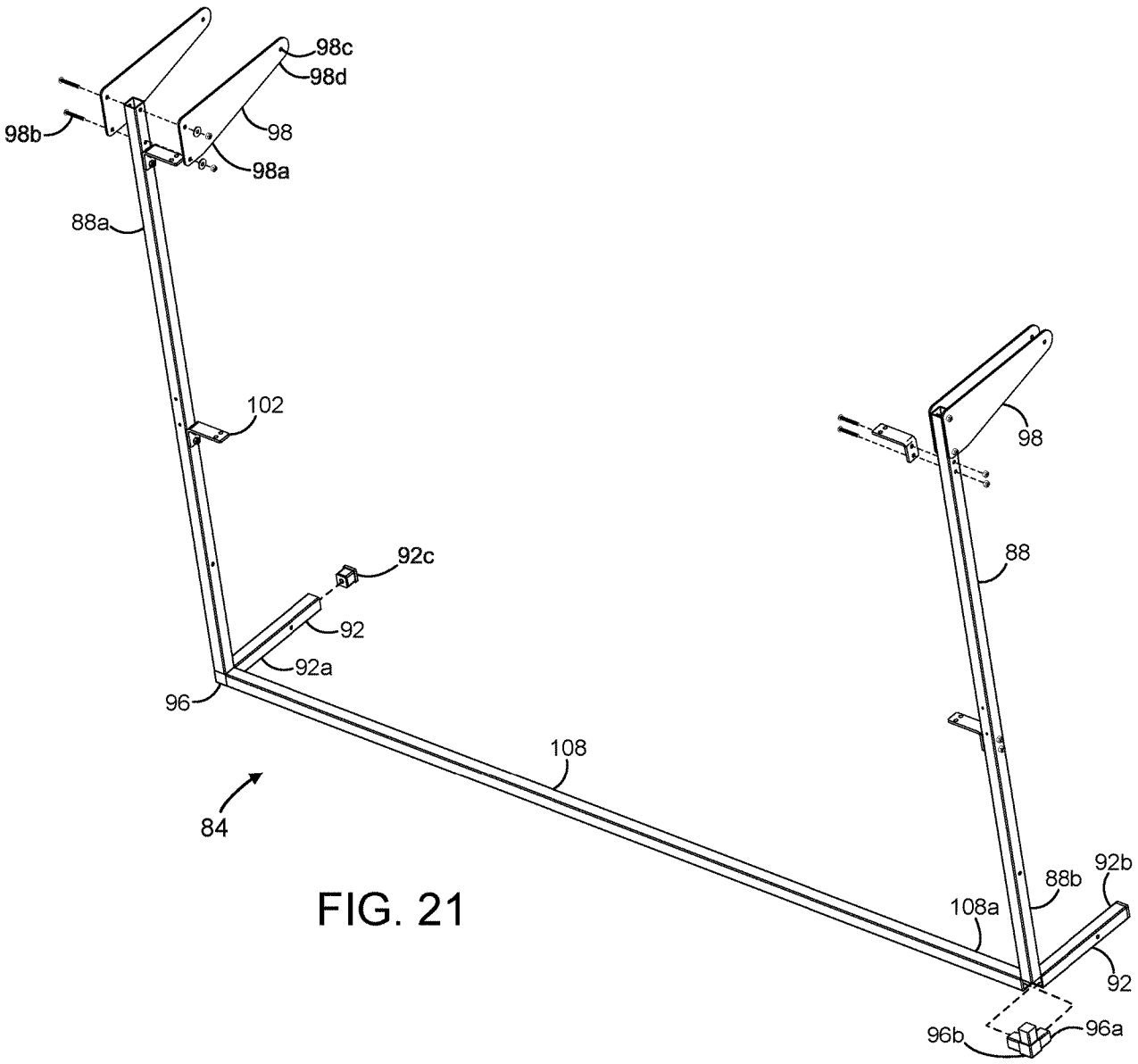
FIG. 21 is a rear perspective view of the preferred embodiment of the present invention illustrating a supportive wind wall having a pair of upright supports connecting to a lower support member.
Figure 24:
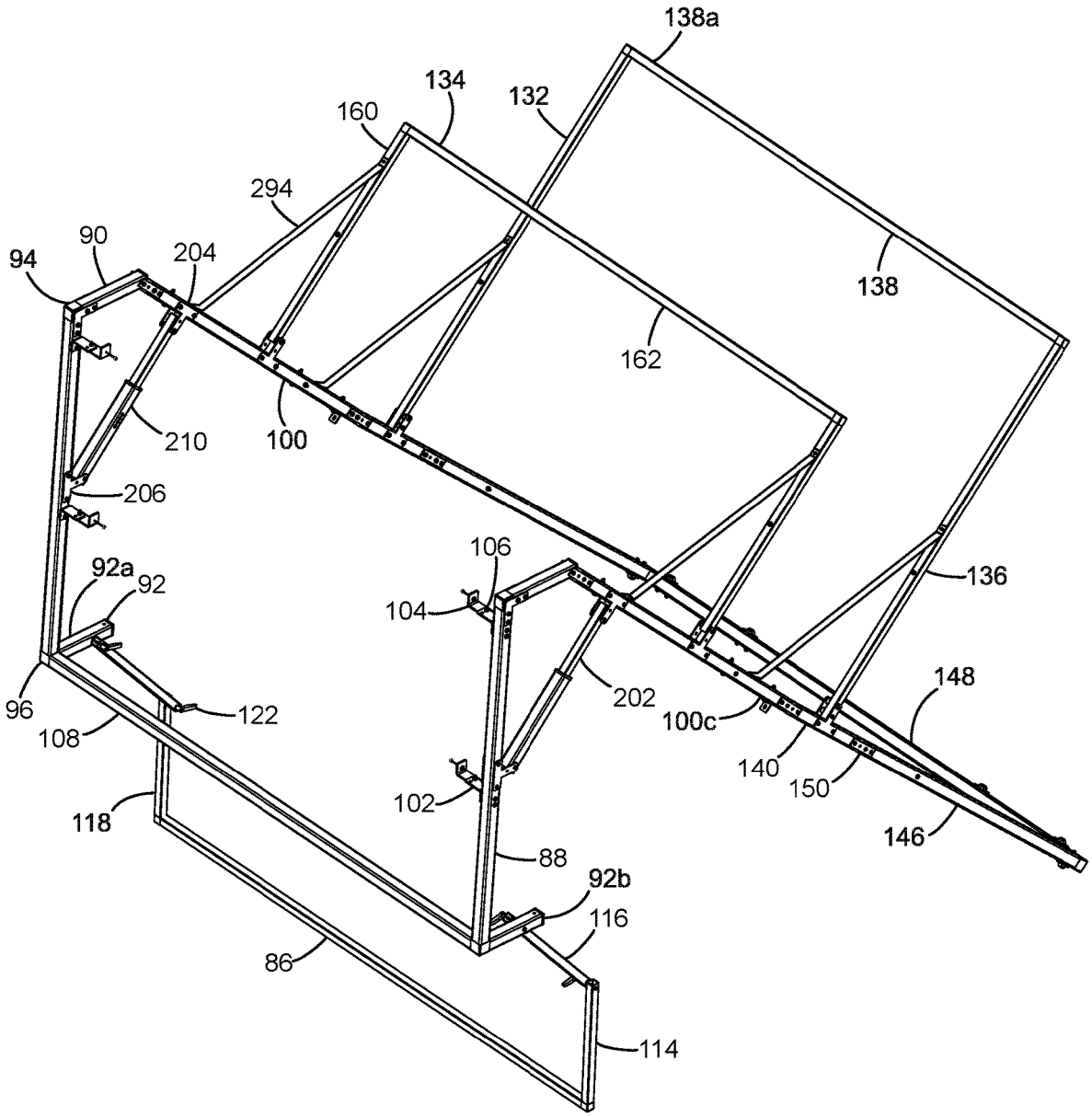
FIG. 24 is a rear perspective view of the preferred embodiment of the present invention illustrating a supportive wind wall connecting to a moveable frame assembly in an expanded relation and a pair of telescopic supports each connectively spanning from an upright support of the supportive wind wall to a sideward arm.
Figure 25:
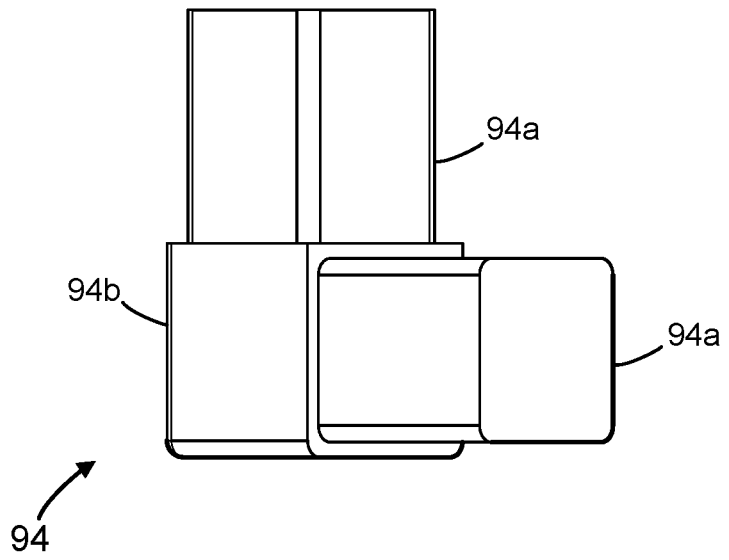
FIG. 25 is a rear perspective view of the preferred embodiment of the present invention illustrating a two-way corner connector with insertable ends.
Figure 26:
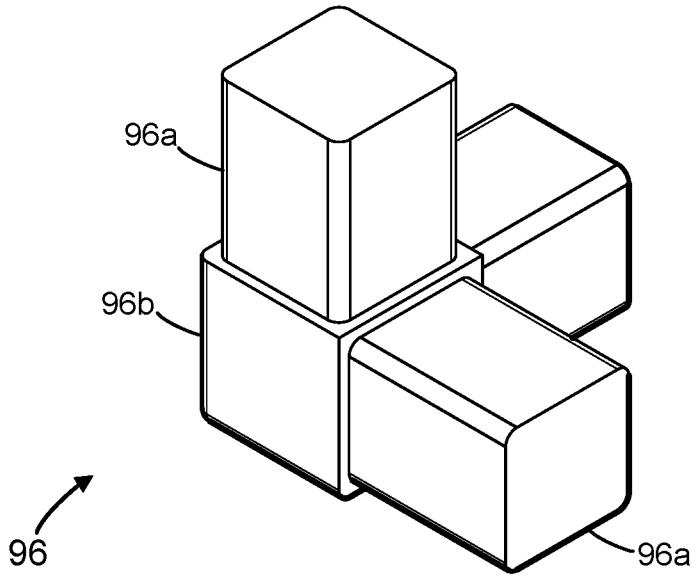
FIG. 26 is a top perspective view of the preferred embodiment of the present invention illustrating a three-way corner connector with insertable ends.

The supportive wind wall in particular is shown in FIGS. 21 and 24 as having a pair of upright supports 88 each configured with a top end 88*a* and a bottom end 88*b* respectively connecting to an upper outward member 90 and a lower outward member 92 at each of their first ends 90*a*, 92*a* by way of a two-way corner connector 94 and a three-way corner connector 96. FIGS. 25 and 26 generally illustrates the overall configuration of each corner connector, where an insertable end 94*a*, 96*a* integrally formed with and extending outwardly from an exposed corner member 94*b*, 96*b* associated therewith geometrically conforms to and fits interiority within the structural square tubing preferentially used in fabricating the moveable frame assembly 18. It is generally understood within the context of this disclosure that the insertable end may be permanently or temporarily attached to the corresponding structural tubing by a variety of attachment means conventionally known in the art, including, but not limited to, press-fitted, screws, bolts, rivets, glue, and so forth.

Figure 27:
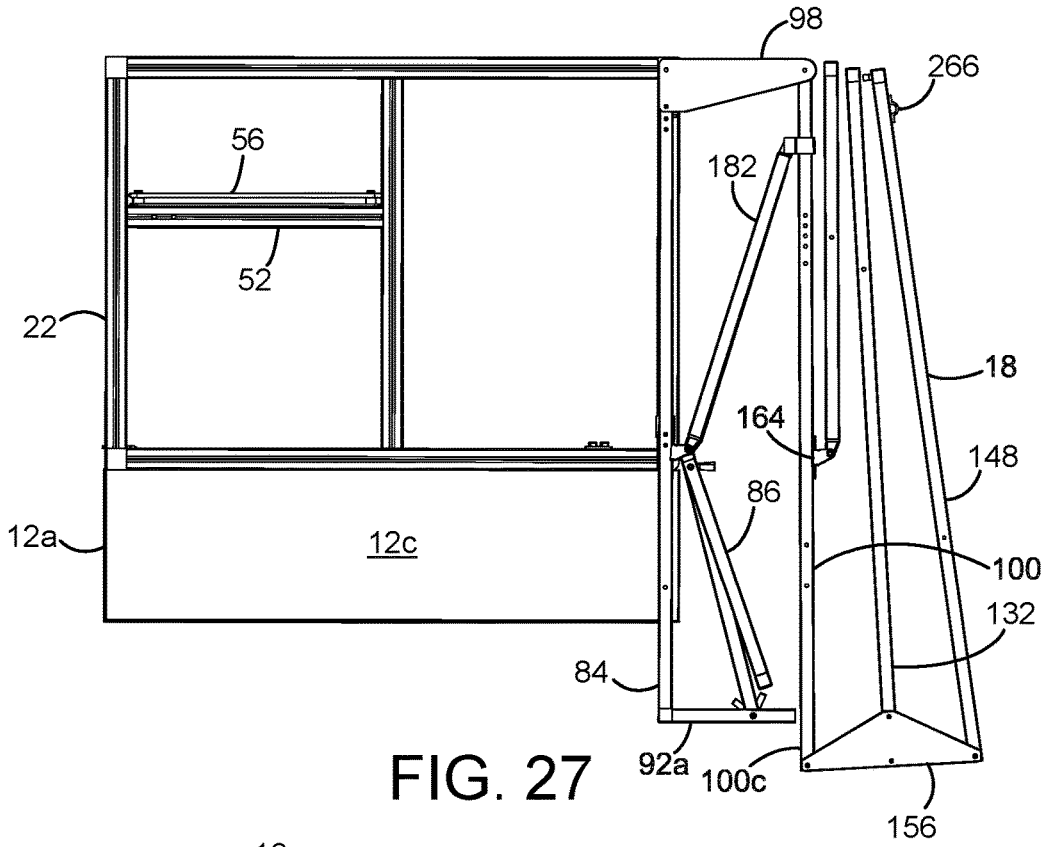
FIG. 27 is a side elevational view of the preferred embodiment of the present invention illustrating a box frame mounted to an open cargo bay of a vehicle and connecting to moveable frame assembly in a folded, compact position.
Figure 28:
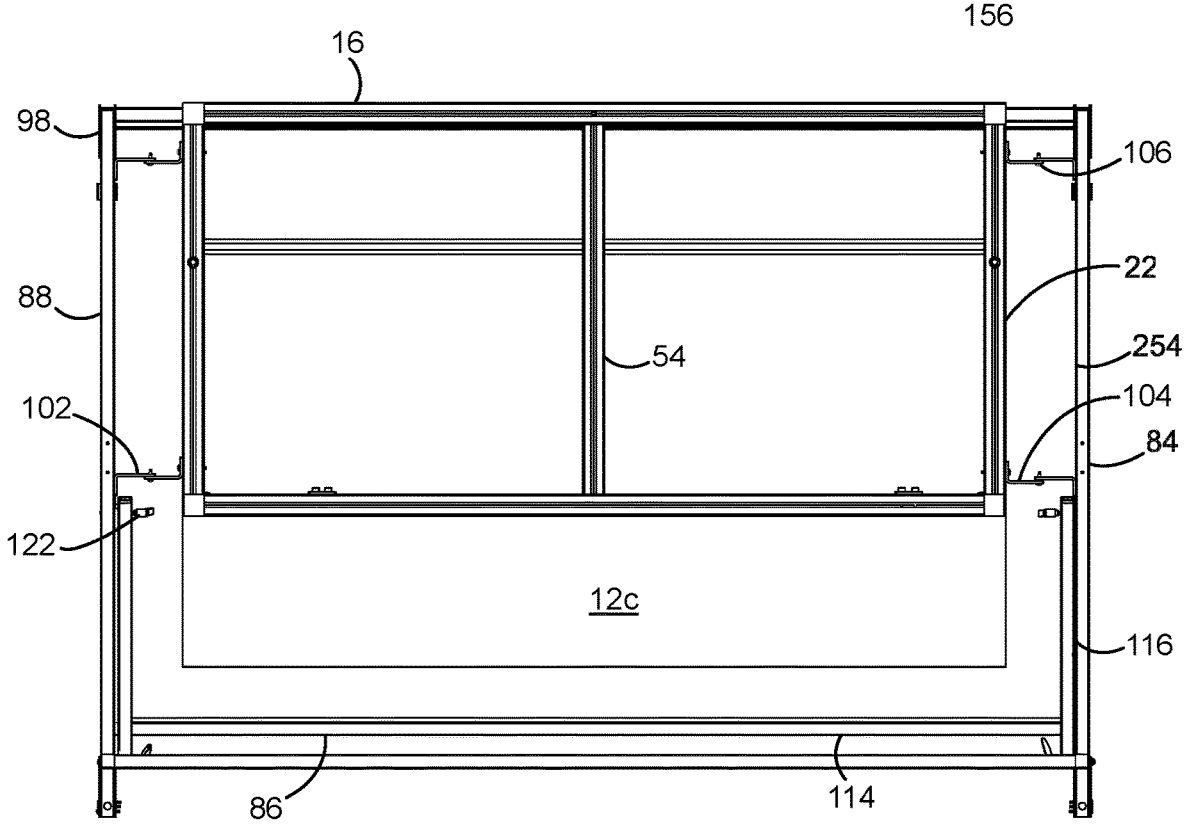
FIG. 28 is a rear elevational view of the preferred embodiment of the present invention illustrating a box frame mounted to an open cargo bay of a vehicle and connecting to moveable frame assembly in a folded, compact position.

As generally depicted in FIGS. 21-23, 27, and 28, as an alternative, second embodiment of the moveable frame assembly 18, each of the upright supports of the supportive wind wall 84 may be outfitted with dual-mountable pivot plates 98 in lieu of the upper outward member to advance connectivity to a sideward arm 100. Connection of the dual-mountable pivot plates to the upright supports 88 is preferably maintained by attachment means relatively at its attachable end 98*a*, such as multiple bolt and nut assemblies 98*b* of the type typically shown in FIG. 21, rivets, screws, welds, and other methodologies recognized in the art for this purpose. Regardless of the overall construct of the supportive wind wall, each of the upright supports is further featured with at least one pair of supportive plates 102 that engagingly connect to an equal number of complementary supportive plates 104 extending outwardly from and connecting to the corner post 22 of the box frame 16 situated most rearward of the vehicle 12. FIG. 28 shows a typical arrangement of the supportive plates with that of the complementary supportive plates, whereby individual sets of bolt and nut assemblies 106 advance a temporary fixed connection thereof.

Figure 22:
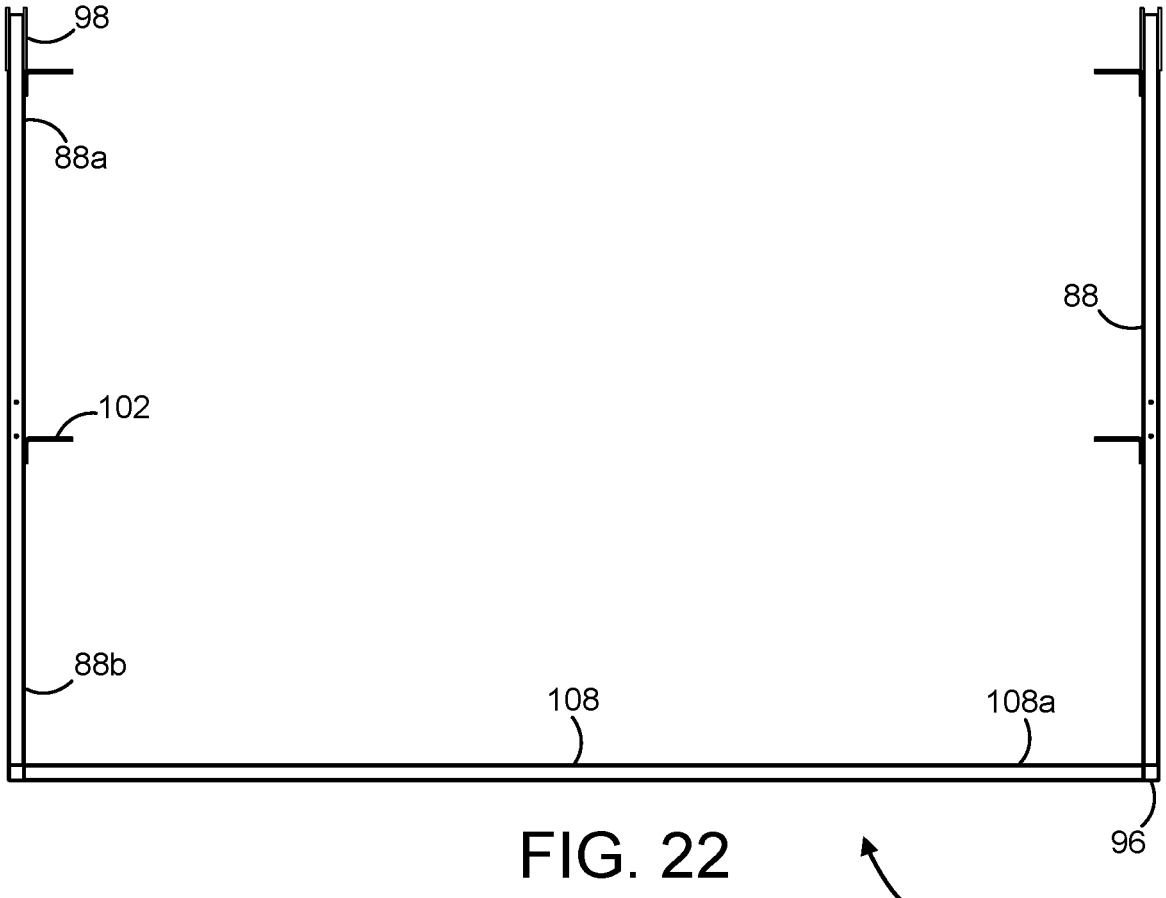
FIG. 22 is a rear elevational view of the preferred embodiment of the present invention illustrating a supportive wind wall having a pair of upright supports connecting to a lower support member.
Figure 23:
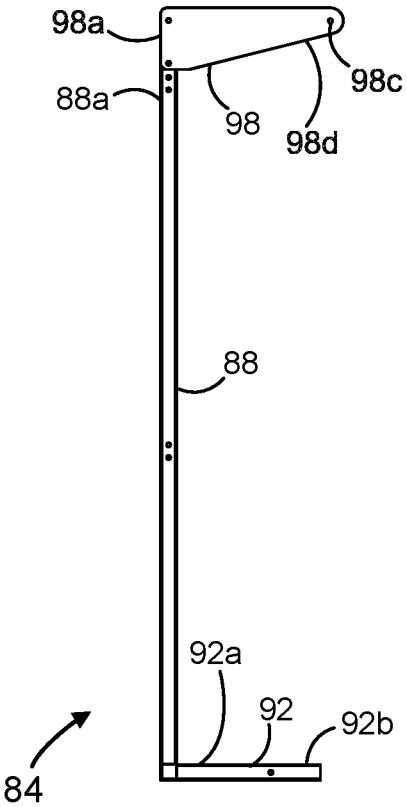
FIG. 23 is a side elevational view of the preferred embodiment of the present invention illustrating a supportive wind wall having a pair of upright supports connecting to a lower outward member and dual-mountable pivot plates.

In fulfilling connection of the two upright supports 88 as well as offering overall structural support to the lower wind wall 86, each of the bottom ends 88*b* in FIGS. 21 and 22 connects to ends 108*a* of a lower support member 108 by way of one of the available insertable ends 96*a* of the three-way connector, particularly in a manner that allows the lower support member to generally reside on the same plane as the upright supports with the lower outward member 92 extending outwardly perpendicular thereto to advance connectivity to the lower wind wall.

Figure 29:
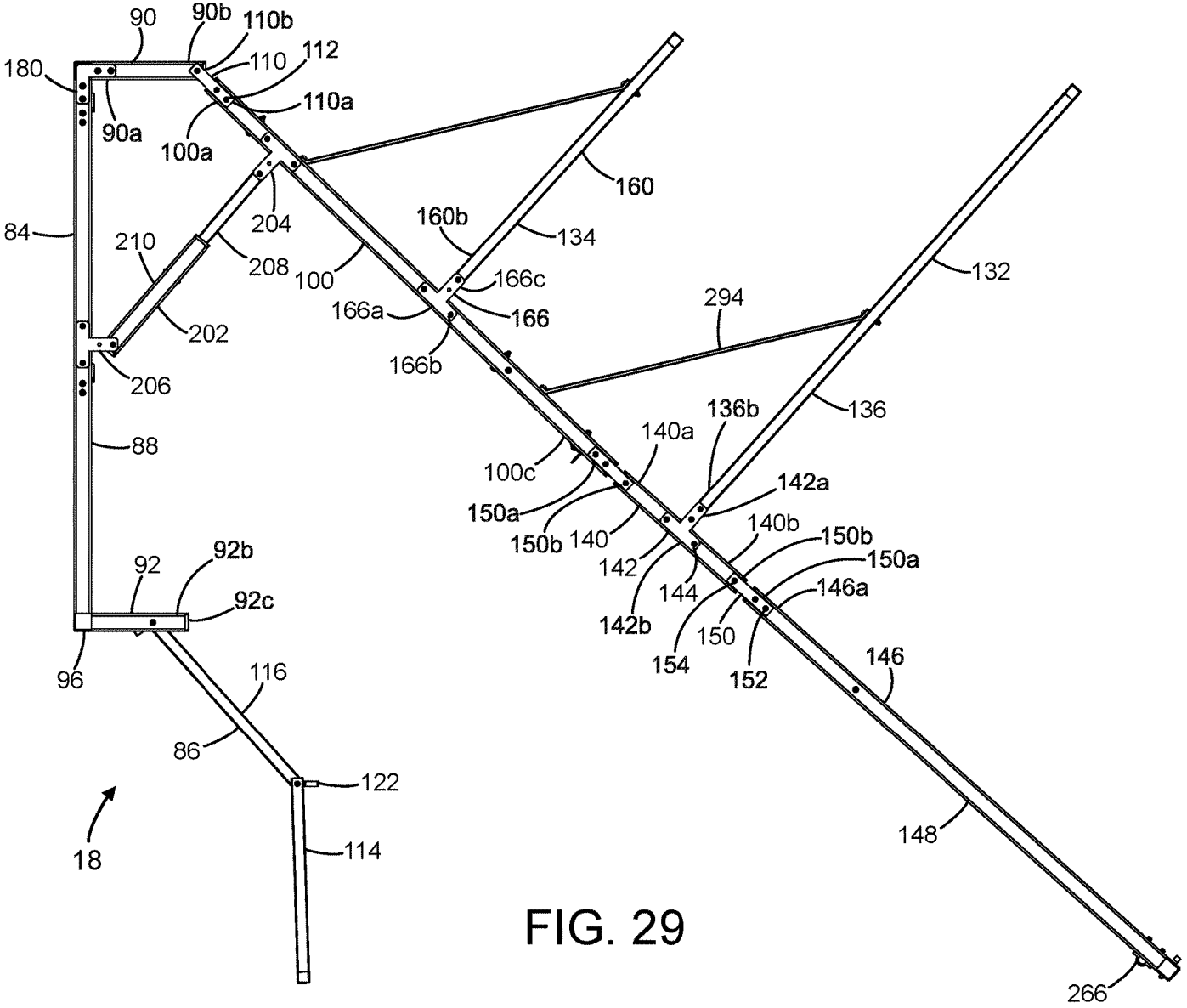
FIG. 29 is a side elevational view of the preferred embodiment of the present invention illustrating a supportive wind wall connecting to a moveable frame assembly and a lower wind wall collectively in an expanded relation.
Figure 30:
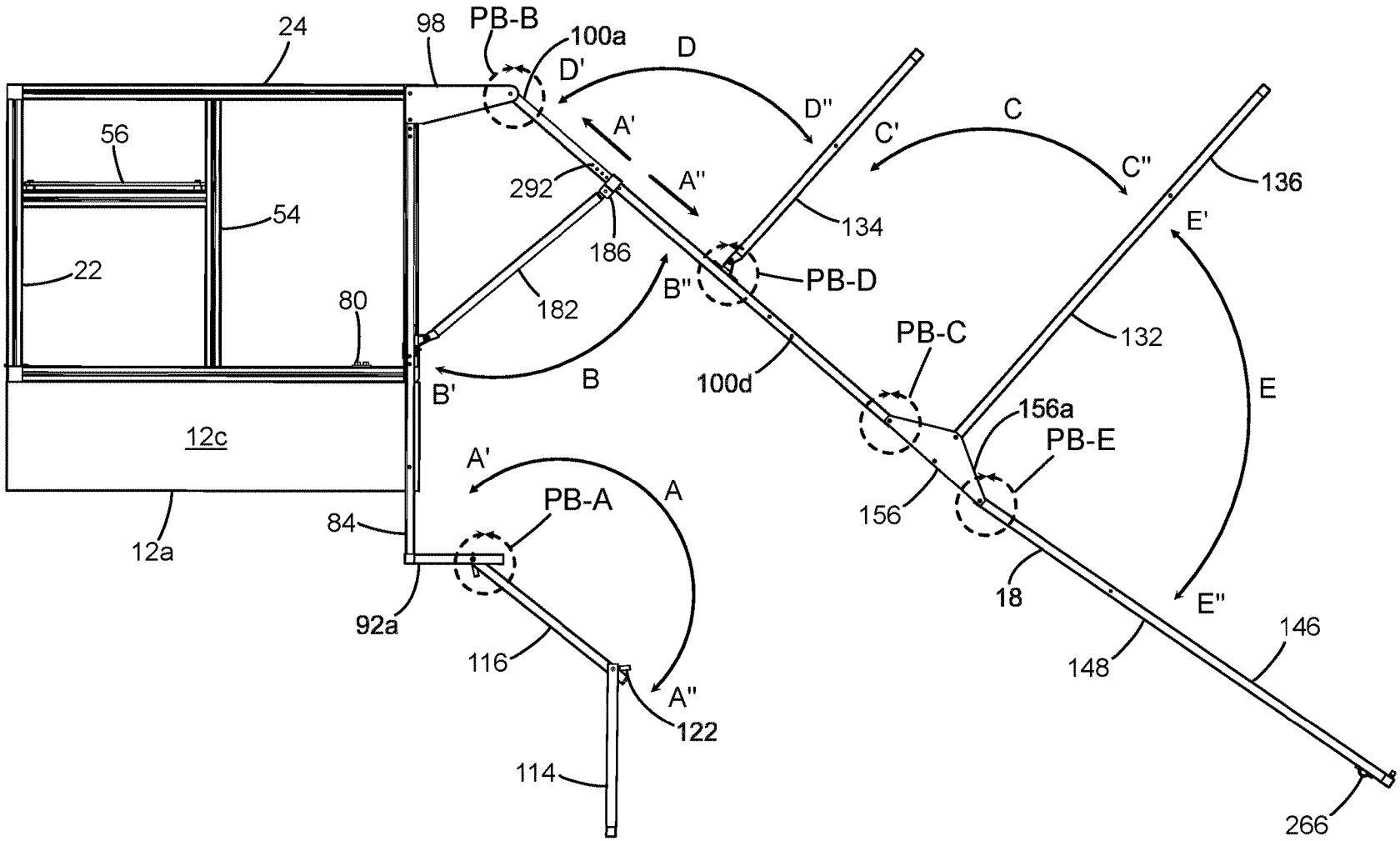
FIG. 30 is a side elevational view of the preferred embodiment of the present invention illustrating a moveable frame assembly presented in expanded form and connecting to a box frame associatively mounted to an open cargo bay of a vehicle.
Figure 31:
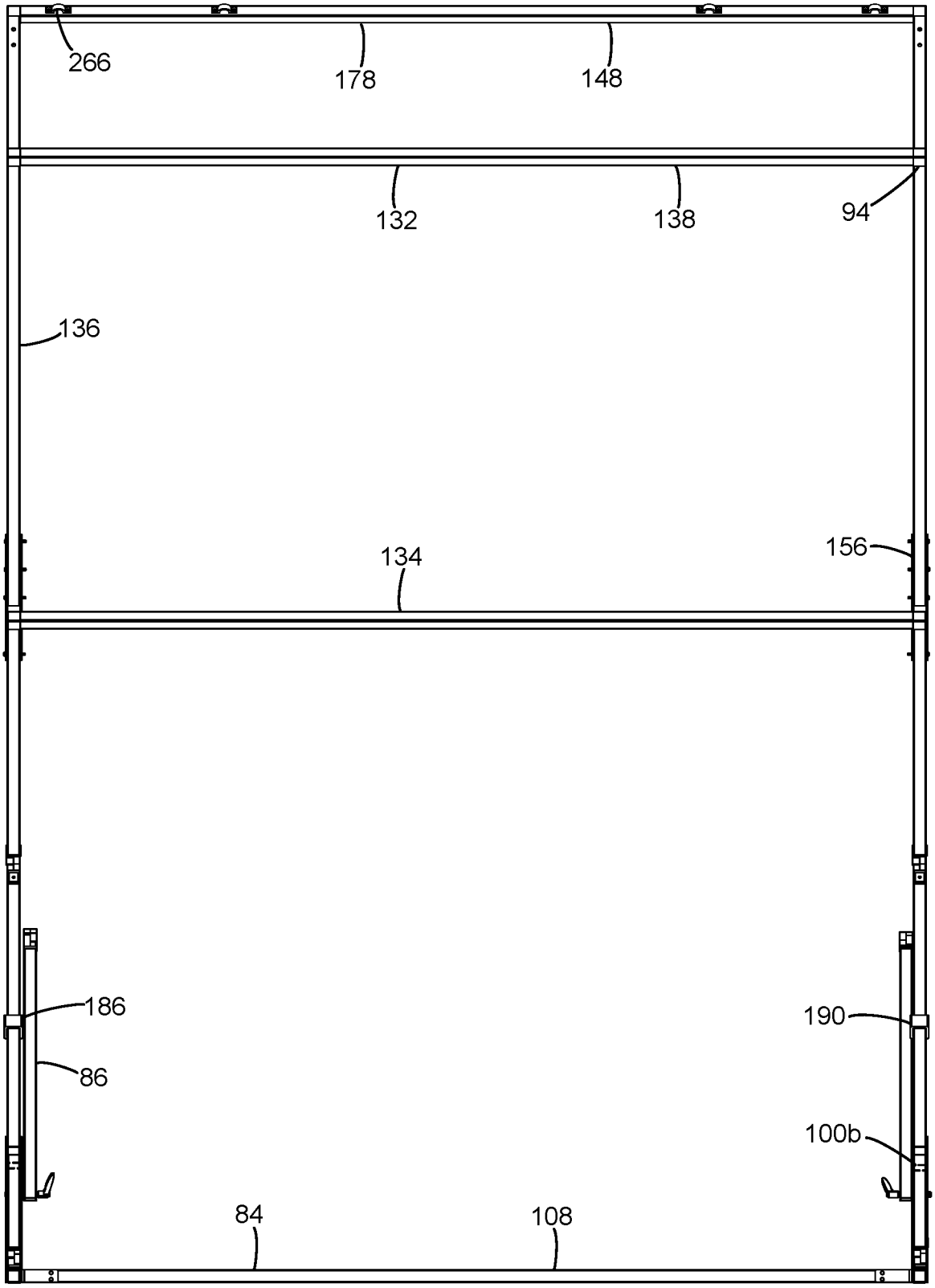
FIG. 31 is a top plan view of the preferred embodiment of the present invention illustrating a supportive wind wall connecting to a moveable frame assembly in an expanded relation.
Figures 32, 32A:
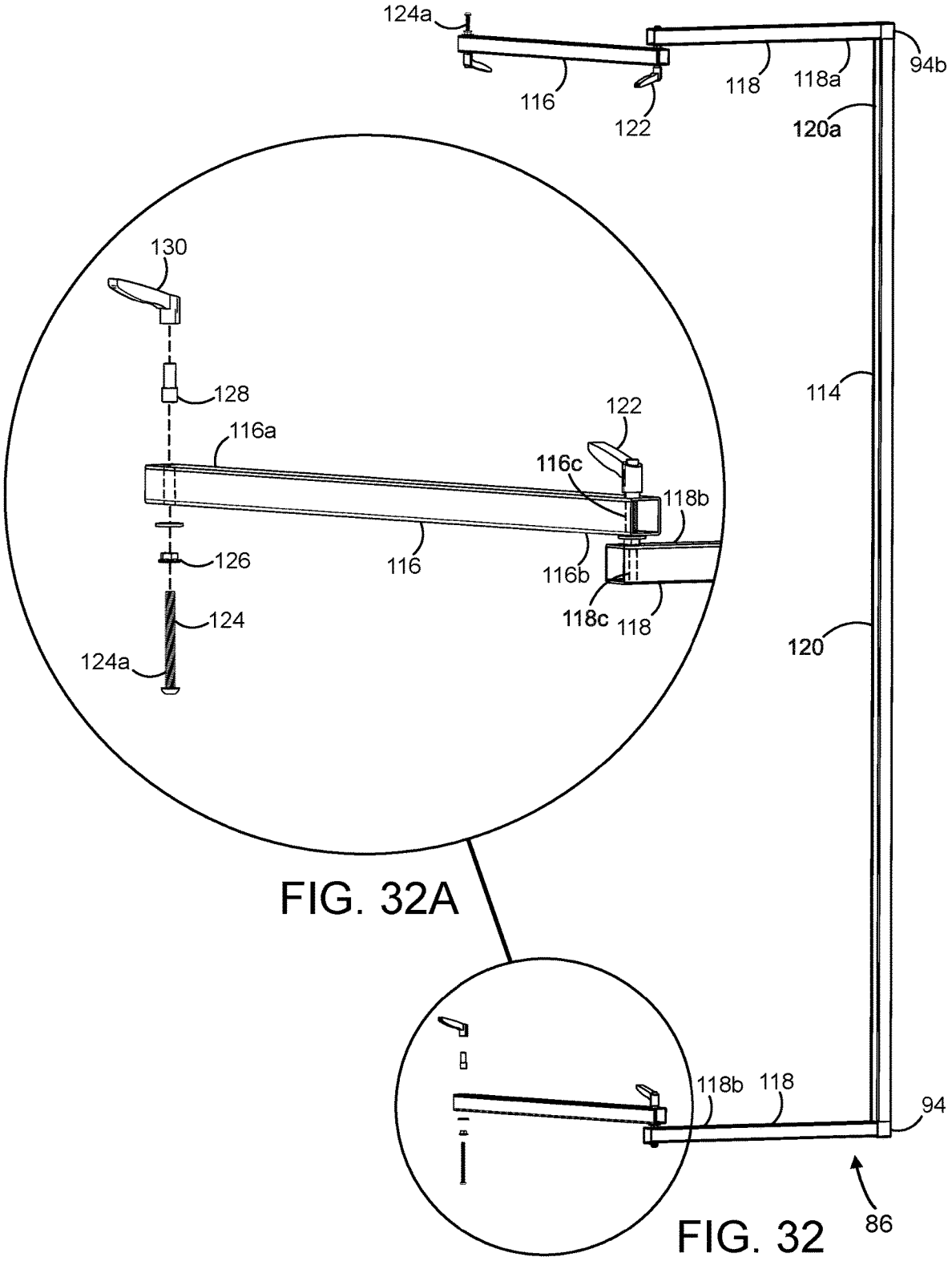
FIG. 32 is a front perspective view of the preferred embodiment of the present invention illustrating a lower wind wall having a supportive framed structure connecting to a pair of rotatable arms.
FIG. 32A is a partial enlarged view of the preferred embodiment of the present invention illustrating a rotatable arm connecting to a supportive end member of a supportive frame structure.

Comparatively, FIGS. 29 and 30 respectively show each of the upper outward members 90 or pair of dual-mountable pivot plates 98 as associated with the alternative embodiment of the moveable frame assembly 18 being connected to the sideward arm 100 in a manner that yields pivotal action relatively at an inward end 100*a* of the sideward arm. In applications employing usage of the upper outward members, for example, a pair of opposing inline plates 110 facilitates connectivity as well as providing for the desirable pivoting movement, where in particular a fixed end 110*a* of the inline plate is fixedly attached to the inward end of the sideward arm by fastening means, such as at least one pair of bolt and nut assemblies 112 of the type shown in FIG. 29, welds, or equivalent, whereas a free end 110*b* of the inline plate connects to a second end 90*b* of the upper outward member by pivot fastening means, such a singular bolt and nut assembly with inner washers possessing lubricity properties, a bolt, a pin, or equivalent types of fasteners capable of yielding pivoting movement. In like manner, the dual-mountable pivot plates 98 each includes an aperture 98*c* extending through a pivoting end 98*d* thereof as in FIG. 21 to align with a cross bore 100*b* extending through the inward end 100*a* of the sideward arm as in FIG. 31, of which is appropriately fitted with pivot fastening means. Referring now to FIGS. 24, 32 and 32A, the lower wind wall is shown as including a supportive framed structure 114 pivotally connecting to a pair of rotatable arms 116 with each having a first end 116*a* pivotally connecting to a second end 92*b* of the lower outward member 92 to substantially form a lower wind wall with dual-hinged capabilities, whereby the lower wind wall is capable of pivot movement relatively at PB-A along path A in the direction of A' toward the supportive wind wall to effect a compact relationship, and conversely, in the direction of A" to effect expansion thereof with that of the moveable frame assembly 18, as generally represented in FIG. 30. The supportive framed structure is generally depicted in FIG. 32 as comprising a pair of supportive end members 118 with each having a first end 118*a* connecting to ends 120*a* of a cross beam 120 by way of the two-way corner connector 94, particularly being arranged to allow the supportive end members to reside on the same plane as the cross beam. A handle assembly 122 of the type generally shown in FIG. 32A preferably fulfills connectivity of a second end 118*b* of the supportive end member with that of a second end 116*b* of the rotatable arm and the second end 92*b* of the lower outward member 92 with that of the first end 116*a* of the rotatable arm. The handle assembly, as exemplarily described for use in connecting the supportive framed structure to the rotatable arm as in FIG. 32A, aptly includes a bolt 124 slidably fitting within an aligned arrangement of cross bores 118*c*, 116*c* extending through the second ends of the supportive end member and rotatable arm and being fixed thereat by a lock nut 126 situated thereinbetween, whereas a threaded exposed end 124*a* of the bolt is threadably fitted with a sleeve 128 that connects to and conjunctively operates with a handle 130 for manually tightening or loosening the connection on an as-needed basis.

Figures 33, 33A:
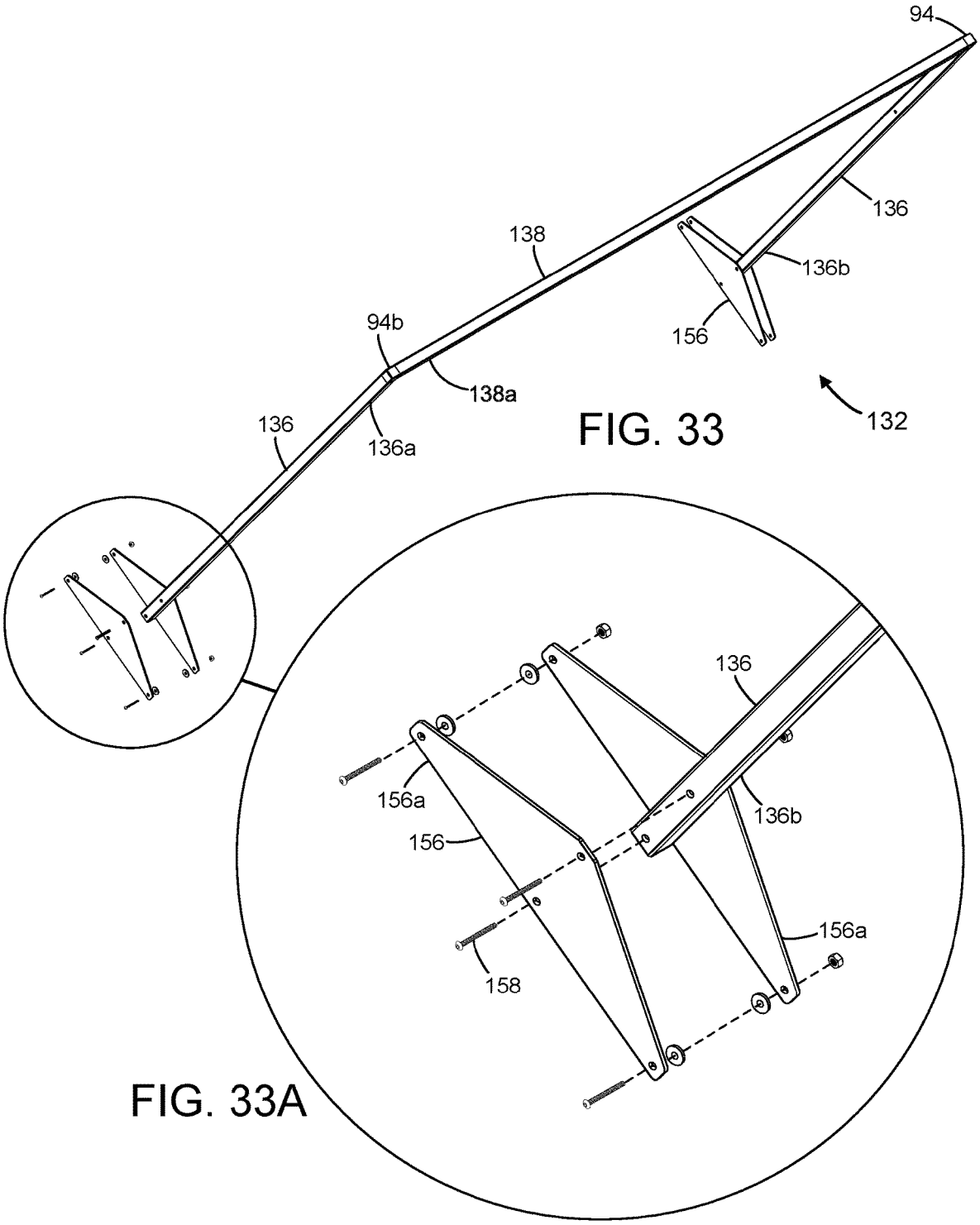
FIG. 33 is a top plan view of the preferred embodiment of the present invention illustrating a primary canopy having a pair of sideward members each connecting to dual triangulated pivot plates.
FIG. 33A is a partial enlarged view of the preferred embodiment of the present invention illustrating a dual triangulated pivot plate separable from a sideward member of a primary canopy.

Now in reference to FIGS. 27, 33 and 33A, the moveable frame assembly 18 is further associated with a primary canopy 132 extending from and connecting to outward ends 100*c* of the sideward arms 100 and a secondary canopy 134 connecting intermediate along the sideward arms, whereby each of the canopies possesses the capabilities of collapsing inwardly toward the sideward arms as well as traveling outwardly therefrom respectively along paths C and D in FIG. 30 to attain contraction and full expansion of the moveable frame assembly 18.

Figure 34:
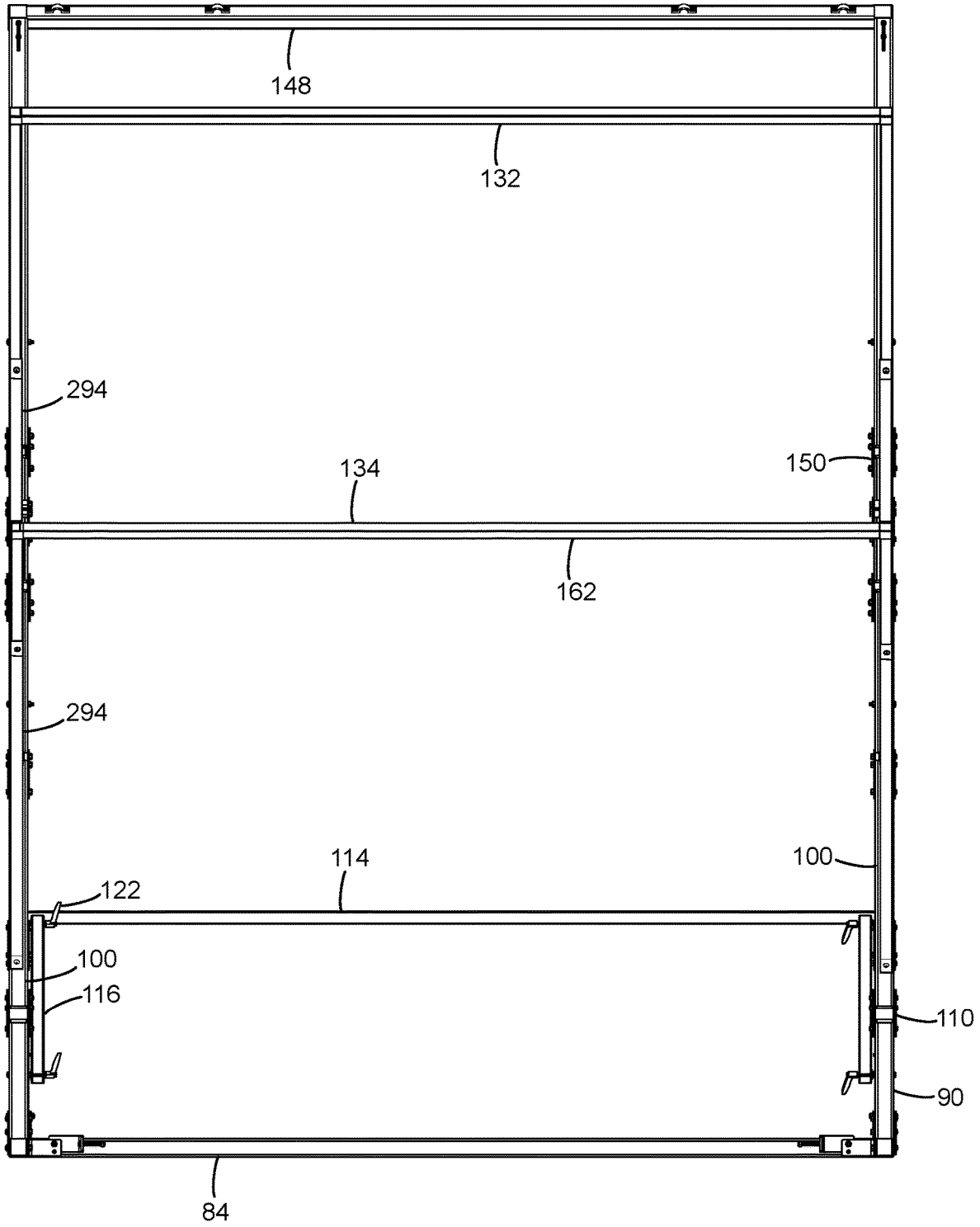
FIG. 34 is a top plan view of the preferred embodiment of the present invention illustrating a supportive wind wall connecting to moveable frame assembly and a lower wind wall collectively in an expanded relation.
Figure 35:
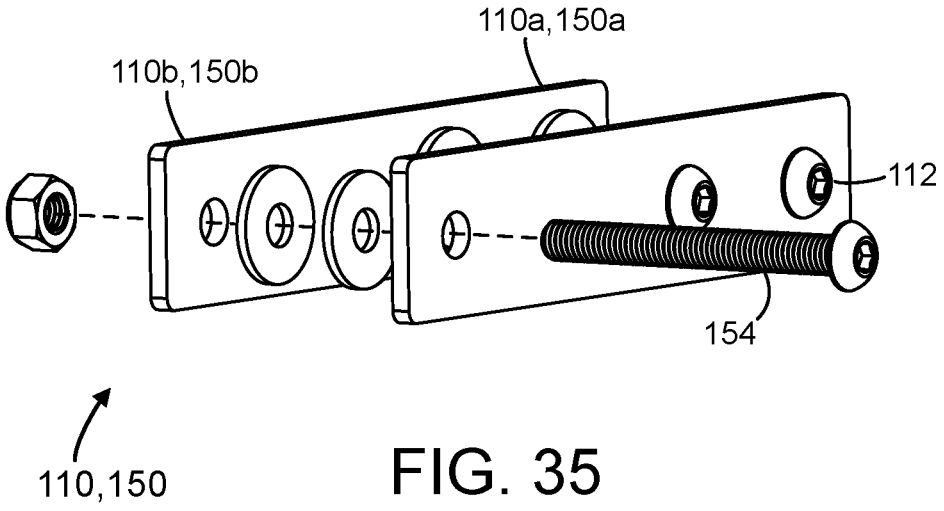
FIG. 35 is a side perspective view of the preferred embodiment of the present invention illustrating a pair of opposing inline plate connecting together by bolt and nut assemblies.
Figure 36:
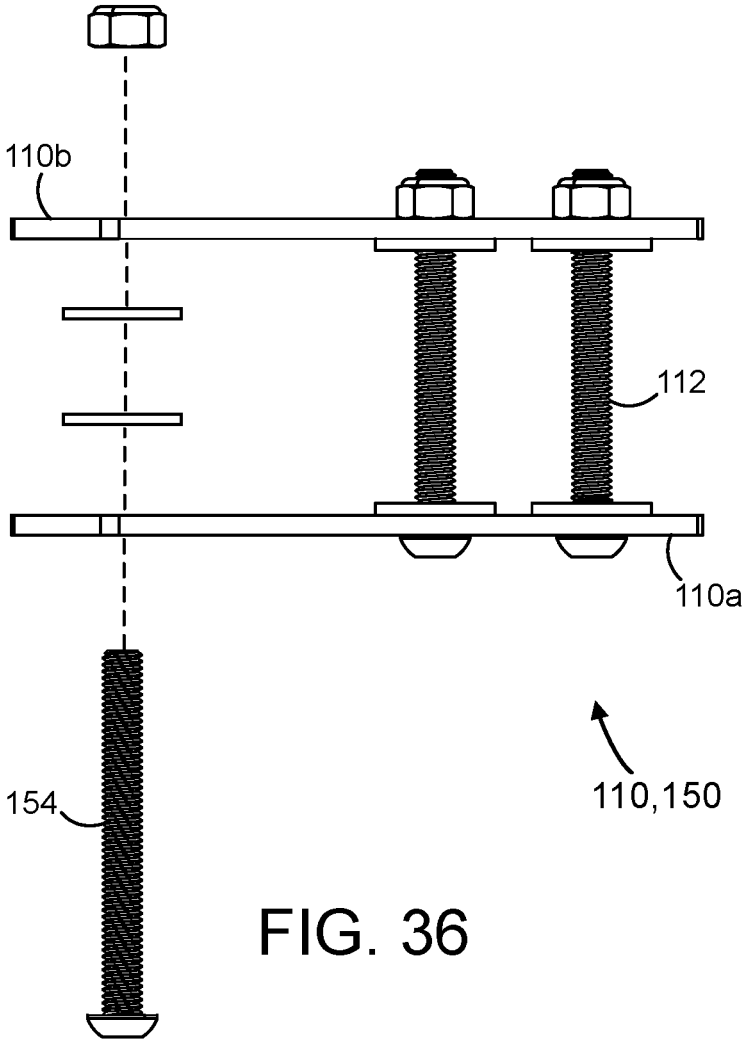
FIG. 36 is a top plan view of the preferred embodiment of the present invention illustrating a pair of opposing inline plate connecting together by bolt and nut assemblies.

As generally depicted in FIGS. 29, 33 and 34, the primary canopy 132 includes a pair of sideward members 136 each having a first end 136*a* connecting to ends 138*a* of a cross member 138 by way of the two-way corner connector 94. The primary canopy is further shown as including a shortened arm 140 generally extending perpendicular to the sideward member 136 and connecting intermediate along thereof to a second end 136*b* of the sideward member by way of a pair of opposing T-plates 142 each having an outward portion 142*a* and a lengthened portion 142*b*, of which may be fastened by bolt and nut assemblies 144 as in FIG. 29, welds, or equivalent fastening means known in the art. In other featural aspects of the primary canopy 132, each of the shortened arms includes first and second ends 140*a*, 140*b* respectively connecting to the outward end 100*c* of the sideward arm 100 and a first end 146*a* of a sideward support 146 of a ground brace 148 by way of a pair of opposing inline plates 150 of the type shown in FIGS. 35 and 36, particularly equivalent to the type used for pivotally joining the inward end of the sideward arm to the upper outward member of the supportive wind wall. In the instance of their usage, a fixed end 150*a* of the individual inline plates is shown in FIG. 29 as being fixedly attached to the outward end 100*c* of the sideward arm as well as the second end of the sideward support by fastening means, such as bolt and nut assemblies 152 as in FIG. 29, welds, or equivalent fastening methodologies known in the art. Comparatively, a free end 150*b* of the individual inline plate providing for capabilities for pivotal movement is shown as being attached to the first and second ends of the shortened arms by pivot fastening means, such as a bolt and nut assembly 154 as in FIG. 29, pass-through pin or bolt with locking capabilities, such as a lockable cross pin, cotter pin, couplers, eye pin, and so forth, or equivalent structural forms known in the art for fulfilling pivotal movement.

As an alternative embodiment, in lieu of the shortened arm, the primary canopy may connect to the sideward arms and ground brace by way of a pair of dual triangulated pivot plates 156 each configured with a pair of outward ends 156*a* and arranged in an opposing manner, whereby a fixed connection is maintained with the sideward members of the primary canopy by fastening means, such as bolt and nut assemblies 158 as in FIG. 33, welds, or equivalent methodologies known in the art for this strict purpose. Pivoting connectivity of the outward ends of the dual triangulated pivot plates with the outward end 100*c* of the sideward arm 100 and sideward support 146 of the ground brace is fulfilled by pivot fastening means to the likes noted above for the opposing inline plates.

Figure 37:
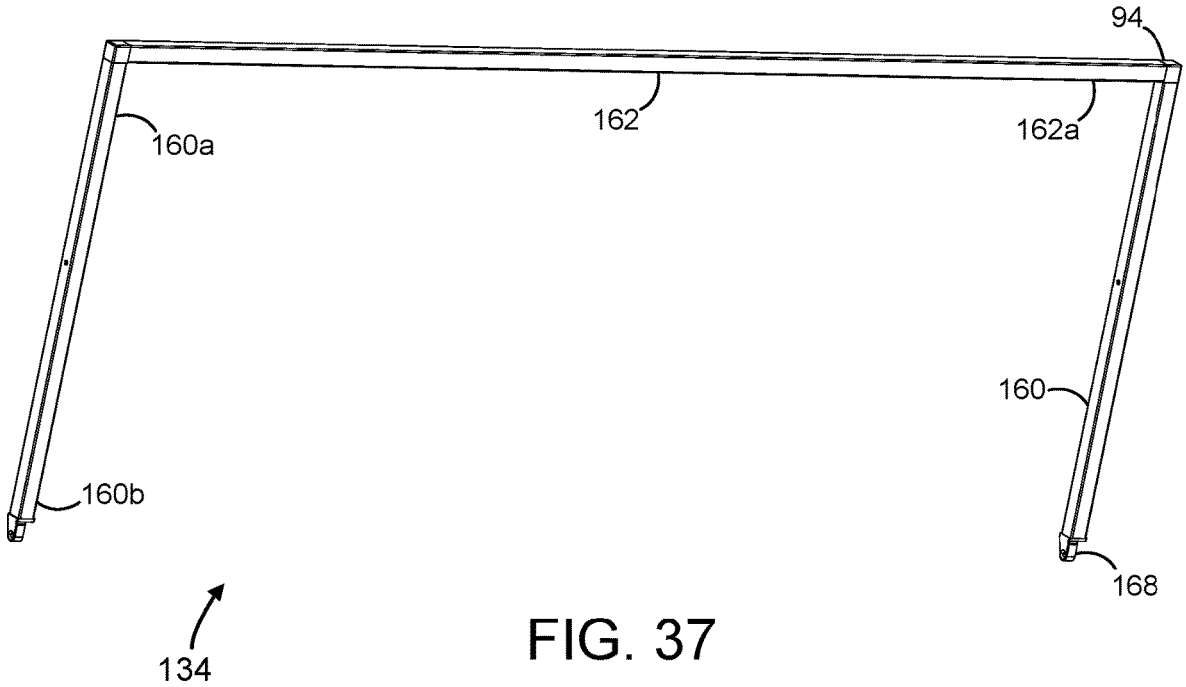
FIG. 37 is a top perspective view of the preferred embodiment of the present invention illustrating a secondary canopy having a pair of sideward members connecting to a cross support.
Figure 38:
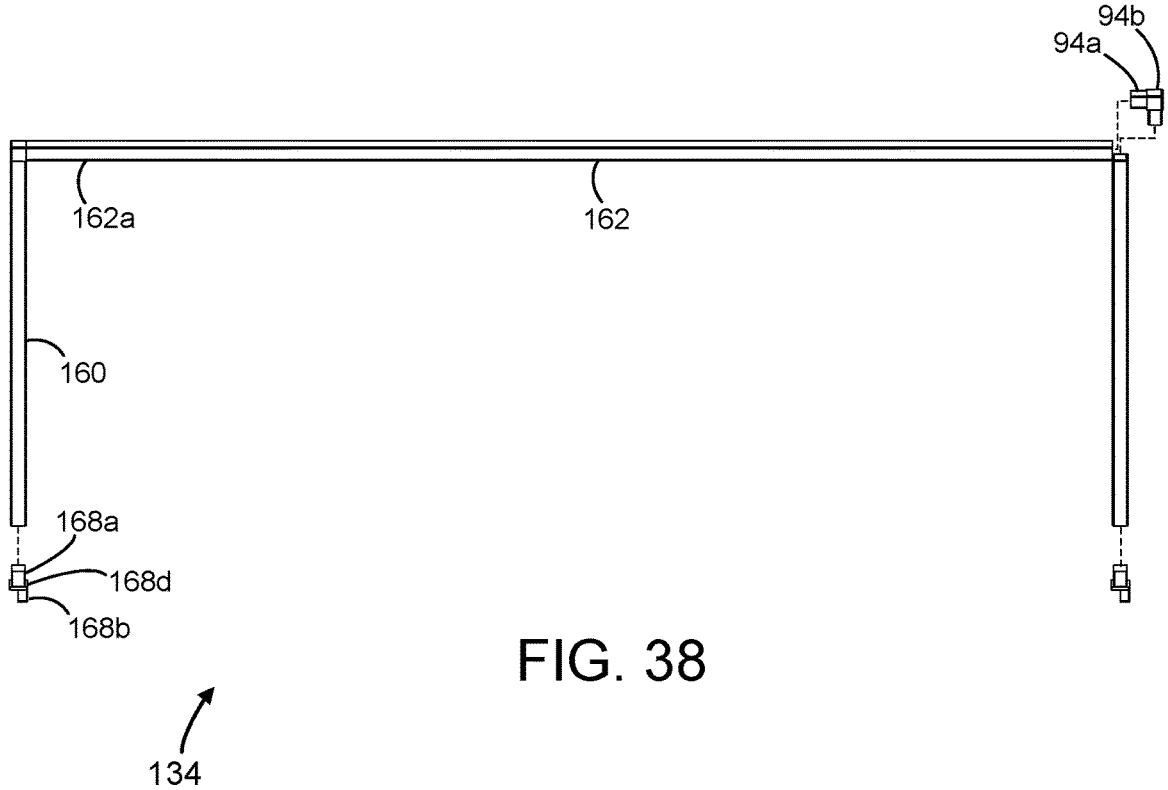
FIG. 38 is a front elevational view of the preferred embodiment of the present invention illustrating a secondary canopy having a pair of sideward members connecting to a cross support and fitted with end-mountable brackets.

As generally represented in FIGS. 37 and 38, the secondary canopy 134 is shown therein as possessing similar structural characteristics as the primary canopy, but differs slightly with respect to its mounting to the sideward arm 100, particularly as such to allow full collapse inwardly toward the supportive wind wall 84. Accordingly, the secondary canopy includes a pair of sideward members 160 each having a first end 160*a* connecting to ends 162*a* of a cross support 162 by way of the two-way corner connector 94. Connection of the secondary canopy to the sideward arm may be fulfilled by a pivot bracket assembly 164 as in FIG. 27 or by a pair of opposing T-plates 166 as in FIG. 29.

Figure 39:
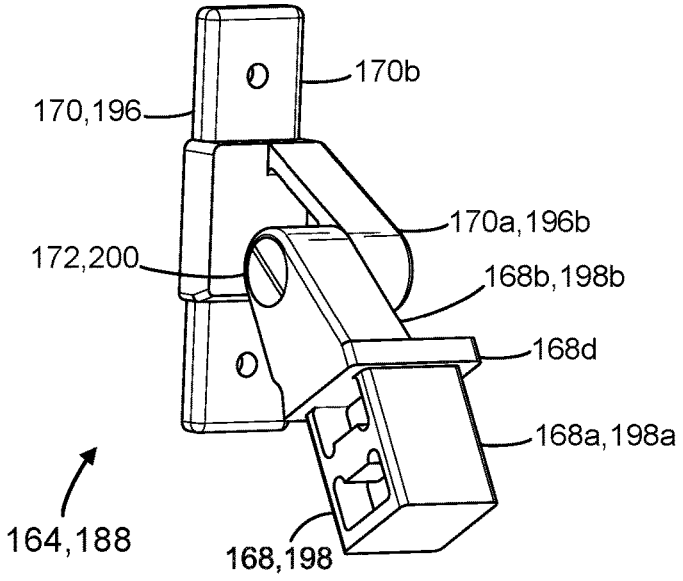
FIG. 39 is a front perspective view of the preferred embodiment of the present invention illustrating a pivot bracket assembly having a plate-mountable bracket pivotally connecting to an end-mountable bracket.
Figure 40:
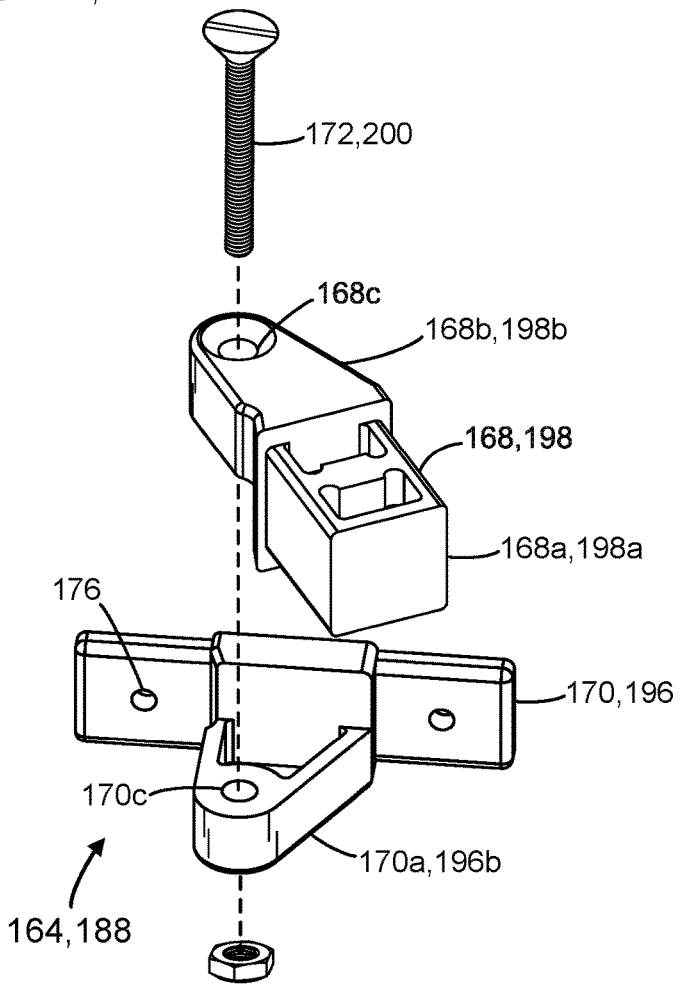
FIG. 40 is an exploded perspective view of the preferred embodiment of the present invention illustrating a pivot bracket assembly having a plate-mountable bracket separable from an end-mountable bracket and a bolt and nut assembly.

The pivot bracket assembly as generally represented in FIGS. 39 and 40 provides for pivotal connection of the sideward members 160 to the sideward arms 100, whereby an end-mountable bracket 168 and a plate-mountable bracket 170 respectively attach to the second end 160*b* of each sideward member and intermediate along each of the sideward arms 100 of the moveable frame assembly 18. As generally depicted in FIGS. 39 and 40 the end-mountable bracket includes an insertable end 168*a* integrally connecting to and extending inline and outwardly from an off-setting protuberance 168*b* configured with a cross bore 168*c*. The end-mountable bracket is further shown in FIG. 39 as having a formed ridge 168*d* situated in between the insertable end and off-setting protuberance to serve as a stop mechanism as the insertable end slidably fits interiorly within the tubing of the sideward member. Permanent or temporary fastening of the insertable end to the sideward member may be maintained by screws, bolts, glue, and other methodologies recognized in the art for this purpose.

Comparatively, the plate-mountable bracket 170 is shown in FIGS. 39 and 40 as comprising a complementary offsetting protuberance 170*a* integrally connecting to and extending outwardly from a base plate 170*b*, whereby the complementary offsetting protuberance engagingly mates with the adjacently-placed offsetting protuberance 168*b* of the end-mountable bracket and connects therewith by way of a bolt and nut assembly 172 appropriately suited for fitment within the arrangement of bores 168*c*, 170*c* extending through the offsetting protuberances. Connection of the plate-mountable bracket is generally fulfilled by at least two bolts 174 or equivalent passing into and through an aligned arrangement of apertures 176 extending through the base plate of the plate-mountable bracket and sideward arm and threadably fitted with nuts 174*a*.

Figure 41:
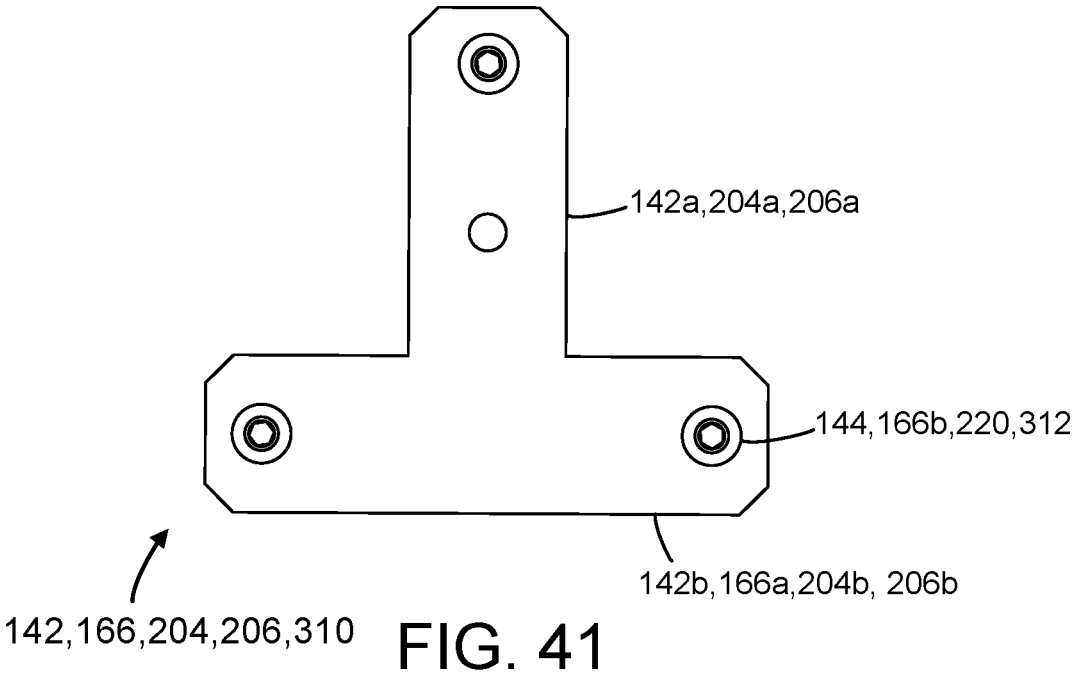
FIG. 41 is a side elevational view of the preferred embodiment of the present invention illustrating a pair of opposing T-plates each with an outward portion and a lengthened end.
Figure 42:
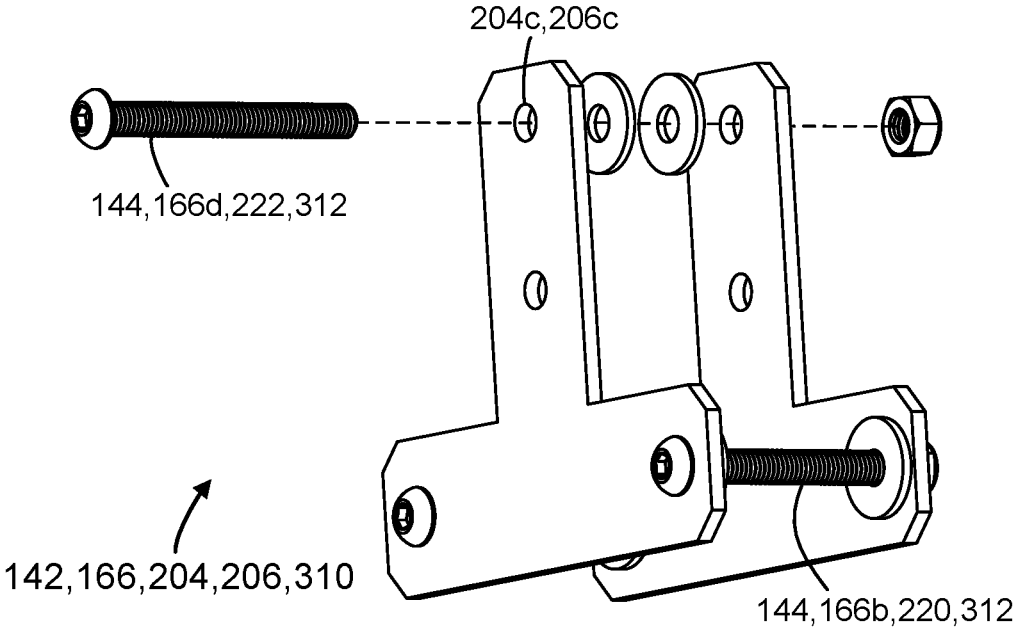
FIG. 42 is a side perspective view of the preferred embodiment of the present invention illustrating a pair of opposing T-plates each having an outward portion and a lengthened end and connecting together by bolt and nut assemblies.

In instances of using the opposing T-plates 166 for joining the secondary canopy to the sideward arm of the type represented in FIGS. 41 and 42, a lengthened portion 166*a* thereof is fixedly attached to the sideward arm 100 by fastening means, such as bolt and nut assemblies 166*b* as in FIG. 29, welds, rivets, or equivalent, whereas an outward portion 166*c* is attached to the second end 160*b* of the sideward member 160 by pivot fastening means, such as a singular bolt and nut assembly 166*d* as in FIG. 42, a pin with locking capabilities, or equivalent type of fastener capable of fulfilling pivotal action thereabout.

Consequently, through the structural connective arrangement of the end-mount and plate-mountable brackets, the secondary canopy 134 can pivotally travel relatively about PB-D inwardly toward the sideward arm 100 in direction of D' along path D in FIG. 30 until the first end of the sideward member 136 generally comes in proximate contact with the inward end 100*a* of the sideward arm as in FIG. 27. Conversely, the secondary canopy 134 can travel outwardly away and apart from the sideward arm 100 in direction of D" along path D to the extent of establishing a near-perpendicular orientation thereof with respect to the sideward arm, as generally shown in FIG. 30.

Figure 43:
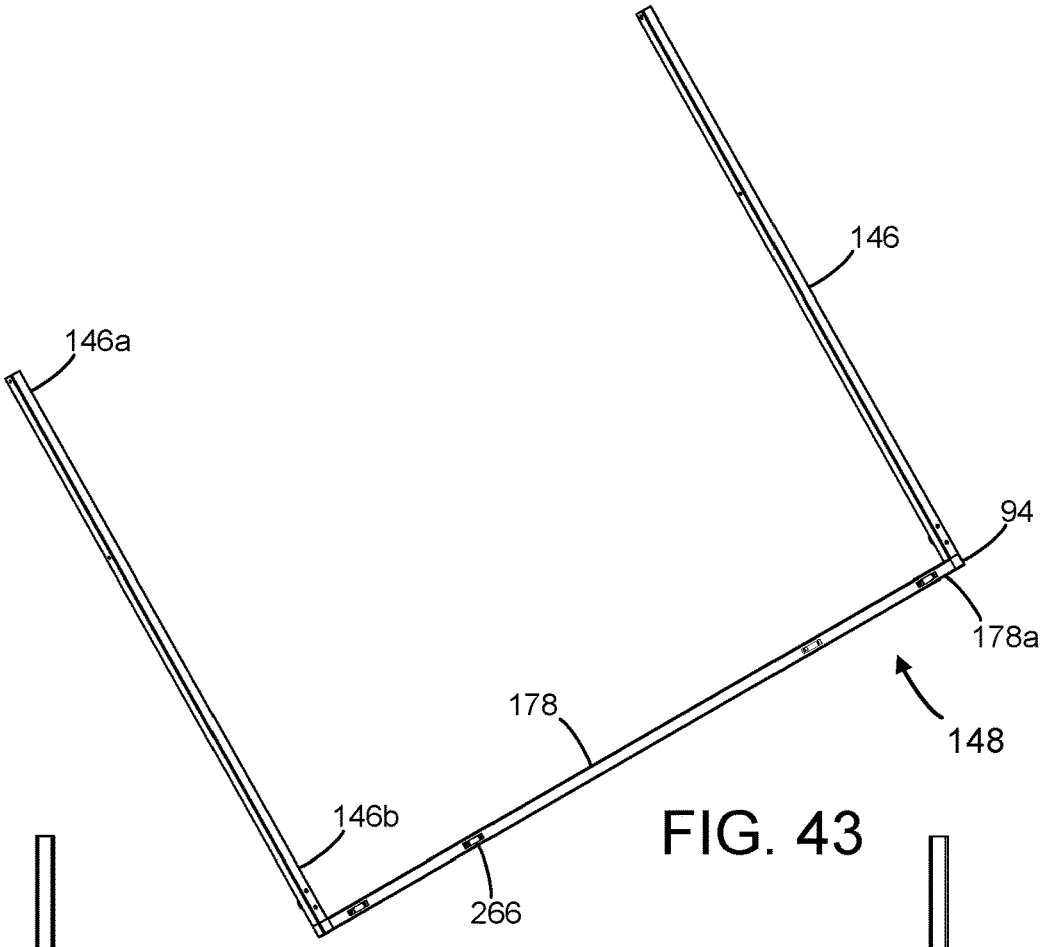
FIG. 43 is a front perspective view of the preferred embodiment of the present invention illustrating a ground brace having a pair of sideward supports connecting to a cross member.
Figure 44:
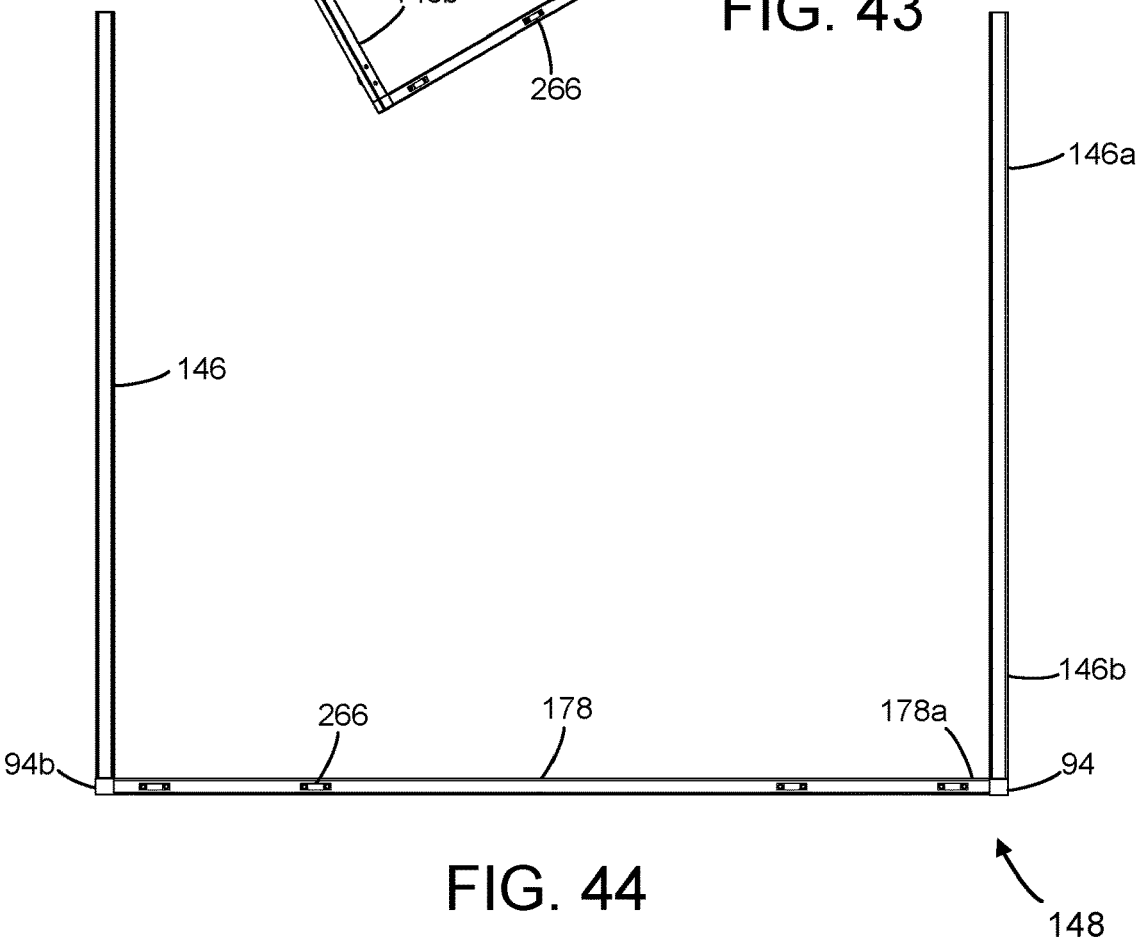
FIG. 44 is a side elevational view of the preferred embodiment of the present invention illustrating a ground brace having a pair of sideward supports connecting to a cross member.

In reference to FIGS. 43 and 44, the portable shelter 10 incorporates within its structure the ground brace 148 to provide for overall structural support of the moveable frame assembly 18 while presented in expanded form for accommodating occupancy by individuals Similar to the construct of the primary and secondary canopies, each of the sideward supports 146 of the ground brace 148 is shown in FIG. 43 as comprising a second end 146*b* connecting to one of two ends 178*a* of a cross member 178 by way of the two-way corner connectors 94 with the insertable ends 94*a* associated therewith being permanently or temporarily attached by fasteners of the type recognized in the art for such purpose, including, press-fitted, screws, bolts, glue, or equivalent. As generally illustrated in FIGS. 29 and 30 and discussed above, adaptation of the opposing T-plates or dual triangulated pivot plates 156 for joining the sideward supports 146 to the primary canopy 132 aptly allows the ground brace 148 to pivot and move inwardly with respect to the primary canopy 132 to fulfill states of partial compactness and expansion of the moveable frame assembly 18 as may be desired from time to time.

Figure 45:
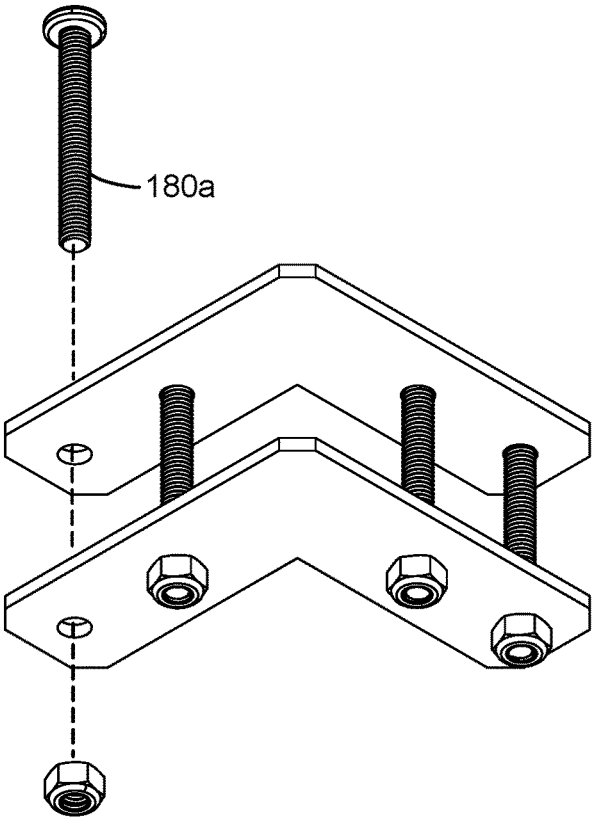
FIG. 45 is a bottom perspective view of the preferred embodiment of the present invention illustrating a pair of corner braces connecting together by bolt and nut assemblies.
Figure 46:
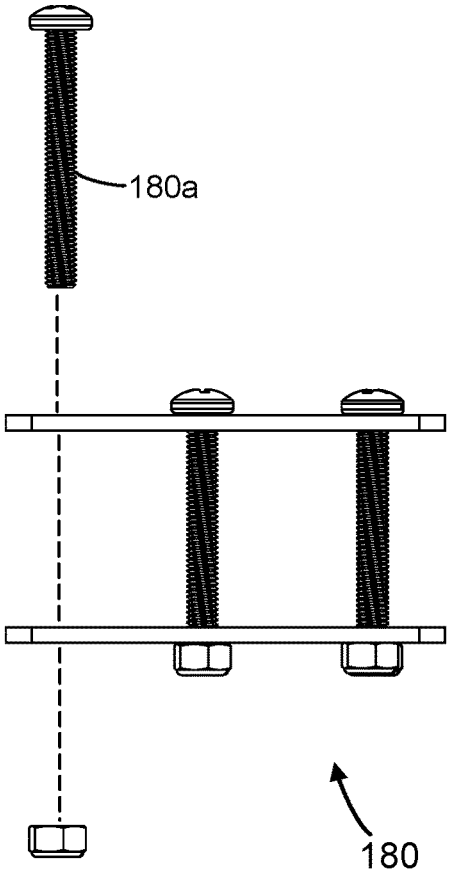
FIG. 46 is a top plan view of the preferred embodiment of the present invention illustrating a pair of corner braces connecting together by bolt and nut assemblies.

As further associated with the portable shelter 10, the primary and secondary canopies as well as the ground brace may include multiple pairs of corner braces 180 of the type shown in FIGS. 45 and 46 to offer structural strength and advance rigidity thereto, particularly among areas most prone to possible permanent disfiguration due to applied twisting and torsional forces that the portable shelter may sustain during operative events. Accordingly, it is desired to place and mount pairs of corner braces in an opposing manner relatively on each side of individual two-way and three-way corner connectors that effect to join the sideward members 136 with that of the cross member 138, as generally associated with the primary canopy, and sideward members 160 with that of the cross support 162, as generally associated with the secondary canopy 134, as well as other structural components requiring supplemental support and rigidity. Like the opposing line plates, the corner braces are fastened to the appropriate, designated structure by fastening means, such bolt and nut assemblies 180*a* as in FIGS. 45 and 46, rivets, or equivalent. Now in reference to FIGS. 47-49, the portable shelter 10 incorporates within its overall structure a supportive extending assembly to assistively extend the moveable frame assembly 18 from the supportive wind wall 84 while in a contracted relation and offer continued support thereof while in an expanded relation.

Figure 47:
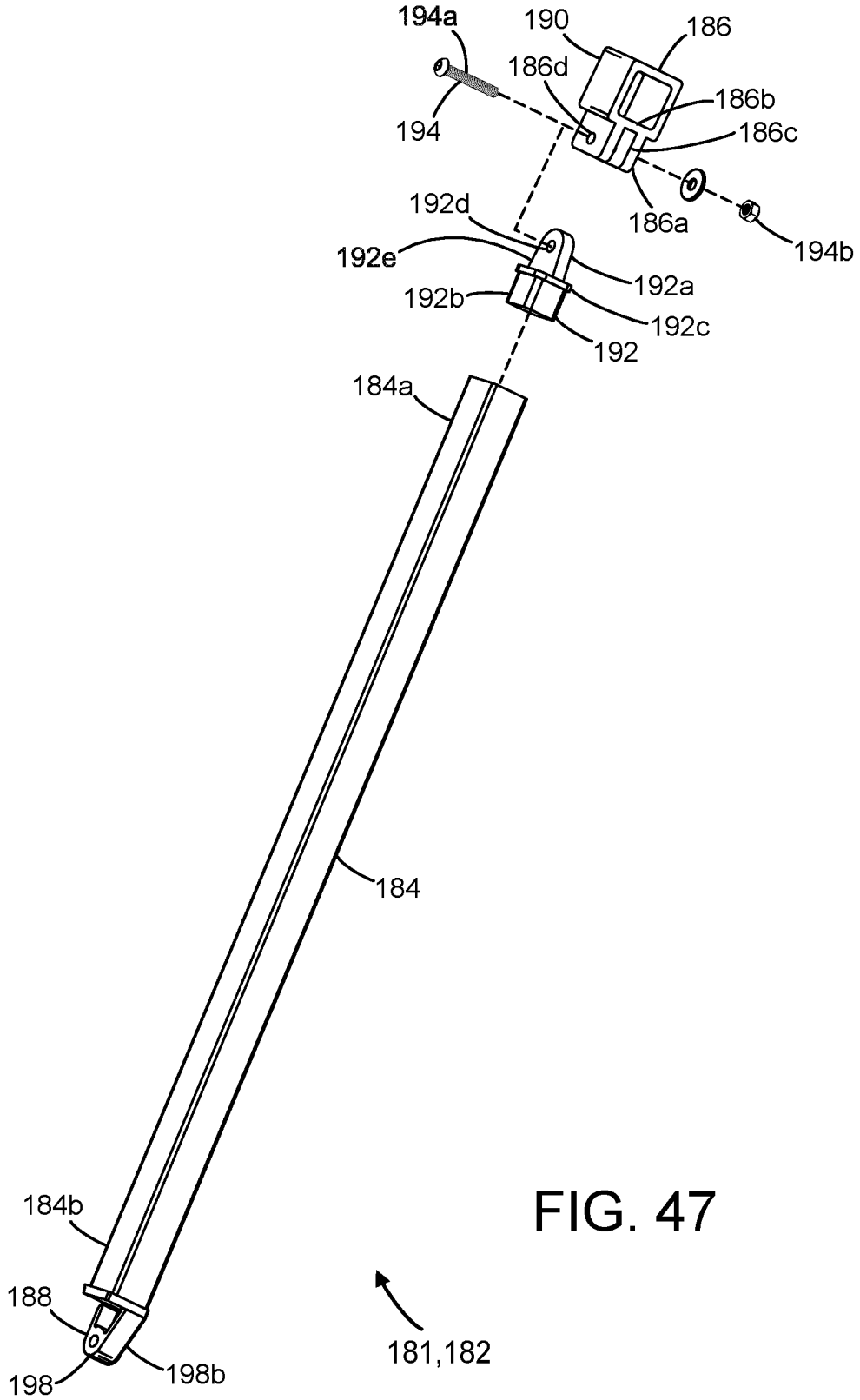
FIG. 47 is an exploded perspective view of the preferred embodiment of the present invention illustrating an angular moveable support having a rigid member separable from an end-mountable pivot bracket and an arm-encompassing sleeve.
Figures 48, 48A:
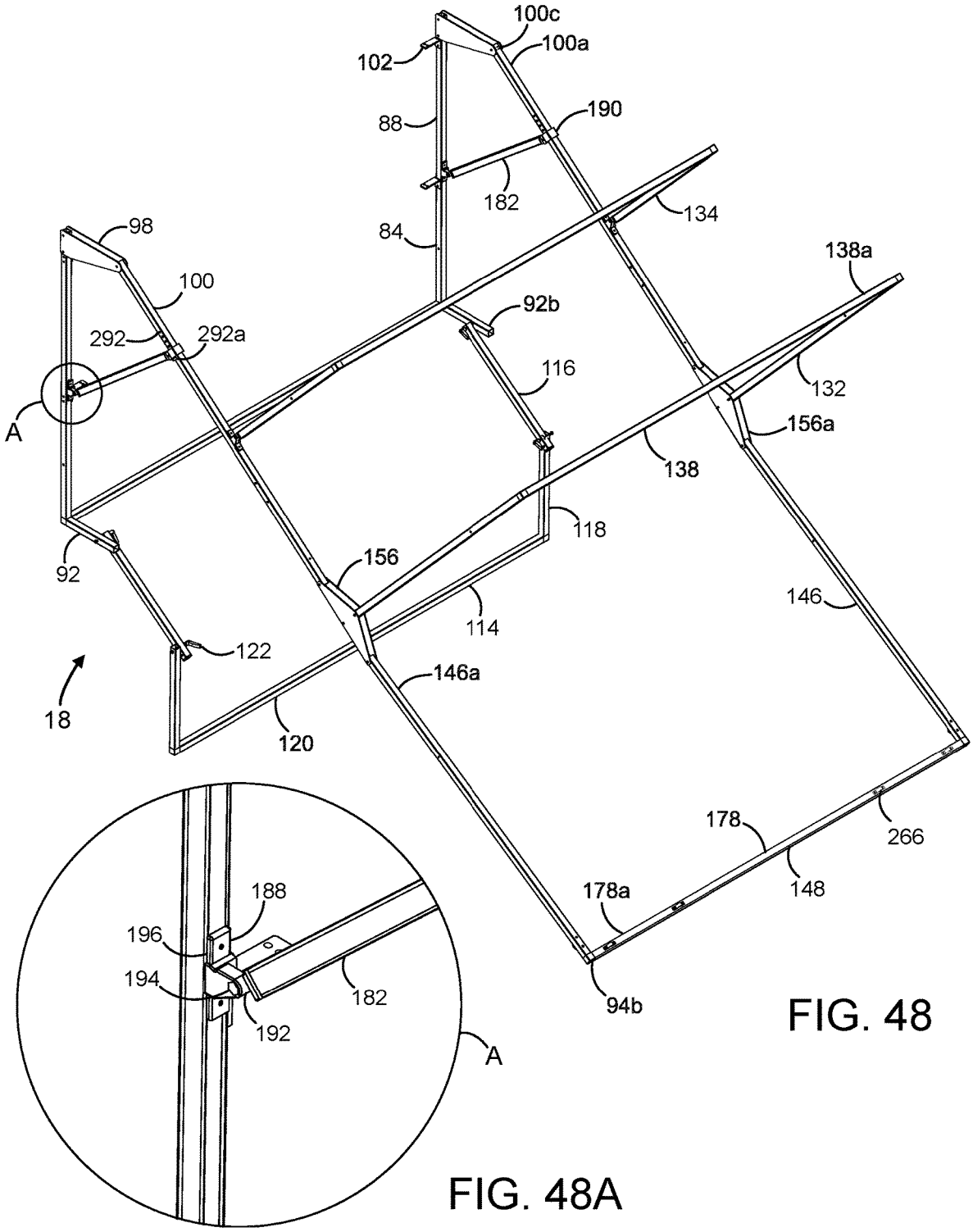
FIG. 48 is a front perspective view of the preferred embodiment of the present invention illustrating a supportive wind wall having a pair of dual-mountable pivot plates and connecting to a moveable frame assembly and a lower wind wall collectively in an expanded relation.
FIG. 48A is a partial enlarged view of the preferred embodiment of the present invention illustrating a pivot bracket assembly mountable to an upright support of a supportive wind wall and pivotally connecting to an angular moveable support.
Figure 49:
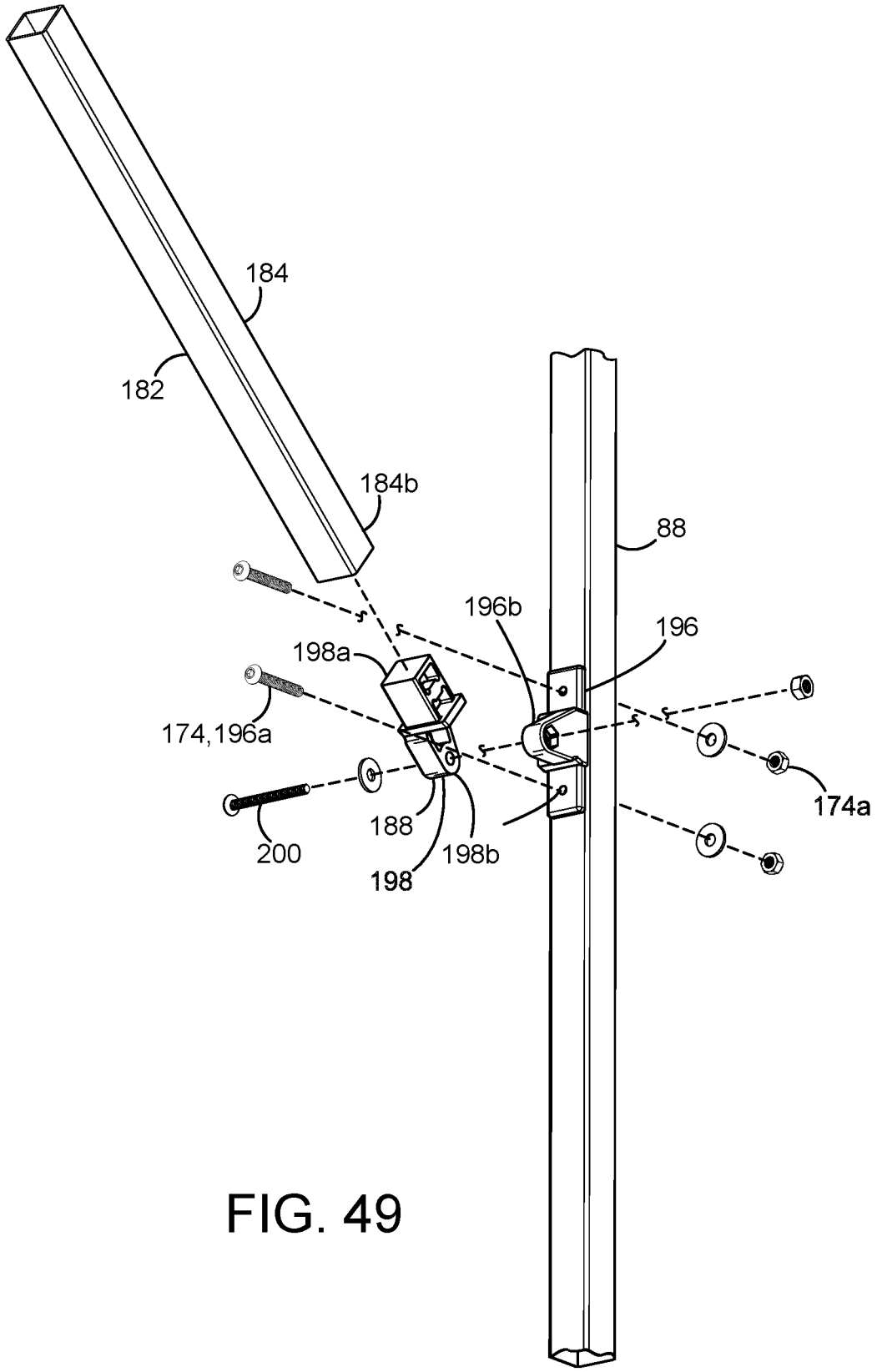
FIG. 49 is an exploded, partial perspective view of the preferred embodiment of the present invention illustrating a pivot bracket assembly having a plate-mountable bracket attachable to an upright support of a supportive wind wall and an end-mountable bracket separable from a rigid member of an angular moveable support.

As generally depicted in FIG. 47, the supportive extending assembly 181 includes a pair of angular moveable supports 182 each extendably spans the connective arrangement of the upright support 88 and sideward arm 100 to afford pivotal rotation relatively about a pivoting end 98*d* of the dual-mountable pivot plates 98 or free end 110*b* of the connected, opposing pairs of inline plates 110 generally designated at PB-B, whereby the sideward arms 100 primarily travel along path B in direction B' to generally reside in proximity to the upright supports of the supportive wind wall 84 to effect a compact relationship thereof and, conversely, along path B in direction B" to extend outwardly from the upright support of the supportive wind wall to effect a fully expanded relationship, as generally represented in FIG. 30. Each angular moveable support 182 is shown in FIG. 47 as comprising a rigid member 184 having a first end 184*a* operably connecting to a slidable yoke assembly 186 and a second end 184*b* operably connecting to a pivot bracket assembly 188 of which respectively attaches to the sideward arm 100 and upright support 88 of the supportive wind wall. The slidable yoke assembly, as particularly shown in FIGS. 47 and 48, includes an arm-encompassing sleeve 190 capable of being slidably fitted to the sideward arm 100 and a pair of flanges 186*a* integral to and extending from one wall 186*b* of the arm-encompassing sleeve to form an inner slot 186*c* for receiving therein a center-positioned protuberance 192*a* of an end-mountable pivot bracket 192. In FIG. 47, the end-mountable pivot bracket is further associated with an insertable end 192*b* integrally connecting to and extending outwardly from an intermediate ridge 192*c* that adequately serves as stop mechanism to the likes described above for the end-mountable bracket 168 of the pivot bracket assembly 164, whereby the insertable end may be permanently or temporarily attached to the first end of the rigid member 184 of the angular moveable support by a variety of fasteners generally known in the art for such purpose. Connectivity between the slidable yoke assembly 186 and the center-positioned protuberance 192*a* is furthered by a bolt and nut assembly 194, wherein the bolt 194*a* fits within an aligned arrangement of apertures 192*d*, 186*d* extending through a face 192*e* of the center-positioned protuberance and pair of flanges 186*a* with a nut and washer 194*b* being mounted to the bolt to consummate the assembly. Comparatively, the pivot bracket assembly 188 appropriate for connecting the upright support to the angular moveable support 182 as in FIG. 49 is structurally equivalent to the type used in connecting the secondary canopy 134 to the sideward arms 100, whereby a plate-mountable bracket 196 is mountable to the upright support 88 with fastening means, such as bolt and nut assemblies 196*a*, screws or equivalent, while the end-mountable bracket 198 with an insertable end 198*a* is fitted interiorly within the second end 184*b* of the rigid member 184. In completing the assembly, off-setting protuberances 196*b*, 198*b* integrally made part of the plate- and end-mountable brackets are placed adjacent to one another and connected together by pivot fastening means, such a bolt and nut assembly 200 or equivalent to fulfill capabilities of pivotal movement thereabout, as typically shown in FIGS. 39, 40 and 49.

As generally depicted in FIGS. 50, 50A and 51, the supportive extending assembly may alternatively comprise a pair of telescopic supports 202 that connectively span from the upright supports 88 to the sideward arms 100, whereby first and second ends 202*a*, 202*b* of the telescopic support respectively connect to outward portions 204*a*, 206*a* of upper and lower sets of opposing T-brackets 204, 206. In particular, each telescopic support is shown in FIGS. 50 and 51 as comprising an inner slidable support 208 slidably fitting interiorly within an elongate sleeve 210 that geometrically conforms therewith. The elongate sleeve includes a first open end 210*a* and a second open end 210*b* respectively accommodating an end cap 212 and a bushing 214 capable being placed interiorly in part within the elongate sleeve while permitting a portion of the inner slidable support 208 to slidably pass through an opening 214*a* associated with the bushing. Comparatively, the inner slidable support is shown to include an open end 208*a* for accommodating therein an insertable end 216*a* of a fitted stop mechanism 216, whereby an enlarged portion 216*b* integrally extending outwardly from and in line with the insertable end forms a peripheral rim 218 that aptly engages with and abuts against an end wall portion 208*b* of the inner slidable support while being fixedly attached thereto. As further evident in FIG. 50A, the enlarged portion includes a spring-loaded pin 216*c* of conventional form and is geometrically configured to tightly fit, but slide interiorly within the elongate sleeve 210, whereby formed surface ridges 216*d* existing exteriorly on the enlarged portion are capable of interactively engaging with and sliding relatively about the elongate sleeve's inner walls without profound resistance while the inner slidable support slidably moves in position to allow the spring-loaded pin to lockingly engage with one of a plurality of apertures 210*c* extending through a wall section 210*d* of the elongate sleeve 210. FIGS. 24 and 29 generally depict connectivity of each of the telescopic supports to the individual sets of T-brackets, where in particular a lengthened portion 204*b*, 206*b* of each of the upper and lower sets of opposing T-brackets 204, 206 is respectively attached to the sideward arm 100 and upright support 88 by fastening means, such as bolt and nut assemblies 220 as in FIGS. 41 and 42, welds, or equivalent methodologies known in the art. Conversely, attachment of the first and second ends of the telescopic supports to each of the outward portions 204*a*, 206*a* of the upper and lower T-brackets is fulfilled by pivot fastening means, such, for example, a bolt and nut assembly 222 with the bolt respectively passing through an aligned arrangement of apertures 202*c*, 204*c*, 206*c* extending individually through the first and second ends of the telescopic support and outward portions of the upper and lower sets of opposing T-brackets designated therefor with nuts being threadably attached thereto to complete the assembly.

Figure 52:
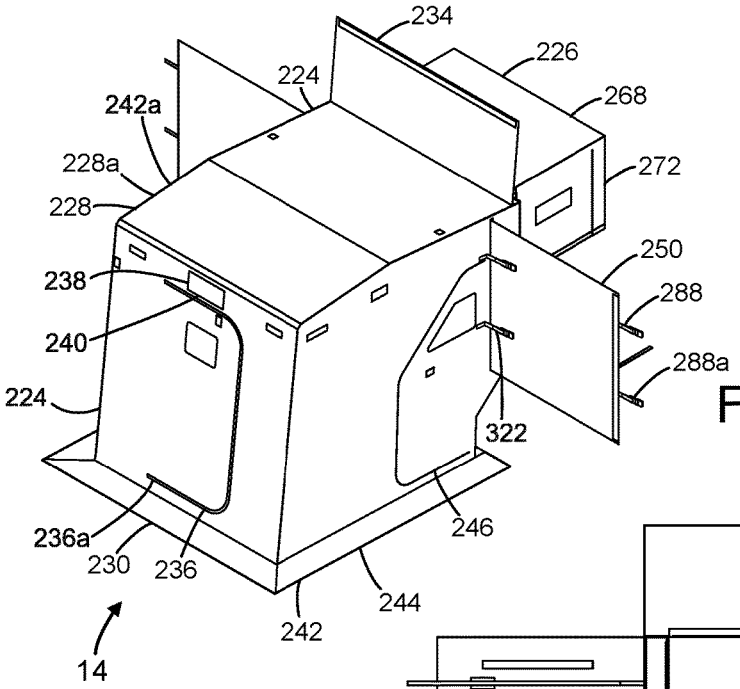
FIG. 52 is a top perspective view of the preferred embodiment of the present invention illustrating a primary shelter shell joining to a secondary shelter shell.
Figure 53:
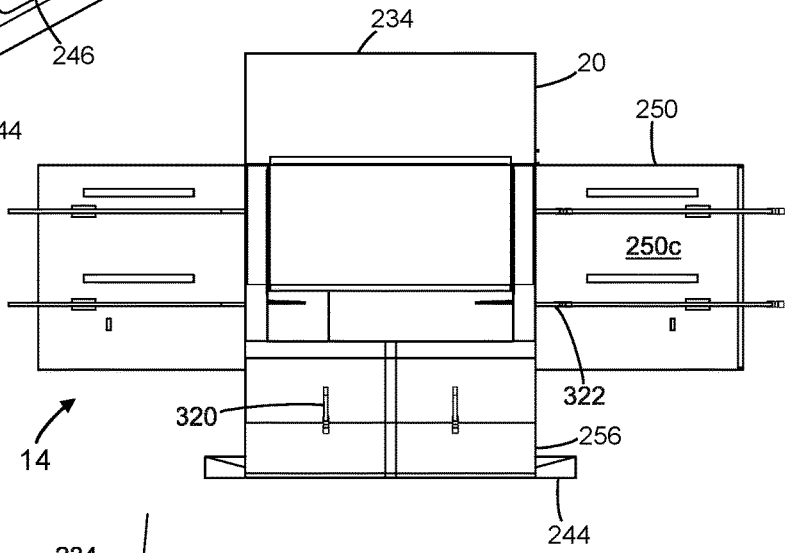
FIG. 53 is a front elevational view of the preferred embodiment of the present invention illustrating a primary shelter shell joining to a secondary shelter shell.
Figure 54:
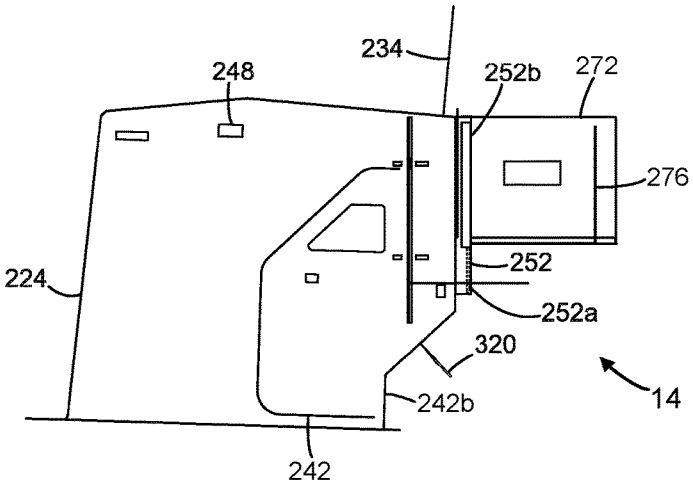
FIG. 54 is a side elevational view of the preferred embodiment of the present invention illustrating a primary shelter shell joining to a secondary shelter shell.
Figure 55:
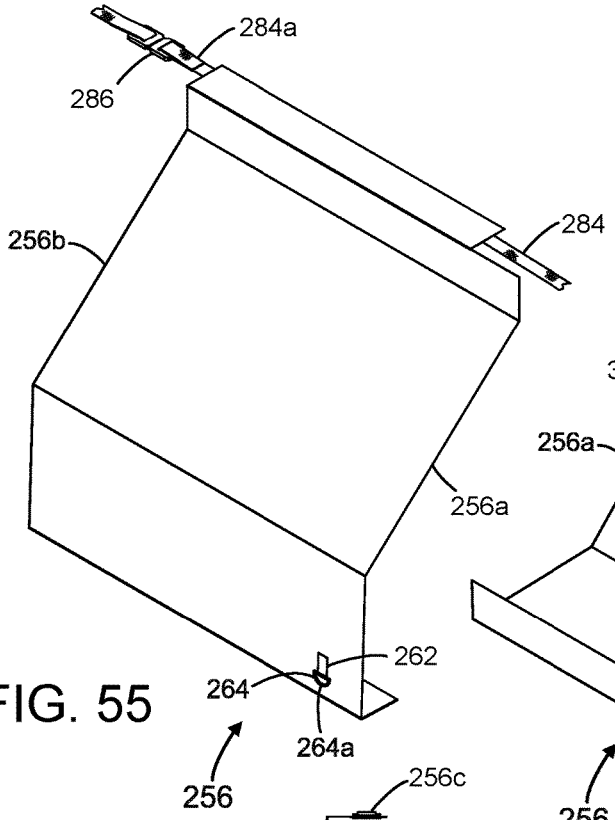
FIG. 55 is a rear perspective view of the preferred embodiment of the present invention illustrating a companion bottom panel of a pair of bottom panels and having a formed sleeve.

As generally shown in FIGS. 52-54, the protective shell assembly 14 comprises a primary shelter shell 224 designated for use with the moveable frame assembly 18 and a secondary shelter shell 226 designated for use with the box frame that generally exists separable from the primary shelter shell, but semi-permanently attached thereto to facilitate assembly and disassembly for repairs that may be needed from time to time, for example, as well as providing for varied use of the box frame 16, with and without the secondary shelter shell, apart from the moveable frame assembly 18, with and without the primary shelter shell, and vice versa.

The primary shelter shell 224, as represented in FIGS. 52-54, includes a top-rearward panel 228 integrally including a bottom outward flap 230 to engage with the ground's surface that functionally mitigates updrafts into an interior compailinent 232 of the portable shelter and an extending top flap 234 of the integral assembly of flaps 20 used in part to encase the moveable frame assembly while presented in collapsible form for transportational purposes. Other notable features of the top-rearward panel as in FIG. 52 include an integrated rearward access door 236 operably configured with a zipper 236*a* or equivalent type of closure mechanism for sealing the doorway and one or more windows 238 with each having a closable flap 240 configured with a hook-and-loop fastener or equivalent attached along a top side thereof.

In FIGS. 1-4 and 52-54, the primary shelter shell 224 further includes a pair of side panels 242 each including a common perimeter edge 242*a* sewnly attached to and along a common sideward edge 228*a* of the top-rearward panel, a bottom outward flap 244, an integrated door 246 to the likes set forth for the top-rearward panel, one or more sealable air vents 248, an elongate sideward flap 250 possessing protective functionality substantially equivalent to the extending top flap 234 for transportational purposes, and a sideward closure flap 252 for enclosing an elongate area 254 formed in between the supportive wind wall 84 and corner post 22 of the box frame 16, as generally depicted in FIG. 28.

In further association with the primary shelter shell 224, as shown in FIGS. 53 and 55-58, a pair of bottom panels 256 is fixedly positioned relatively about the lower wind wall 86, where in particular each bottom panel includes an outer sideward edge 256*a* sewnly attached to a lower perimeter edge 242*b* of the side panel and a common interior edge 256*b* configured with a hook-and-loop fastener 258 or equivalent to engagingly mate with its complementary hook-and-loop fastener or equivalent associated with the adjacent, companion bottom panel.

Figure 3:
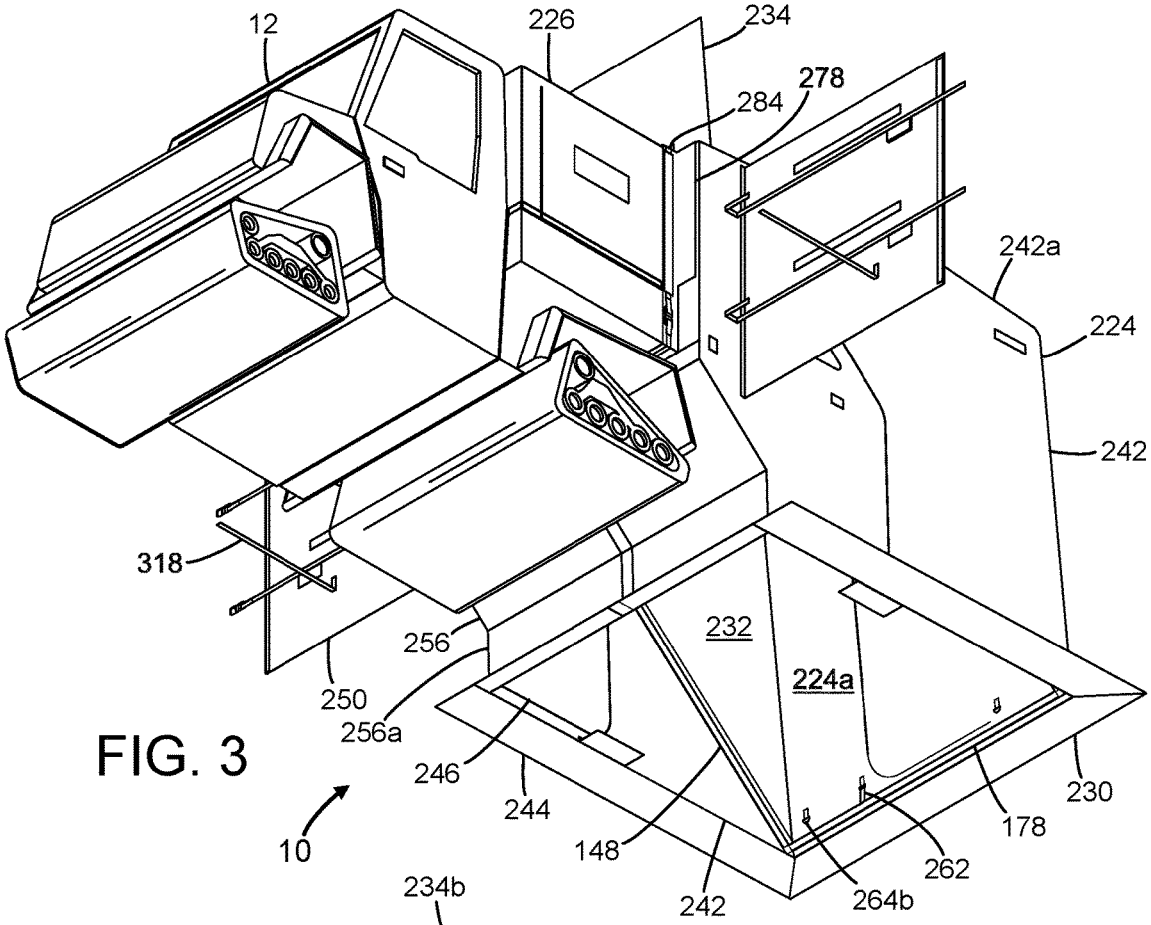
FIG. 3 is a bottom perspective view of the preferred embodiment of the present invention illustrating a primary shelter shell connecting to a secondary shelter shell operably attached to a vehicle.
Figure 4:
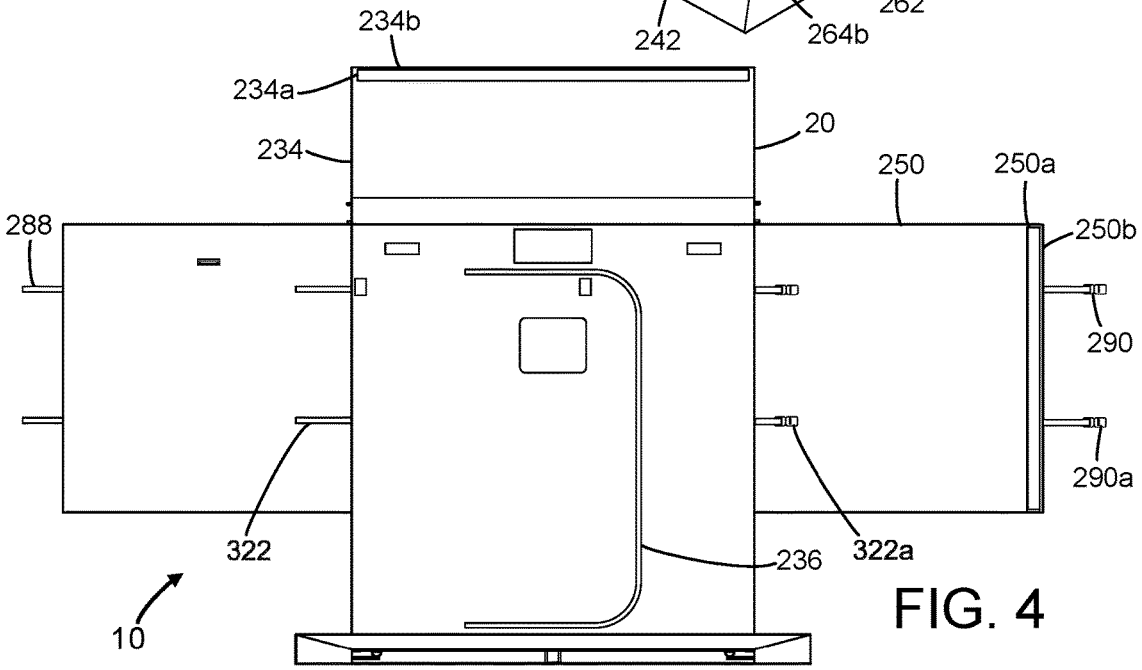
FIG. 4 is a rear elevational view of the preferred embodiment of the present invention illustrating a primary shelter shell having an extending top flap and a pair of elongate sideward flaps.

Connection of the primary shelter shell to the moveable frame assembly 18 as in FIG. 3 is mainly provided by multiple straps 262 extending outwardly from and attaching to an interior surface 224*a* of the primary shelter shell. Each of the straps generally incorporates at its end a fastener 264 in the form of a hook-and-loop fastener, a D-ring 264*a*, snap, button, or other suitable types generally recognized in the art for fulfilling this purpose. Configuration and securement of the straps 262 specifically in relation to the cross member of the primary canopy, cross support of the secondary canopy, and cross member of the ground brace generally involves encircling the straps around each of the foregoing structures and affixing their position with the fastener. FIG. 3 illustrates exemplarily availability of straps individually configured with a D-ring to effect connection of the top-rearward panel 228 to available loop brackets 266 extending outwardly from and connecting to the sideward support and cross member 178 of the ground brace 148 and bottom panels 256 of the lower wind wall 86.

Figure 59:
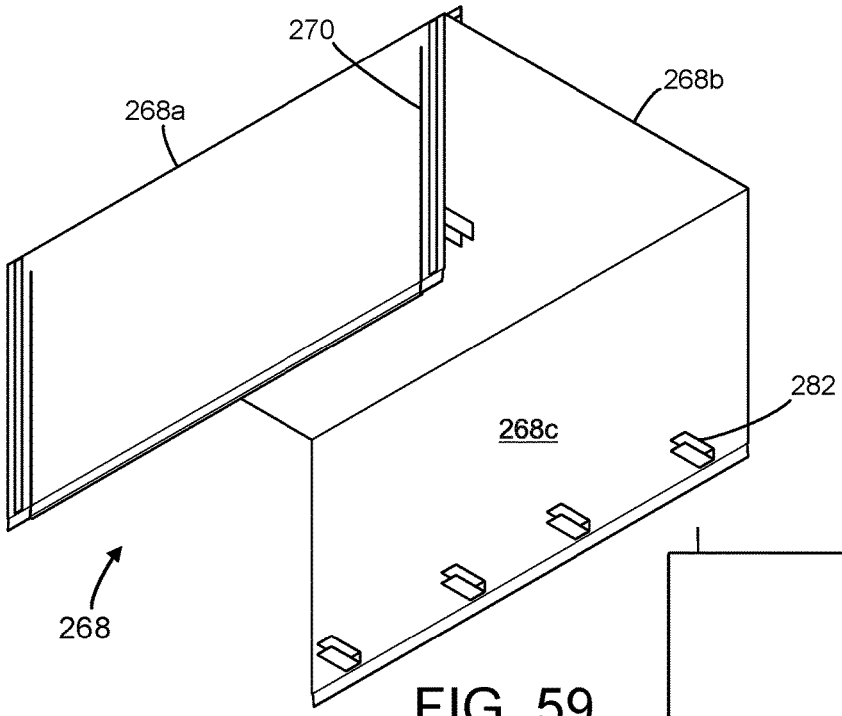
FIG. 59 is a bottom perspective view of the preferred embodiment of the present invention illustrating a frontal-top-rearward panel of a secondary shelter shell.
Figure 60:
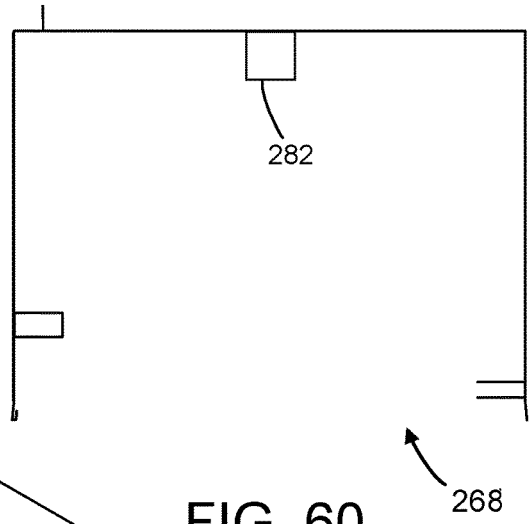
FIG. 60 is a side elevational view of the preferred embodiment of the present invention illustrating a frontal-top-rearward panel of a secondary shelter shell.
Figure 61:
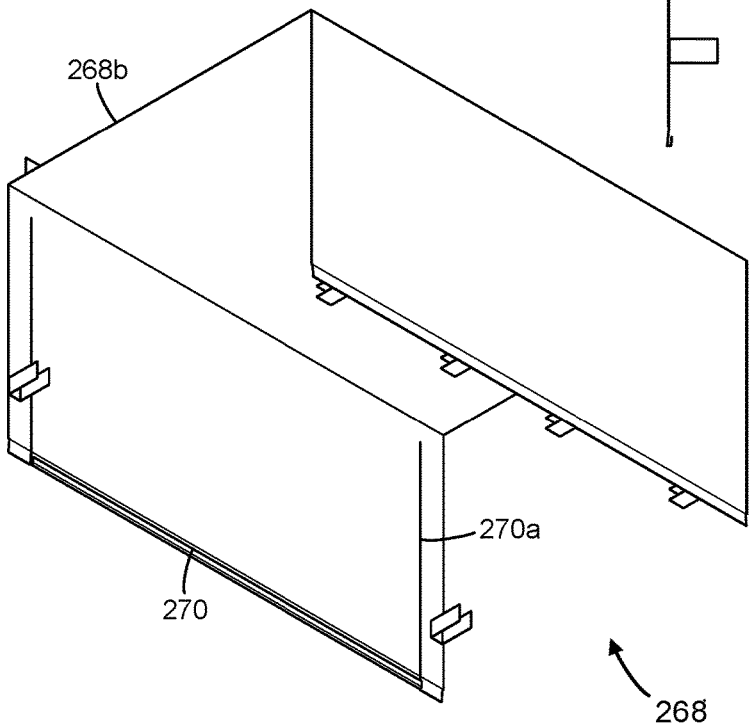
FIG. 61 is a bottom perspective view of the preferred embodiment of the present invention illustrating a frontal-top-rearward panel of a secondary shelter shell and having an access door.

Comparatively, the secondary shelter shell 226, as generally depicted in part in FIGS. 59-61, is shown therein as including a frontal-top-rearward panel 268 selectively positioned over front, top and back sides of the box frame 16, whereby a rearward side 268*a* of the frontal-top-rearward panel includes an access door 270 configured with a zipper 270*a* or equivalent closure mechanism to possibly cordon off an interior space formed by the box frame and interior area of the moveable frame assembly 18 or offer complete enclosure of the box frame 16, generally in instances of desirable non-use of or being disassembled apart from the moveable frame assembly 18.

Figure 2:
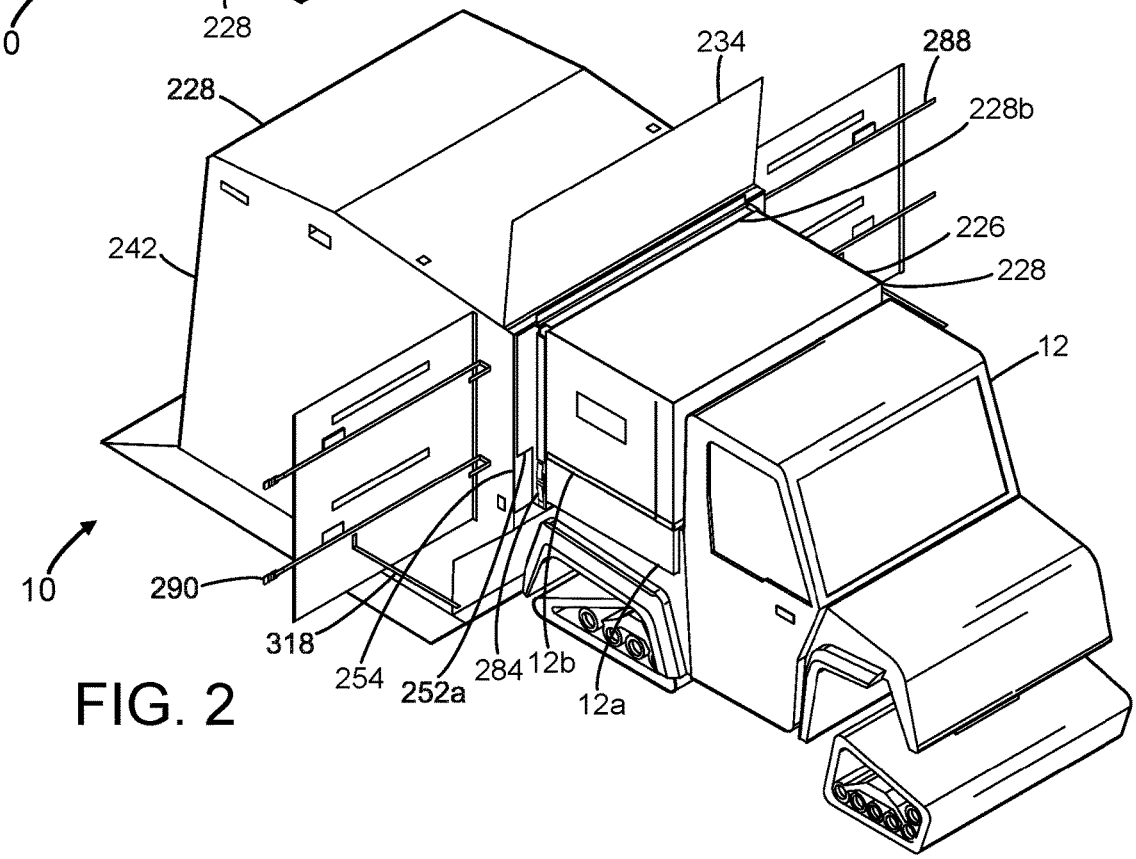
FIG. 2 is a front perspective view of the preferred embodiment of the present invention illustrating a primary shelter shell joined to a secondary shelter shell collectively covering a box frame and a moveable frame assembly and being attached to a vehicle.
Figure 56:
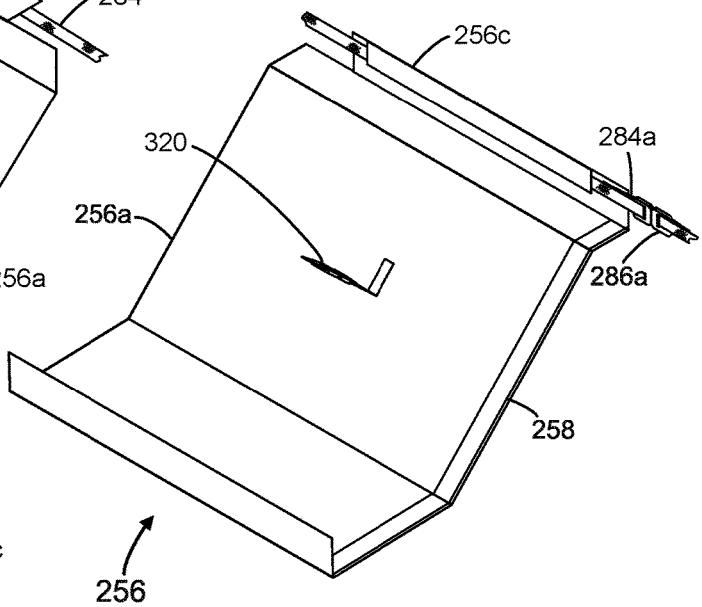
FIG. 56 is a front perspective view of the preferred embodiment of the present invention illustrating a companion bottom panel of a pair of bottom panels and having a formed sleeve.
Figure 57:
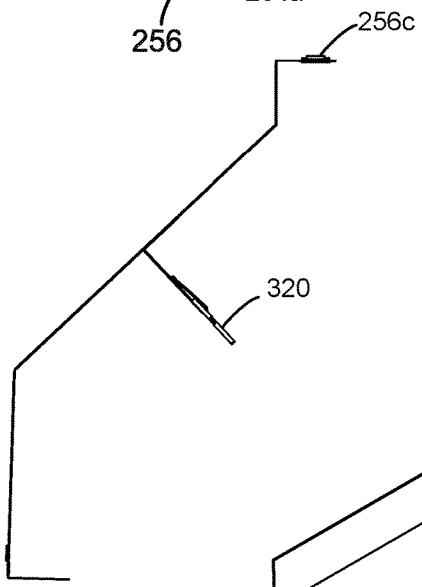
FIG. 57 is a side elevational view of the preferred embodiment of the present invention illustrating a companion bottom panel of a pair of bottom panels and having a buckle and strap assembly.
Figure 58:
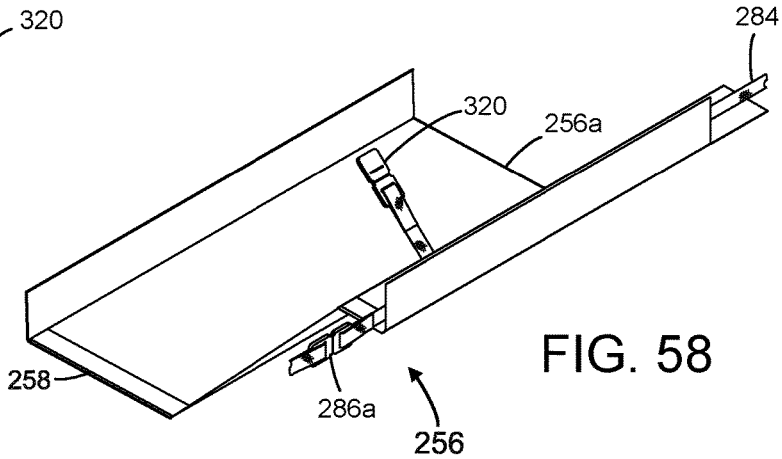
FIG. 58 is a top perspective view of the preferred embodiment of the present invention illustrating a companion bottom panel of a pair of bottom panels and having a buckle and strap assembly.
Figure 62:
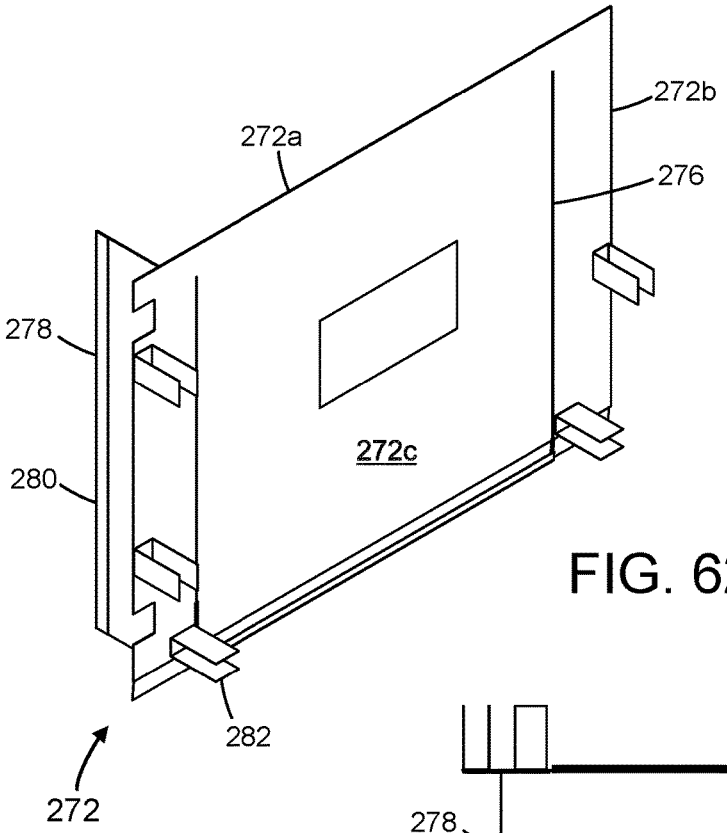
FIG. 62 is a top perspective view of the preferred embodiment of the present invention illustrating a box side panel of a secondary shelter shell.
Figure 63:
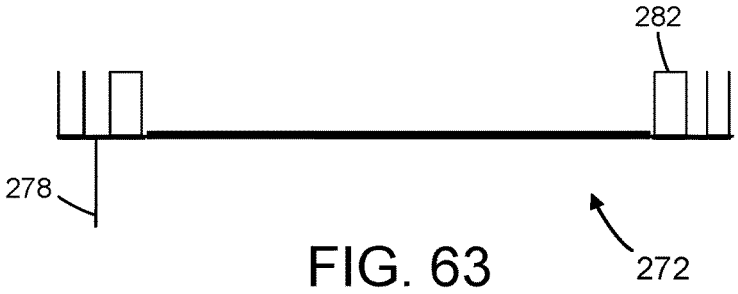
FIG. 63 is a bottom plan view of the preferred embodiment of the present invention illustrating a box side panel of a secondary shelter shell.
Figure 64:
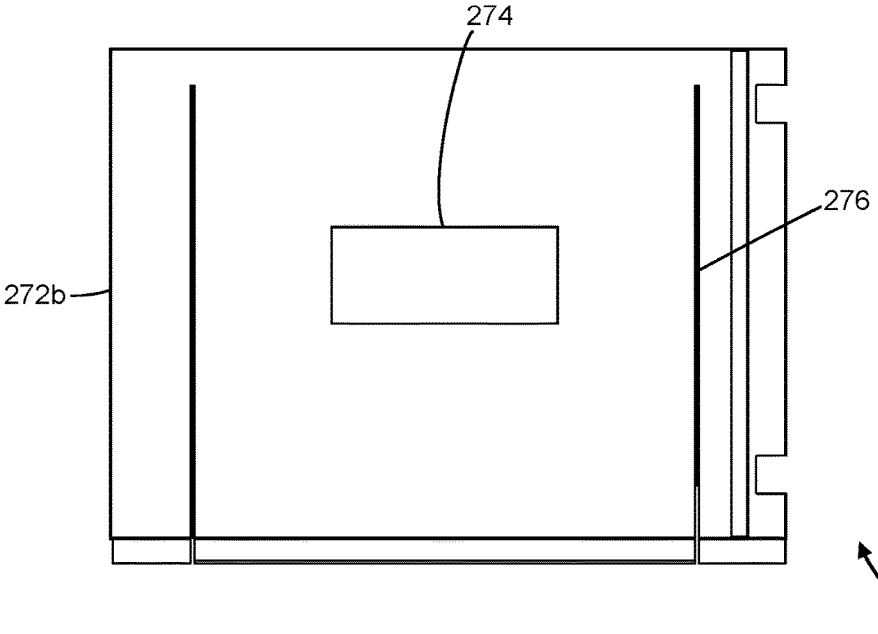
FIG. 64 is a side elevational view of the preferred embodiment of the present invention illustrating a box side panel of a secondary shelter shell and having a zippered door.

In completing enclosure of the box frame, as depicted in FIGS. 62-64, the secondary shelter shell 226 includes a pair of box side panels 272 each having an upper perimeter 272*a* and a pair of sideward edges 272*b* sewnly attached to a common sideward edge 268*b* of the frontal-top-rearward panel 268. Other aspects of each box side panel as in FIGS. 62 and 64 include an optional window 274 and zippered door 276 to gain convenient access to the interior space of the box frame and an integral sideward flap 278 configured with a hook-and-loop fastener 280 that selectively mates with a hook-and-loop fastener 252*a* integral to the structure of the sideward closure flap 252 of the side panel 242, of which supplementally serves to protectively enclose the elongate area 254 formed in between the upright support 88 of the supportive wind wall and corner post 22 of the box frame. Connection of the secondary shelter shell 226 to the box frame 16 is fulfilled by a plurality of straps 282 with each extending outwardly from an interior side 268*c*, 272*c* of the frontal-top-rearward panel and box side panel 272 and being configured with a fastener of the type generally associated, for example, with the top-rearward panel. In advancing a tight seal between the primary shelter and secondary shelter shells, an assembly of segmented straps 284 as in FIGS. 2, 56 and 58 are provided to slidably fit and reside within formed sleeves 252*b*, 228*b*, 256*c* respectively integral to the sideward closure flap 252 of the side panel 242, top-rearward panel 228, and pair of bottom panels 256. Fasteners 286 in the form of a buckle 286*a*, hook-and-loop fasteners, snaps, buttons, or equivalent provide means for connecting together ends 284*a* of the segmented straps.

Now by way of briefly exemplifying description of the assembly and functionally of the portable shelter 10, one may appreciably gain further insight into the relatedness and interaction of the operative components discussed thus far that principally fulfill the utilitarian objects of the invention.

The box frame 16 is initially assembled by way of connecting together the corner posts 22 with that of the upper and lower horizontal members 24, 26 with structural provisions being made for mounting one or more shelves. The resultant box frame is selectively positioned about the sidewalls 12*c* of the open cargo bay and partially fitted with the secondary shelter shell 226 before finalizing attachment to the open cargo bay 12*a* by way of the turnbuckles 66.

Comparatively, the moveable frame assembly 18 is preferably assembled in whole as a structure without the primary shelter shell 224 before being fixedly attached to the box frame, where in particular the supportive wind wall 84 pivotally connects to the lower wind wall 86 and the pair of sideward arms 100 followed by the primary canopy pivotally connecting to the sideward arms, the ground brace 148 pivotally connecting to the primary canopy 132, and the secondary canopy 134 pivotally connecting to the sideward arms. In fulfilling manual operation for contraction and expansion of the portable shelter 10, the supportive extending assembly, which preferably exists in form as pairs of angular moveable supports or telescopic supports, are selectively mounted within the structure of the moveable frame assembly. Regardless of using either the angular moveable supports or telescopic supports, which are shown in FIGS. 29 and 30 as connectively spanning from the upright supports of the supportive wind wall to the sideward arms 100, each possesses capabilities for pivotally moving the sideward arms outwardly from and inwardly toward the upright supports 88 of the supportive wind wall 84 along path B in FIG. 30.

Once in assembled form, the moveable frame assembly 18 is selectively located in vicinity of the box frame and positioned in a manner to allow the supportive plates connected to the rearward corner post 22 of the box frame 16 and supportive wind wall 84 to engagingly mate with one another, where in particular the supportive plates 102 mounted to the supportive wind wall rest upon the complementary supportive plates 104 affixed to and extending outwardly from the rearward corner posts. A bolt and nut assembly 106 accompanying and fitting to each of the mating, overlapping supportive plates consummates a secured connection of the moveable frame assembly to the box frame. After attachment in this regard, the primary shelter shell 224 is fitted relatively about and over the moveable frame assembly 18 and affixed thereto by means of the straps 262, with sideward closure flaps 252 of the side panel 242 of the primary shelter shell engagingly mating with the integral sideward flap 278 of the box side panels 272 of the secondary shelter shell 226 by way of the hook-and-loop fasteners.

Figure 65:
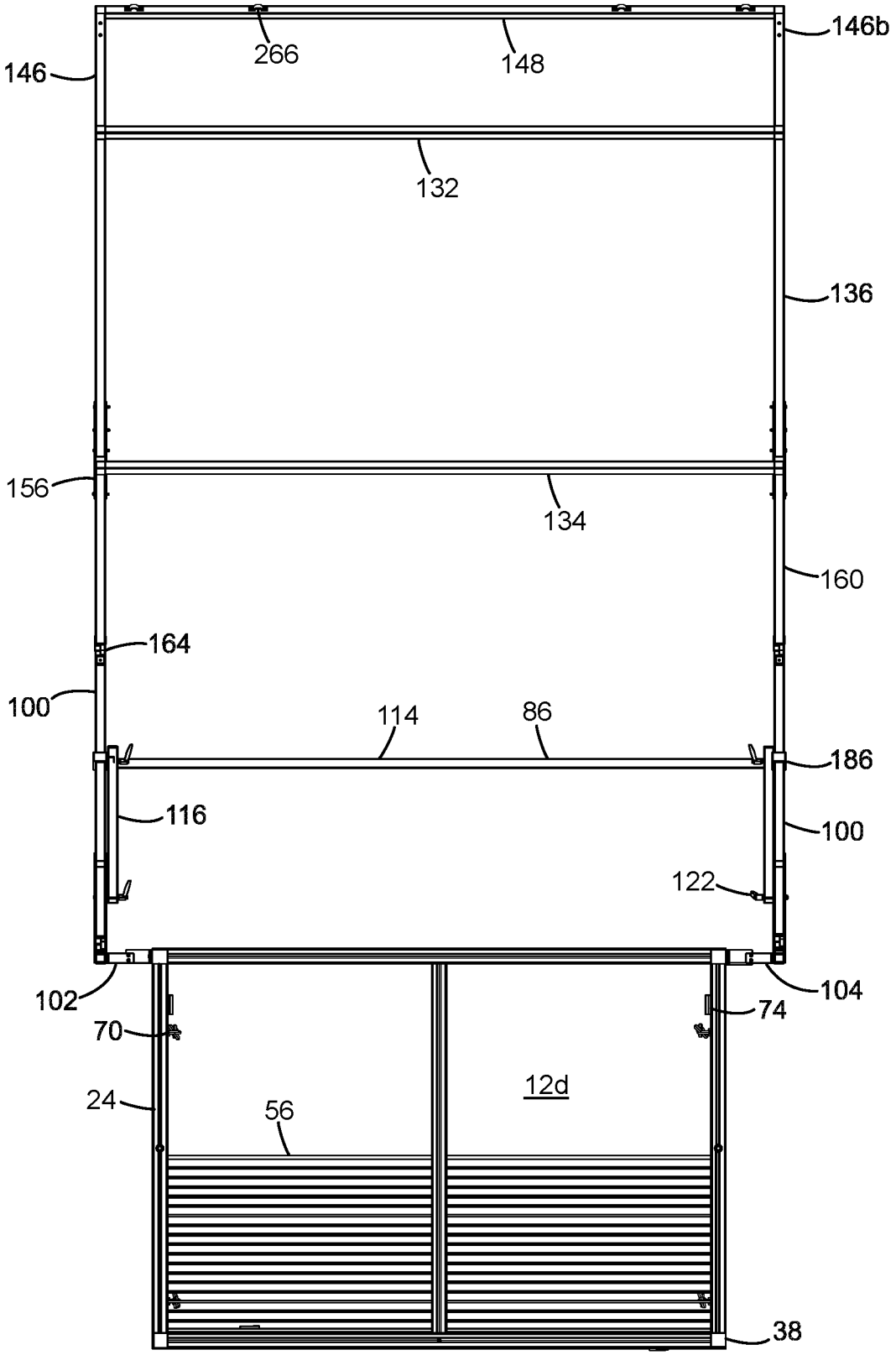
FIG. 65 is a top plan view of the preferred embodiment of the present invention illustrating a moveable frame assembly presented in expanded form and connecting to a box frame configured with a shelf platform.

In operational configurations of the portable shelter 10, the moveable frame assembly, as associatively attached to the box frame 16, is presented in expanded form with and without attachment of the primary shelter shell 224, as in FIGS. 30 and 65, and, conversely, in contracted form, as in FIGS. 27 and 28 to permit encasement thereof by way of the integral assembly of flaps 20, particularly the extending top flap 234 and elongate sideward flap 250, with provisions for securement thereof by multiple elongate straps 288 configured with fasteners 290 in the form of buckles 290*a*, hook-and-loop fasteners, snaps, buttons, ties, or equivalent, primarily in preparation of transport.

In the exemplary instance of using the angular movable supports 182 to yield overall contraction of the moveable frame assembly 18, the arm-encompassing sleeves 190 of the slidable yoke assembly 186 are slidably moved along the sideward arms 100 in the direction of A' in FIG. 30 toward the inward end 100*a* of the sideward arm, where in particular the sideward arms will pivot relatively at PB-B while moving inwardly along path B in the direction of B' toward the supportive wind wall. At the same time, the primary and secondary canopies will respectively pivot relatively at PB-C and PB-D while moving inwardly along paths C and D in the directions of C' and D' toward the sideward arms followed by the ground brace pivoting at PB-E and moving inwardly along path E in the direction of E' toward the primary canopy to attain an overall compact arrangement of the moveable frame assembly to the likes shown in FIG. 27. An end cap 92*c* of the type shown in FIG. 21 may be fitted to the second end 92*b* of each of the lower outward members to offer protection of the sideward arm as it comes in proximity to the upright support 88. Conversely, in fulfilling expansion of the movable frame assembly 18 to the likes shown in FIGS. 30, the arm-encompassing sleeve 190 of the slidable yoke assembly are slidably moved in the direction of A" downwardly along the sideward arms 100 toward the outward end 100*c* thereof to the extent of intercepting one of a plurality of settable stops 292 desirably set and located about the length of the sideward arm, mainly represented by a cross pin 292*a* or like structure, whereby the sideward arms move outwardly from the supportive wind wall 84 along path B in the direction of B" while the primary and secondary canopies respectively move and unfold along paths C and D in the direction of C" and D" to the extent of reaching the maximum, desirable length of limiting straps 294 individually mounting to and extending from each of the primary and secondary canopies to the sideward arms, as typically illustrated in FIG. 24. Approximately at the same time, the ground brace 148 will move outwardly from the primary canopy along path E in the direction of E" and continue to unfold to the extent that the cross member 178 of the ground brace engages the ground's surface.

In an alternative instance of using telescopic supports 202 for effecting manual movement of the moveable frame assembly 18, overall operability of the sideward arms, primary and secondary canopies, and ground brace occurs in like manner described above for the angular moveable supports 182, primarily about their respective pivots, but differs with respect to the manner in which the telescopic supports operate in relation to the sideward arms. In this regard, the spring-loaded pin 216*c* is depressed and released from its mating aperture 210*c* to allow the inner slidable support 208 to freely and slidably move inward within the elongate sleeve 210, which simultaneously allows the sideward arms 100, primary and secondary canopies and ground brace to collectively move and collapse inwardly toward the supportive wind wall 84. Conversely, expansion of the movable frame assembly simply involves depression of the spring-loaded pin and manually applying an outward force to the sideward arms to extent of attaining a desirable position away and apart from the supportive wind wall, whereupon the canopies and ground brace will collectively unfold with the connected primary shelter shell while the spring-loaded pin is permitted to engage with one of the selected apertures such to lock the moveable frame assembly in place.

In using either the angular moveable supports 182 or telescopic supports to effect movement of the moveable frame assembly 18, consideration is given to the lower wind wall 86 in instances of storage and use of the portable shelter 10. Untightening the handle 130 allows the supportive framed structure 114 to freely pivot at PB-A and travel along path A and move inwardly and outwardly respectively in the direction of A' and A" toward and away from the supportive wind wall to assistively attain overall compactness and expansion of the moveable frame assembly.

Figure 66:
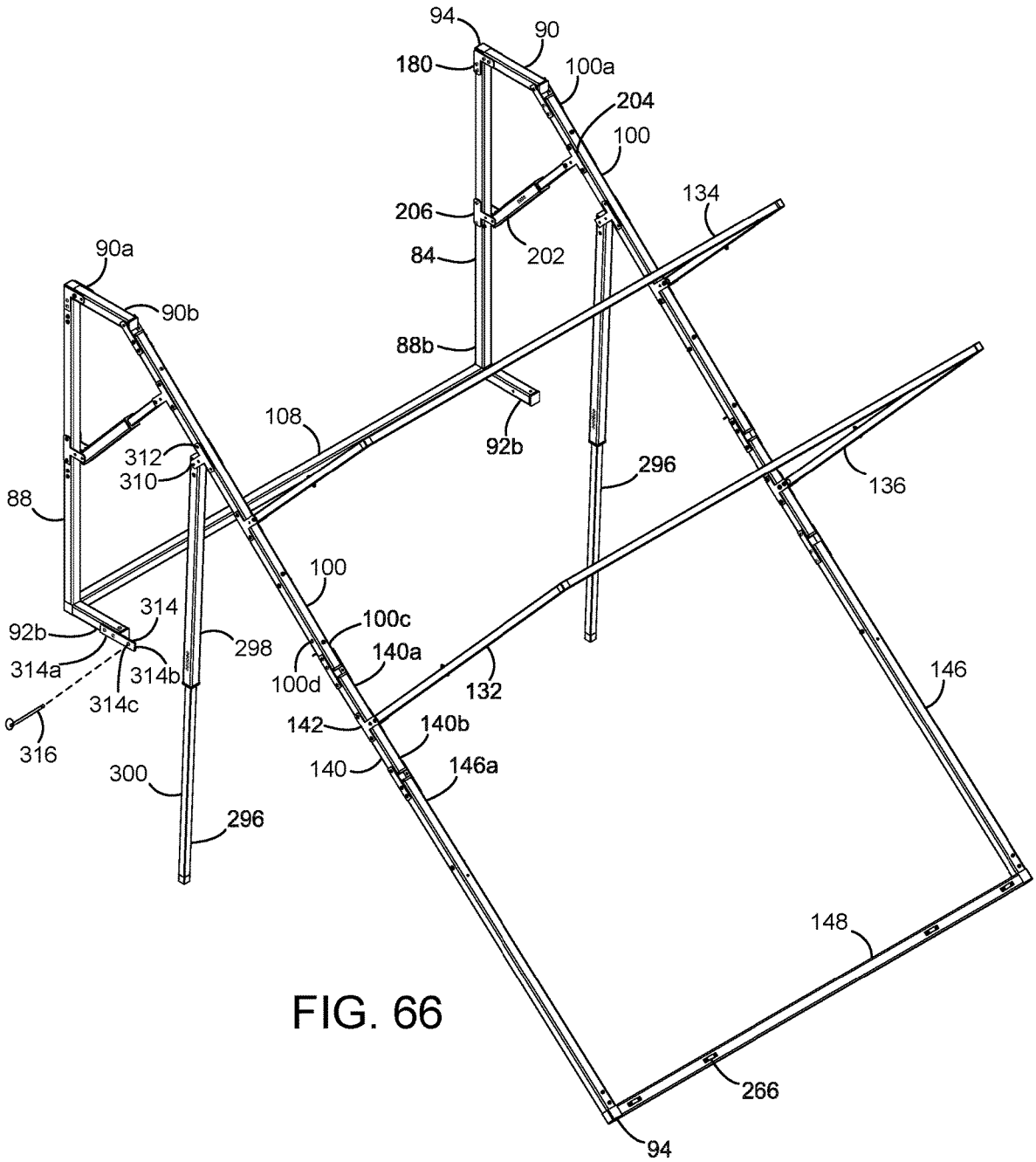
FIG. 66 is a front perspective view of the preferred embodiment of the present invention illustrating a supportive wind wall connecting to a moveable frame assembly in an expanded relation and a pair of telescopic support poles connecting to sideward arms.
Figure 67:
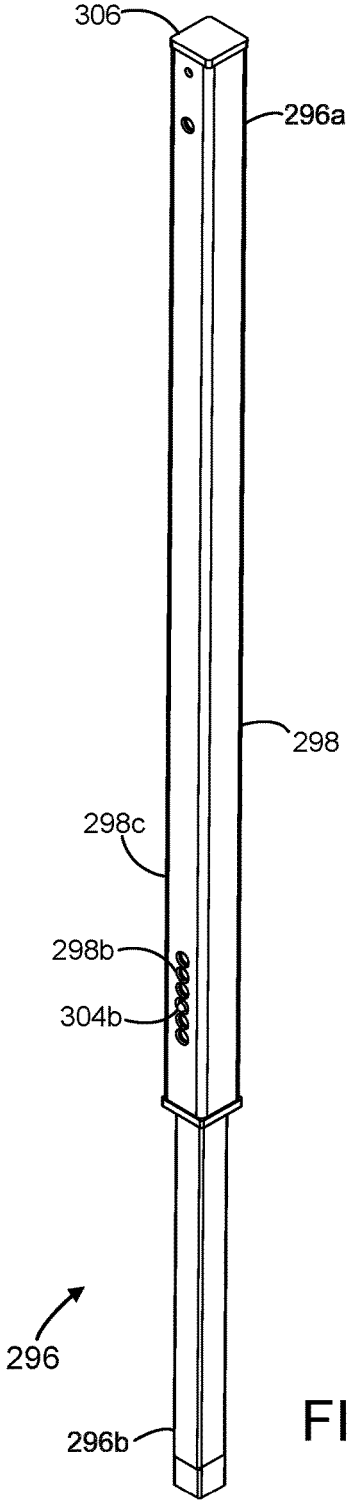
FIG. 67 is a rear perspective view of the preferred embodiment of the present invention illustrating a telescopic support pole having an elongate member slidably fitting within a lengthened sleeve.
Figure 68:
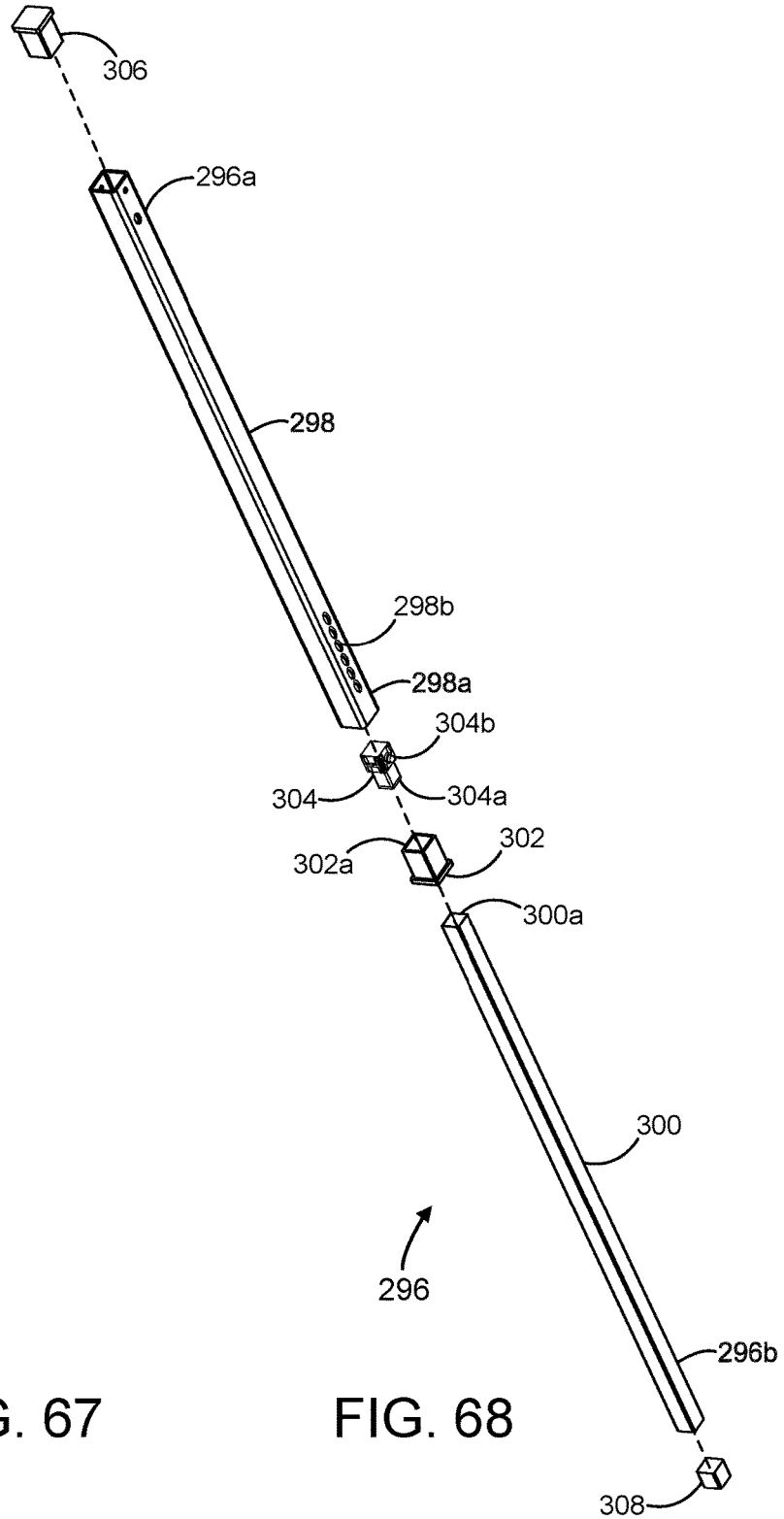
FIG. 68 is an exploded perspective view of the preferred embodiment of the present invention illustrating a telescopic support pole having an elongate member separable from a lengthened sleeve, a fitted bushing, and a stop mechanism.

In an optional configuration of the portable shelter 10, as generally depicted in FIG. 66, a pair of telescopic support poles 296 may be used in lieu of or in conjunction with the lower wind wall 86 to supplement overall support to the moveable frame assembly 18 and advance options for connecting the primary shelter shell 224. Like the telescopic supports 202 in terms of overall features and function, as operably associated with the sideward arms, each of the telescopic support poles as in FIGS. 67 and 68 includes a lengthened sleeve 298 for housing and slidably accepting a portion of an elongate member 300. An open end 298*a* of the lengthened sleeve includes a fitted bushing 302 configured with an opening 302*a* to permit select passage of the elongate member, whereas an open end 300*a* of the elongate member is fitted with an insertable end 304*a* of a stop mechanism 304, of which is configured with a pin 304*b* of conventional form or equivalent structure for engaging with one of a plurality of apertures 298*b* extending through a wall section 298*c* of the lengthened sleeve. By and through the act of disengaging and engaging the pin at the appropriate or pre-select aperture advances fixed connectivity of the lengthened sleeve 298 with that of the elongate member 300, particularly being advantageous in setting the overall length of the telescopic support poles to aptly correspond with the cross member 178 of the ground brace generally residing relatively at ground's surface as well as for stowing alongside the moveable frame assembly in contractive form. In other regards, each of the telescopic support poles 296 may be fitted with an end cap 306 and a foot pad 308 respectively at its first and second ends 296*a*, 296*b*. Connectivity of each of the telescopic support poles to the moveable frame assembly 18 is preferably advanced by a pair of T-brackets 310 mountable in an opposing manner relatively about the sideward arms 100 by fastening means, such as a bolt and nut assembly 312 or equivalent, generally at a location in between the supportive extending assembly and the secondary canopy 134 collectively connecting to the sideward arms 100. In fulfilling capabilities for compactness with that of the moveable frame assembly and securement therewith, each of the lower outward arms 92 may be fitted with an in-line plate 314 as in FIG. 66, whereby a fixed end 314*a* thereof is attached to the second end 92*b* of the lower outward member 92, while a free end 314*b* thereof includes aperture 314*c* that aligns with an aperture 100*d* extending through the sideward arm. A spring pin 316 of conventional form is placed within the aligned arrangement of apertures to fulfill a locking relationship of the sidearm arm 100 with that of the supportive wind wall 84, particularly upon the instance the telescopic support poles are in a retractable relation and abutting the sideward arms in proximity to the upright supports 88.

In a typical, yet preferred approach for protectively encasing and wrapping the portable shelter 10 for storage and transport, the elongate sideward flaps 250 are moved inwardly and folded to cover a majority of the primary shelter shell 224 from behind, whereby hook-and-loop fasteners 250*a* existing along an outer leading edge 250*b* engagingly mate with one another, while ends 288*a* of the elongate straps 288 are secured together by the buckle 290*a* or equivalent. Subsequently, a pair of lower elongate straps 318 each connectively extending from the elongate sideward flaps 250 are positioned to engagingly mate with a buckle and strap assembly 320 associated with the pair of bottom panels 256. In completing encapsulation of the contracted moveable frame assembly, the extending top flap 234 is downwardly folded over the connected arrangement of the elongate sideward flaps 250 to permit hook-and-loop fasteners 234*a*, 250*a* respectively associated with a leading edge 234*b* of the extending top flap and on an exterior surface 250*c* of the elongate sideward flaps to engagingly mate with one another. Comparatively, in instances where the moveable frame assembly 18 is expanded for utilitarian purposes of occupancy, the elongate sideward flaps may be rolled and bounded by one or more sideward straps 322 extending from and connecting to the side panels 242, whereby fasteners 322*a* such as a buckle or equivalent secures ends of sideward straps for fulfilling compact storage of the elongate sideward flaps alongside the side panels.

It is obvious that the components comprising the portable shelter 10 may be fabricated from a variety of materials, providing such selection or use of materials possess the capacity to withstand forces acting thereon throughout its duration of use as well as limiting occurrences of premature failure due to repeated forces acting thereon during contraction and expansion of the moveable frame assembly 18. Accordingly, it is most desirable, and therefore preferred, to construct the portable shelter 10, namely, components of the box frame 16 and moveable frame assembly from extruded aluminum, high tensile strength plastic, polymer composites, or an equivalent type of material that meaningfully offers reasonable structural strength for its weight, while limiting the extent by which the components may unacceptably fail due to applied stresses.

While there has been shown and described a particular embodiment of the invention, it will be obvious to those skilled in the art that various changes and alterations can be made therein without departing from the invention and, therefore, it is aimed in the appended claims to cover all such changes and alterations which fall within the true spirit and scope of the invention.

What is claimed is:

1. A portable multi-hinged shelter for attachment to a vehicle having an open cargo bay formed by sidewalls, said multi-hinged shelter comprising, in combination:

a box frame adaptively mounting atop of and connecting to the open cargo bay;

a supportive wind wall adaptively attaching to said box frame and being substantially positioned rearward of the vehicle;

a moveable frame assembly having a pair of sideward arms each having an inward end pivotally connecting to said supportive wind wall and an outward end, a primary canopy pivotally connecting to said outward ends of the sideward arms, a secondary canopy pivotally connecting to said sideward arms relatively midway along thereof, and a ground brace pivotally connecting to said primary canopy;

a supportive extending assembly connectively spanning from said supportive wind wall to said sideward arms for assistively extending and supporting said moveable frame assembly; and a protective shell assembly adaptively fitting to and substantially covering said moveable frame assembly, said supportive wind wall, and said box frame.

2. The portable multi-hinged shelter as set forth in claim 1, further comprising a lower wind wall pivotally connecting to said supportive wind wall.

3. The portable multi-hinged shelter as set forth in claim 2, further comprising a pair of bottom panels removably attaching to said lower wind wall with each having a common interior edge fitted with a hook-and-loop fastener for temporarily connecting together said bottom panels.

4. The portable multi-hinged shelter as set forth in claim 1, wherein said protective shell assembly comprises a primary shelter shell adaptively fitting to and substantially covering said moveable frame assembly and said supportive wind wall and a secondary shelter shell adaptively fitting to and substantially covering said box frame.

5. The portable multi-hinged shelter as set forth in claim 4, wherein said primary shelter shell comprises a pair of side panels each having a common perimeter edge and a top-rearward panel having a pair of common sideward edges each connecting to and along said common perimeter edge of one of the side panels.

6. The portable multi-hinged shelter as set forth in claim 5, wherein said primary shelter shell further comprises an integral assembly of flaps extending outwardly from and connecting to each of said side panels and said top-rearward panel for covering and enclosing said primary shelter shell while said moveable frame assembly attains a state of compactness for storage and transport.

7. The portable multi-hinged shelter as set forth in claim 5, wherein each of said side panels comprises an integrated door for gaining access into said primary shelter shell while said moveable frame assembly attains a state of expansion.

8. The portable multi-hinged shelter as set forth in claim 4, wherein said secondary shelter shell comprises a frontal-top-rearward panel having a pair of common sideward edges and a pair of box side panels each having a pair of sideward edges and an upper perimeter collectively attached to and along one of said common sideward edges of the frontal-top-rearward panel.

9. The portable multi-hinged shelter as set forth in claim 1, wherein said supportive extending assembly comprises a pair of angular moveable supports each having a rigid member configured with a first end and a second end, a slidable yoke assembly having an arm-encompassing sleeve capable of slidably fitting to one of said sideward arms, a pair of flanges integrally connecting to and extending outwardly from said arm-encompassing sleeve to form an inner slot and an end-mountable pivot bracket fixedly fitting to said first end of the rigid member and configured with a center-positioned protuberance fitting within said inner slot and pivotally connecting therewith, a pivot bracket assembly having an end-mountable bracket fixedly fitting to said second end of the rigid member and configured with an off-setting protuberance, a plate-mountable bracket fixedly attaching to said supportive wind wall and configured with an off-setting protuberance and pivot fastening means for pivotally connecting together said off-setting protuberances.

10. The portable multi-hinged shelter as set forth in claim 9, wherein said arm-encompassing sleeve is capable of slidably moving along one of said sideward arms toward said inward end or said outward end thereof to correspondingly move said sideward arms, said primary canopy, and said ground brace respectively inward toward or outward from said supportive wind wall to attain contraction or expansion of said moveable frame assembly.

11. The portable multi-hinged shelter as set forth in claim 1, wherein said supportive extending assembly comprises a pair of telescopic supports each configured with a first end pivotally connecting to one of said sideward arms and a second end pivotally connecting to said supportive wind wall and having an inner slidable support configured with an open end, an elongate sleeve configured with a first open end and a second open end and capable of accommodating therewithin a portion of said inner slidable support, a fitted stop mechanism having an insertable end fitting to said open end of the inner slidable support and an enlarged portion configured with a spring-loaded pin and capable of slidably fitting interiorly within said elongate sleeve, said elongate sleeve having a wall section configured with a plurality of apertures for accepting said spring-loaded pin to advance a fixed relation of said inner slidable support relatively to said elongate sleeve.

12. The portable multi-hinged shelter as set forth in claim 1, wherein said box frame comprises upper horizontal members, lower horizontal members and corner posts, each of said corner posts having a first end supporting and connecting to one or more of said upper horizontal members and a second end connecting to one or more of said lower horizontal members.

13. The portable multi-hinged shelter as set forth in claim 12, further comprising a plurality of alignment plates for aligning said box frame relatively about the open cargo bay, each of said alignment plates having a top planar element engaging and attaching to said lower horizontal member and a sideward planar element integrally connecting to said top planar element and engaging one of the sidewalls of the open cargo bay.

14. The portable multi-hinged shelter as set forth in claim 13, further comprising a plurality of turnbuckles for securing said box frame to the open cargo bay, each of said turnbuckles having a pair of ends with one end thereof engaging and attaching to said lower horizontal member and the other end thereof engaging and attaching to a bottom surface of the open cargo bay.

15. The portable multi-hinged shelter as set forth in claim 14, wherein said box frame further comprises a pair of vertically orientated intermediate members each having ends respectively connecting to said upper and lower horizontal members, a pair of shelf supports each having ends respectively connecting to said corner post and said vertically orientated intermediate member, and a shelf platform situated atop of and mounted to said shelf supports.

16. The portable multi-hinged shelter as set forth in claim 1, wherein said primary canopy comprises a pair of shortened arms, a cross member having ends, and a pair of sideward members each having a first end connecting to one of said ends of the cross member and a second end connecting to one of said shortened arms relatively midway along thereof.

17. The portable multi-hinged shelter as set forth in claim 16, wherein said secondary canopy comprises a cross support having ends and a pair of sideward members each having a first end connecting to one of said ends of the cross support and a second end pivotally connecting to one of said sideward arms.

18. The portable multi-hinged shelter as set forth in claim 17, wherein said ground brace comprises a cross member having ends and a pair of sideward supports each having a first end pivotally connecting to one of said shortened arms and a second end connecting to one of said ends of the cross member.

19. The portable multi-hinged shelter as set forth in claim 1, wherein said supportive wind wall comprises a pair of upper outward members each having a first end and a second end, a pair of lower outward members each having a first end and a second end, a pair of upright supports each having a top end and a bottom end respectively connecting to said first end of one of the upper outward members and said first end of one of the lower outward members, a lower support member having a pair of ends respectively connecting to said bottom ends of the upright supports.

20. The portable multi-hinged shelter as set forth in claim 19, wherein said lower wind wall comprises a pair of rotatable arms each configured with a first end pivotally connecting to said second end of one of the lower outward members and a second end and a supportive framed structure having a cross beam configured with ends and a pair of supportive end members each configured with a first end connecting to one of said ends of the cross beam and a second end pivotally connecting to said second end of one of the rotatable arms.

21. The portable multi-hinged shelter as set forth in claim 19, wherein each of said upright supports comprises at least one pair of supportive plates connecting therewith and extending outwardly therefrom and each of said corner posts substantially positioned rearward of the open cargo bay comprises a pair of complementary supportive plates connecting therewith and extending outwardly therefrom to attachably connect with said supportive plates associated with the upright supports.

22. The portable multi-hinged shelter as set forth in claim 1, wherein said supportive wind wall comprises a pair of dual-mountable pivot plates each configured with an attachable end and a pivoting end, a pair of lower outward members each having a first end and a second end, a pair of upright supports each having a top end fixedly attaching to said attachable end of one of the dual-mountable pivot plates and a bottom end connecting to said first end of one of the lower outward members, a lower support member having a pair of ends respectively connecting to said bottom ends of the upright supports.

23. The portable multi-hinged shelter as set forth in claim 1, further comprising a pair of telescopic support poles each configured with a first end and a second end and having an elongate member configured with an open end, a lengthened sleeve for housing and slidably accepting a portion of said elongate member and having a wall section configured with a plurality of apertures extending therethrough, and a stop mechanism having an insertable end fitting to said open end and a pin for engaging with one of said apertures, said telescopic support poles pivotally connecting individually to one of said sideward arms.

24. A portable multi-hinged shelter for attachment to a vehicle having an open cargo bay formed by sidewalls, said multi-hinged shelter comprising, in combination:

a box frame adaptively mounting atop of and connecting to the open cargo bay;

a supportive wind wall adaptively attaching to said box frame and being substantially positioned rearward of the vehicle;

a moveable frame assembly having a pair of sideward arms each having an inward end pivotally connecting to said supportive wind wall and an outward end, a primary canopy pivotally connecting to said outward ends of the sideward arms, a secondary canopy pivotally connecting to said sideward arms relatively midway along thereof, and a ground brace pivotally connecting to said primary canopy;

a pair of telescopic supports each configured with a first end pivotally connecting to one of said sideward arms and a second end pivotally connecting to said supportive wind wall and having an inner slidable support configured with an open end, an elongate sleeve configured with a first open end and a second open end and capable of accommodating therewithin a portion of said inner slidable support, a fitted stop mechanism having an insertable end fitting to said open end of the inner slidable support and an enlarged portion configured with a spring-loaded pin and capable of slidably fitting interiorly within said elongate sleeve, said elongate sleeve having a wall section configured with a plurality of apertures for accepting said spring-loaded pin to advance a fixed relation of said inner slidable support relatively to said elongate sleeve; and a protective shell assembly adaptively fitting to and substantially covering said moveable frame assembly, said supportive wind wall, and said box frame.

25. The portable multi-hinged shelter as set forth in claim 24, wherein said supportive wind wall comprises a pair of upper outward members each having a first end and a second end, a pair of lower outward members each having a first end and a second end, a pair of upright supports each having a top end and a bottom end respectively connecting to said first end of one of the upper outward members and said first end of one of the lower outward members, a lower support member having a pair of ends respectively connecting to said bottom ends of the upright supports.

26. The portable multi-hinged shelter as set forth in claim 24, further comprising a lower wind wall having a pair of rotatable arms each configured with a first end pivotally connecting to said second end of one of the lower outward members and a second end and a supportive framed structure having a cross beam configured with ends and a pair of supportive end members each configured with a first end connecting to one of said ends of the cross beam and a second end pivotally connecting to said second end of one of the rotatable arms.

27. The portable multi-hinged shelter as set forth in claim 26, wherein said primary canopy comprises a pair of shortened arms, a cross member having ends, and a pair of sideward members each having a first end connecting to one of said ends of the cross member and a second end connecting to one of said shortened arms relatively midway along thereof, said secondary canopy comprises a cross support having ends and a pair of sideward members each having a first end connecting to one of said ends of the cross support and a second end pivotally connecting to one of said sideward arms, and said ground brace comprises a cross member having ends and a pair of sideward supports each having a first end pivotally connecting to one of said shortened arms and a second end connecting to one of said ends of the cross member.

28. The portable multi-hinged shelter as set forth in claim 26, wherein said primary canopy comprises a pair of dual triangulated pivot plates each having a pair of outward ends, a cross member having ends, and a pair of sideward members each having a first end connecting to one of said ends of the cross member and a second end connecting to one of said dual triangulated pivot plates relatively midway along thereof, said secondary canopy comprises a cross support having ends and a pair of sideward members each having a first end connecting to one of said ends of the cross support and a second end pivotally connecting to one of said sideward arms relatively midway along thereof, said ground brace comprises a cross member having ends and a pair of sideward supports each having a first end pivotally connecting to one of said outward ends of one of the dual triangulated pivot plates and a second end connecting to one of said ends of the cross member.

29. A portable multi-hinged shelter for attachment to a vehicle having an open cargo bay formed by sidewalls, said multi-hinged shelter comprising, in combination:

a box frame adaptively mounting atop of and connecting to the open cargo bay;

a supportive wind wall adaptively attaching to said box frame and being substantially positioned rearward of the vehicle;

a moveable frame assembly having a pair of sideward arms each having an inward end pivotally connecting to said supportive wind wall and an outward end, a primary canopy pivotally connecting to said outward ends of the sideward arms, a secondary canopy pivotally connecting to said sideward arms relatively midway along thereof, and a ground brace pivotally connecting to said primary canopy;

a pair of angular moveable supports each having a rigid member configured with a first end and a second end, a slidable yoke assembly having an arm-encompassing sleeve capable of slidably fitting to one of said sideward arms, a pair of flanges integrally connecting to and extending outwardly from said arm-encompassing sleeve to form an inner slot and an end-mountable pivot bracket fixedly fitting to said first end of the rigid member and configured with a center-positioned protuberance fitting within said inner slot and pivotally connecting therewith, a pivot bracket assembly having an end-mountable bracket fixedly fitting to said second end of the rigid member and configured with an off-setting protuberance, a plate-mountable bracket fixedly attaching to said supportive wind wall and configured with an off-setting protuberance and pivot fastening means for pivotally connecting together said off-setting protuberances; and a protective shell assembly adaptively fitting to and substantially covering said moveable frame assembly, said supportive wind wall, and said box frame.

30. The portable multi-hinged shelter as set forth in claim 29, further comprising a lower wind wall having a pair of rotatable arms each configured with a first end pivotally connecting to said second end of one of the lower outward members and a second end and a supportive framed structure having a cross beam configured with ends and a pair of supportive end members each configured with a first end connecting to one of said ends of the cross beam and a second end pivotally connecting to said second end of one of the rotatable arms.

31. The portable multi-hinged shelter as set forth in claim 29, wherein said supportive wind wall comprises a pair of dual-mountable pivot plates each configured with an attachable end and a pivoting end, a pair of lower outward members each having a first end and a second end, a pair of upright supports each having a top end fixedly attaching to said attachable end of one of the dual-mountable pivot plates and a bottom end connecting to said first end of one of the lower outward members, a lower support member having a pair of ends respectively connecting to said bottom ends of the upright supports.

32. The portable multi-hinged shelter as set forth in claim 29, wherein said primary canopy comprises a pair of dual triangulated pivot plates each having a pair of outward ends, a cross member having ends, and a pair of sideward members each having a first end connecting to one of said ends of the cross member and a second end connecting to one of said dual triangulated pivot plates relatively midway along thereof, said secondary canopy comprises a cross support having ends and a pair of sideward members each having a first end connecting to one of said ends of the cross support and a second end pivotally connecting to one of said sideward arms relatively midway along thereof, said ground brace comprises a cross member having ends and a pair of sideward supports each having a first end pivotally connecting to one of said outward ends of one of the dual triangulated pivot plates and a second end connecting to one of said ends of the cross member.

* * * * *